US011801981B2

(12) United States Patent
Wetsch

(10) Patent No.: US 11,801,981 B2
(45) **Date of Patent: *Oct. 31, 2023**

(54) PACKAGING WITH SEALING MATERIALS HAVING DIFFERENT SEALING CONDITIONS

(71) Applicant: Pregis Innovative Packaging LLC, Deerfield, IL (US)

(72) Inventor: Thomas D. Wetsch, Naples, FL (US)

(73) Assignee: Pregis Innovative Packaging LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/365,548

(22) Filed: Jul. 1, 2021

(65) Prior Publication Data

US 2022/0002050 A1 Jan. 6, 2022

Related U.S. Application Data

(60) Provisional application No. 63/107,333, filed on Oct. 29, 2020, provisional application No. 63/107,312,
(Continued)

(51) Int. Cl.
*B65D 81/03* (2006.01)
*B65D 65/42* (2006.01)
(Continued)

(52) U.S. Cl.
CPC ..... *B65D 65/42* (2013.01); *B65B 51/10* (2013.01); *B65B 61/06* (2013.01); *B65B 61/24* (2013.01);
(Continued)

(58) Field of Classification Search
CPC ..... B65D 81/03; B65D 81/32; B65D 65/40; B65D 65/42; B65D 27/14; B65D 75/30;
(Continued)

(56) References Cited

U.S. PATENT DOCUMENTS 1,686,787 A 10/1928 Bates
1,974,339 A 9/1934 McDonald
(Continued)

FOREIGN PATENT DOCUMENTS

JP H07165266 A 6/1995
WO 2012033998 A2 3/2012
(Continued)

OTHER PUBLICATIONS

International Search Report and Written Opinion for International Application No. PCT/US21/40142, filed Jul. 1, 2021, dated Nov. 23, 2021.

*Primary Examiner* — King M Chu
(74) *Attorney, Agent, or Firm* — Fox Rothschild LLP

(57) ABSTRACT

Packaging material is provided. The packaging material can include at least one web layer having a surface that includes first and second regions. When corresponding first regions are overlaid with each other and corresponding second regions are overlaid with each other, the overlaid first and second regions can cooperatively surround a cavity. The packaging material further can include a first sealing material disposed in the first region and configured to seal together the corresponding first regions upon application of first conditions to the first sealing material, and a second sealing material disposed in the second region and configured to seal together the corresponding second regions upon application of second conditions to the second sealing material. The second sealing material can be configured such that the first conditions applied to the second sealing material are insufficient to cause the second sealing material to seal.

24 Claims, 35 Drawing Sheets

Related U.S. Application Data filed on Oct. 29, 2020, provisional application No. 63/105,420, filed on Oct. 26, 2020, provisional application No. 63/069,571, filed on Aug. 24, 2020, provisional application No. 62/706,110, filed on Jul. 31, 2020, provisional application No. 63/046,828, filed on Jul. 1, 2020.

(51) Int. Cl.

| | |
|---|---|
| ***B65D 65/40*** | (2006.01) |
| ***B65D 27/14*** | (2006.01) |
| ***B65D 75/30*** | (2006.01) |
| ***B65D 75/42*** | (2006.01) |
| ***B65D 75/52*** | (2006.01) |
| ***B65D 81/32*** | (2006.01) |
| ***B65B 51/10*** | (2006.01) |
| ***B65B 61/06*** | (2006.01) |
| ***B65B 61/24*** | (2006.01) |
| ***B65B 67/12*** | (2006.01) |

(52) U.S. Cl.

CPC ..... *B65B 67/1255* (2013.01); *B65D 27/14* (2013.01); *B65D 65/40* (2013.01); *B65D 75/30* (2013.01); *B65D 75/42* (2013.01); *B65D 75/527* (2013.01); *B65D 81/03* (2013.01); *B65D 81/3266* (2013.01); *B65B 2067/1283* (2013.01); *B65D 2581/02* (2013.01)

(58) Field of Classification Search

CPC ..... B65D 75/58; B65D 27/06; B65D 27/34; B65D 27/38; B65D 27/16; B65D 27/30

USPC ..... 206/523, 524, 484; 229/305, 310, 71, 76

See application file for complete search history.

(56) References Cited

U.S. PATENT DOCUMENTS

| | | | | |
|---|---|---|---|---|
| 2,649,199 | A | 8/1953 | Werman | |
| 2,847,915 | A | 8/1958 | Rapp | |
| 3,140,816 | A | 7/1964 | Schultz | |
| 3,359,703 | A | 12/1967 | Quaadgras | |
| 3,469,769 | A | 9/1969 | William | |
| 3,642,550 | A | 2/1972 | Doll | |
| 3,750,907 | A * | 8/1973 | Steele | C08L 63/00 206/524.2 |
| 3,868,056 | A | 2/1975 | Keren | |
| 4,193,499 | A | 3/1980 | Lookholder | |
| 4,232,788 | A | 11/1980 | Roth | |
| 4,620,633 | A | 11/1986 | Lookholder | |
| 4,726,804 | A | 2/1988 | Stitcher | |
| 4,738,391 | A | 4/1988 | Wiseman | |
| 4,999,975 | A | 3/1991 | Willden et al. | |
| 5,129,519 | A | 7/1992 | David et al. | |
| 5,391,136 | A | 2/1995 | Makowka | |
| 5,429,576 | A | 7/1995 | Doderer-Winkler | |
| 6,410,119 | B1 | 6/2002 | De Luca et al. | |
| 6,435,348 | B1 | 8/2002 | Pasquesi | |
| 6,652,933 | B2 | 11/2003 | Hall | |
| 6,713,137 | B1 * | 3/2004 | Andersson | B32B 27/32 428/35.2 |
| 7,807,253 | B2 | 10/2010 | Kannankeril | |
| 7,926,507 | B2 | 4/2011 | Wetsch et al. | |
| 8,061,110 | B2 | 11/2011 | Wetsch | |
| 8,128,770 | B2 | 3/2012 | Wetsch et al. | |
| 8,746,483 | B2 | 6/2014 | Sierra-Gomez et al. | |
| 9,615,642 | B2 | 4/2017 | Bergh et al. | |
| 9,827,711 | B2 | 11/2017 | Wetsch et al. | |
| 10,183,458 | B2 | 1/2019 | Fu et al. | |
| 10,870,535 | B2 | 12/2020 | Olness | |
| 10,926,935 | B2 | 2/2021 | Martin | |
| 11,084,637 | B1 | 8/2021 | Hoffman | |
| 2003/0211268 | A1 | 11/2003 | Hillemann et al. | |
| 2004/0000581 | A1 | 1/2004 | Brandolini et al. | |
| 2008/0092488 | A1 | 4/2008 | Gabrielsen et al. | |
| 2010/0092758 | A1 * | 4/2010 | Slovencik | B65D 81/052 425/542 |
| 2010/0282824 | A1 | 11/2010 | Kannankeril et al. | |
| 2010/0330330 | A1 | 12/2010 | Luca et al. | |
| 2011/0153527 | A1 * | 6/2011 | Smythe | B65D 27/38 705/500 |
| 2011/0172072 | A1 | 7/2011 | Wetsch et al. | |
| 2014/0261752 | A1 | 9/2014 | Wetsch | |
| 2015/0291335 | A1 | 10/2015 | Wetsch | |
| 2015/0314940 | A1 | 11/2015 | Matta | |
| 2018/0148246 | A1 | 5/2018 | Fu et al. | |
| 2019/0031415 | A1 | 1/2019 | Kumar | |
| 2019/0062028 | A1 | 2/2019 | Getty et al. | |
| 2019/0225406 | A1 | 7/2019 | Kim | |
| 2019/0291907 | A1 | 9/2019 | Wetsch et al. | |
| 2020/0024049 | A1 | 1/2020 | Borrero et al. | |
| 2020/0115082 | A1 | 4/2020 | Hess et al. | |
| 2022/0032598 | A1 | 2/2022 | Wetsch | |

FOREIGN PATENT DOCUMENTS

| | | | |
|---|---|---|---|
| WO | 2014015060 | A2 | 1/2014 |
| WO | 2014175792 | A1 | 10/2014 |
| WO | 2019140065 | A1 | 7/2019 |

* cited by examiner

PACKAGING WITH SEALING MATERIALS HAVING DIFFERENT SEALING CONDITIONS

CROSS-REFERENCE TO RELATED APPLICATION

The present application claims priority to U.S. Provisional Patent Application No. 63/046,828, filed Jul. 1, 2020, entitled "EXPANDABLE WALL BAGS IN SERIES;" U.S. Provisional Patent No. 62/706,110, filed Jul. 31, 2020, entitled "EXPANDABLE WALL BAGS IN SERIES;" U.S. Provisional Patent Application No. 63/069,571, filed Aug. 24, 2020, entitled "EXPANDABLE WALL BAGS IN SERIES;" U.S. Provisional Patent Application No. 63/105,420, filed Oct. 26, 2020, entitled "POST-EXPANSION PACKAGING;" U.S. Provisional Patent Application No. 63/107,333, filed Oct. 29, 2020, entitled "POST-EXPANSION PACKAGING;" and U.S. Provisional Patent Application No. 63/107,312, filed Oct. 29, 2020, entitled "PACKAGING MATERIAL WEB WITH STRIP SEALS;" each of which is incorporated herein by reference in its entirety.

FIELD OF THE INVENTION

The present disclosure relates generally to packaging for shipping items. More specifically, the disclosure relates to generating packaging materials including a plurality of sealing materials having different sealing conditions.

BACKGROUND

Traditional low-density protective packaging is produced in standard bulky, low-density configurations. These bulky, low-density configurations may include, for example, preformed and inflated fluid chambers (e.g., bubble wrap), pre-expanded foam, the insertion of padding, etc. These bulky, low-density configurations provide packaging support during shipment. Before they can be used in packaging, however, they must be shipped to the packaging and shipment locations.

Since traditional protective packaging is produced already in bulky, low-density configurations, it must be transported as such. This increases the total volume of the packaging material even before it is used for packaging, thus increasing shipping costs of the packaging material to packaging and shipment locations and decreasing the amount of product that can be stored at these locations until use is needed.

For at least these reasons, systems and methods for producing packaging material in a low volume, high-density configuration which can then be expanded at a later time is needed.

SUMMARY

According to various embodiments of the present disclosure, packaging material is provided. The packaging material can include at least one web layer having a surface that includes first and second regions. When corresponding first regions are overlaid with each other and corresponding second regions are overlaid with each other, the overlaid first and second regions can cooperatively surround a cavity defined between the at least one web layer. The packaging material further can include a first sealing material disposed in the first region and configured to seal together the corresponding first regions of the at least one web layer upon application of first conditions to the first sealing material, and a second sealing material disposed in the second region and configured to seal together the corresponding second regions of the at least one web layer upon application of second conditions to the second sealing material. The second sealing material can be configured such that the first conditions applied to the second sealing material are insufficient to cause the second sealing material to seal.

According to various embodiments, the first and second sealing materials are different materials.

According to various embodiments, the at least one web layer forms a plurality of walls of a packaging unit configured to cushion an object to be shipped, and at least one of the walls includes padding configured to provide cushioning to the object. According to various embodiments, at least one of the walls includes a wall cavity positioned therebetween, and the padding is disposed in the wall cavity.

According to various embodiments, the padding is positioned along the at least one web layer in sections in order to facilitate folding of the at least one web layer between adjacent sections. According to various embodiments, the padding includes an expansion material.

According to various embodiments, the at least one web layer forms walls of a packaging container when the first regions are sealed to each other, which walls cooperatively bounding at least a portion of the cavity, the cavity being a packaging interior cavity that is configured to house an object to be shipped.

According to various embodiments, the corresponding first regions are sealed to each other by the first sealing material, and the second sealing material is in an unsealed condition, forming an opening to the interior cavity, the opening being configured to receive the object into the interior cavity. According to various embodiments, the second sealing material is configured to seal closed the opening. According to various embodiments, when the corresponding first regions are sealed to each other and the corresponding second regions abut each other. According to various embodiments, the at least one web layer includes a longer web layer and a shorter web layer, the second region of the longer web layer is positioned on the longer web layer in a direction facing the interior cavity, and the second region of the shorter web layer is positioned on the shorter web layer in a direction facing outwardly from the interior cavity.

According to various embodiments, the packaging material includes an assembled web that includes the at least one web layer, which at least one web layer includes a plurality of said walls defining a plurality of said interior cavities, such that the assembled we includes a series of the packaging containers. According to various embodiments, the packaging material further includes a region of weakness positioned between adjacent packaging containers in the series of packaging containers, wherein the region of weakness is configured to facilitate separation of the adjacent packaging containers. According to various embodiments, one of the walls is interrupted, forming the opening, the region of weakness is positioned along the other remaining wall, and the opening is overlaid over the region of weakness.

According to various embodiments, the at least one web layer is part of a single web that is folded over itself to provide the at least one web layer on each side of the fold. According to various embodiments, the at least one web layer includes a plurality of webs that are overlaid.

According to various embodiments, the at least one web layer includes first and second overlaid plies including a hinge area disposed for folding the overlaid plies over each other at a hinge line that extends through the hinge area to divide the overlaid plies into first and second wall portions on opposite sides of the hinge line, such that the wall portions are folded about the hinge line to a folded configuration, defining the cavity therebetween, the cavity being an interior cavity configured to receive and house an object, and an expandable material configured, when in an expanded configuration, to cushion the object, the expandable material being disposed between the first and second plies in a main padding area, wherein the hinge area between the plies has less of the expandable material than in the main padding area such that, in the folded configuration, the hinge area is thinner than the main padding area. The first sealing material is disposed to affix the wall portions in the folded configuration such that the first and second walls define a packaging unit.

According to various embodiments, the hinge area is substantially free of the expandable material, providing a gap between portions of the main padding area on the first and second wall portions.

According to various embodiments, the first and second overlaid plies include a third wall portion, and the hinge area includes a first hinge area disposed between the first and second wall portions, and a second hinge area disposed between the second and third wall portions, such that the first and third wall portions folded respectively about hinges in the first and second hinge areas each overlays the second wall portion, such that the second wall portion forms a first wall of a packaging container, and the first and third wall portions form a second wall of the packaging container overlaid on the first wall and defining the interior cavity between the walls. The first sealing material is disposed to seal the first wall to the third wall. According to various embodiments, first and third wall portions have longitudinal edges such that, in the folded configuration, the longitudinal edges are disposed above the second wall portion and are sealed together by the first sealing material.

According to various embodiments, the first conditions or the second conditions include a required temperature or pressure. According to various embodiments, the first conditions include a required first maximum temperature for the first sealing material, and the second conditions include a required second minimum temperature for the second sealing material. The second minimum temperature is higher than the first maximum temperature, and the second sealing material is configured to remain unsealed at the first maximum temperature.

According to various embodiments, the second sealing material is heat sealable, and application of the second conditions thereto forms a heat seal between the corresponding second regions.

According to various embodiments, the at least one web layer includes a substrate made of paper.

According to various embodiments, the first seal is disposed over a majority of a surface of the at least one web layer.

According to various embodiments of the present disclosure, a packaging material web is provided. The packaging material web can include first and second overlaid plies including a hinge area disposed for folding the overlaid plies over each other at a hinge line that extends through the hinge area to divide the overlaid plies into first and second wall portions on opposite sides of the hinge line, such that the wall portions are folded about the hinge line to a folded configuration, defining an interior cavity therebetween, the interior cavity being configured to receive and house an object. The packaging material further can include an expandable material configured, when in an expanded configuration, to cushion the object, the expandable material being disposed between the first and second plies in a main padding area. The hinge area between the plies can have less of the expandable material than in the main padding area such that, in the folded configuration, the hinge area is thinner than the main padding area, and a sealing material disposed to affix the wall portions in the folded configuration such that the first and second walls define a packaging unit.

According to various embodiments, the hinge area is substantially free of the expandable material, providing a gap between portions of the main padding area on the first and second wall portions.

According to various embodiments, the first and second overlaid plies include a third wall portion, and the hinge area includes a first hinge area disposed between the first and second wall portions, and a second hinge area is disposed between the second and third wall portions, such that the first and third wall portions folded respectively about hinges in the first and second hinge areas each overlays the second wall portion, such that the second wall portion forms a first wall of a packaging container, and the first and third wall portions form a second wall of the packaging container overlaid on the first wall and defining the interior cavity between the walls. According to various embodiments, the sealing material is disposed to seal the first wall to the third wall.

According to various embodiments, first and third wall portions have longitudinal edges such that, in the folded configuration, the longitudinal edges are disposed above the second wall portion and are sealed together by the sealing material.

According to various embodiments, the second wall portion has a transverse width, and the first and third wall portions cumulatively have a cumulative transverse width that is at least as wide as the transverse width of the second wall portion.

According to various embodiments, the hinge areas extend longitudinally, the overlaid plies include edges extending longitudinally, and the sealing material is disposed to seal the edges together in the folded position.

According to various embodiments, the first and second wall portions each form one wall. According to various embodiments, the first and second wall portions each include a longitudinal edge, and the sealing material is disposed to affix the wall portions along the longitudinal edges of the first and second wall portions.

According to various embodiments, the web includes an assembled web that includes the first and second plies forming a plurality of said wall portions defining a plurality of said interior cavities, such that the assembled we includes a series of the packaging containers.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
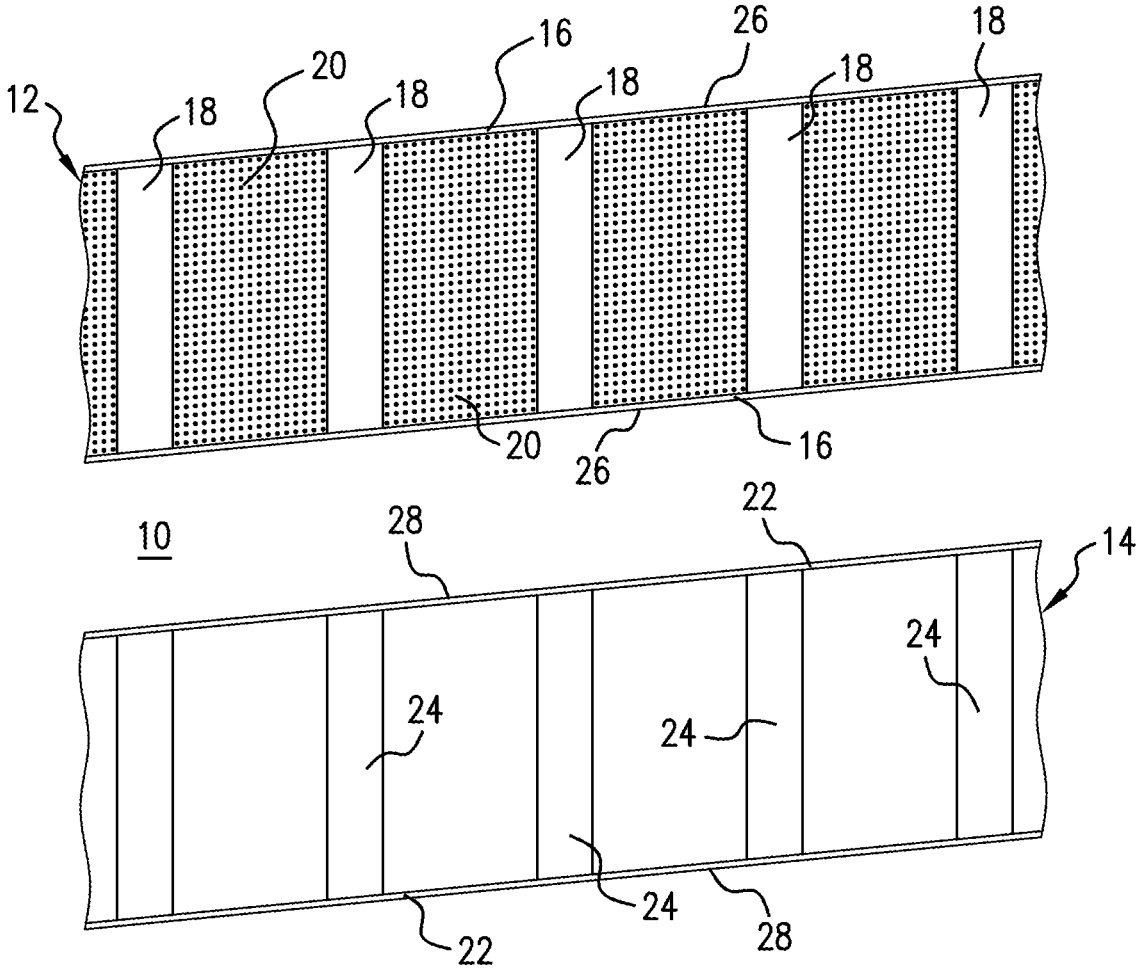
FIG. 1 is a top perspective view of an embodiment of plies used to form a wall.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples can be utilized and other changes can be made without departing from the spirit or scope of the subject matter presented herein. It will be readily understood that the aspects of the present disclosure, as generally described herein and illustrated in the figures, can be arranged, substituted, combined, separated, and designed in a wide variety of different configurations, all of which are implicitly contemplated herein.

Some aspects of the present disclosure are directed to packaging elements formed from packaging material. Some packaging elements formed from the packaging material include pads and sheets, which include a single wall. Some packaging elements formed from the packaging material include packaging units configured to cushion one or more objects during shipping. Packaging units can include, for example, pads and packaging containers. Packaging containers include a plurality of walls enclosing an interior cavity for storing one or more products. Some packaging containers include bags and envelopes, such as mailers, which may be fabricated and then filled with an item to be shipped at a later point in time.

Some embodiments of the present disclosure include expansion walls. Some expansion walls include expandable walls, which are in an unexpanded configuration and can be expanded at a later time. Some expansion walls include expanded walls, which are already in an expanded configuration. Expansion walls can include an expansion member. Expansion members may include one or more inflation chambers. Some inflation chambers include inflatable chambers configured to receive a fluid such as, for example, air or other suitable gaseous or non-gaseous fluids. Some inflation chambers include inflated fluid-chambers. Inflated fluid-chambers may include, for example, preformed chambers (e.g., vacuformed bubbles). Expansion members may include one or more expansion materials. Some expansion materials include expandable material configured to expand with the application of heat or chemical reaction, or other suitable means. Some expansion materials include expanded materials having expanded from applied dimensions.

The various seals described herein include at least one sealing material. In a preferred embodiment, a web of packaging material includes a plurality of sealing materials. The sealing material includes a sticking element. The sticking element includes an adhesive or cohesive material to provide an adhesive or cohesive surface, respectively. A combination of adhesive and cohesive surfaces can be used. The sticking element can be applied directly to the exposed surface of the material by suitable known methods, or it can be applied on a tape, such as a double-sided tape, or other suitable methods. In some embodiments, the sealing material includes polyethylene. In some embodiments, the sealing material includes a material which can be heat sealed. In some embodiments, the sealing material includes a material which acts as a cold glue. It is noted that other suitable sealing materials can be used in conjunction with, or alternatively to, the example sealing materials described herein.

As used herein, an adhesive sticking element is made of a material that adheres to other types of surfaces, preferably such as ones that would be typically be found in the vicinity of protective packaging, such as to plastic, paper, or metals. The adhesive can stick to an opposing surface without relying on the opposing surface having the same or a complimentary material for the stickage to take place to form a connection between the two surfaces. Examples of suitable adhesives include liquid adhesives and pressure sensitive adhesives. Pressure sensitive adhesives can be selected that stich after applying a slight, initial, external pressure to create the bond. Examples of these include water-based, acrylic, pressure sensitive adhesives, similar to what is applied to packaging tape, which material holds two surfaces together solely by surface contact, often upon a slight initial external pressure. Examples may include dry adhesives, which typically require no activation with water, solvent or heat, and firmly adhere to many dissimilar surfaces. Pressure sensitive adhesives can be selected that are aggressive and/or permanently tacky at room temperature. Pressure sensitive adhesive application and use can be automated. When used in assembly, pressure sensitive adhesives that do not require setup or long curing times can be used to save time compared to using typical liquid adhesives. Adhesion is preferably immediate with pressure sensitive adhesives, allowing manufacturing procedures to continue uninterrupted, which can result in significant time and labor savings. Examples of water based, acrylic, pressure sensitive adhesives include those known as RHOPLEX N-1031 Emulsion, RHOPLEX N-580 Emulsion, and RHOPLEX N-619 Emulsion. Other emulsion polymers or acrylic polymer blend adhesives are also known, and other suitable types of adhesives and/or contact adhesives can be used.

A cohesive material of a sticking element causes one surface to stick to an opposing surface by coming into contact with the same or a complimentary cohesive substance to form the bond between the two surfaces. Cohesives, in which opposing cohesives stick to one another, do not stick to other substances sufficiently to adhere to those other substances (e.g., other surfaces of the protective packaging material that do not have a cohesive element, surfaces of the container, surfaces of the product to be shipped), or in some cases would stick very weakly compared to the bond they form from sticking to each other. A cohesive can be a pressure sensitive cohesive, in which pressure is required to activate the bond. Examples of a suitable cohesive material from which the cohesive sticking elements can be made include natural and synthetic latex-based cohesives. The cohesive material in some embodiments is applied as a liquid to the appropriate portion of the protective packaging material, and in others is applied in other known forms. Some types of cohesives, such as ones made with latex, is mixed with water without additional adhesives to bond to the respective, non-cohesive, portion of the protective packaging material, and upon drying remains stuck to the exposed surface of the protective packaging material to which is has been applied. In some embodiments, the cohesive material can be mixed with an adhesive, often applied as a liquid, onto the protective packaging material. The adhesive can be selected so that after applying the cohesive and adhesive mixture onto the protective packaging material (e.g., onto a film ply), the adhesive evaporates, leaving the cohesive bonded to the non-cohesive protective packaging material (e.g., onto a film or paper ply). One method of liquid application is spraying, although brushing or other suitable methods can be used. Also, other suitable methods of applying the cohesive to the non-cohesive material surface can alternatively be used.

Referring to FIG. 1, a supply web 10 of packaging material is shown in a low-volume, high-density configuration. The web 10 material includes one or more plies or layers of a polymer, a cellulose-based (e.g., paper), or other suitable material. In FIG. 1, the web 10 forms an expansion wall and includes a plurality of plies 12, 14. A wall is provided as a multi-ply structure. In alternative embodiments, one or more walls are multi-ply and/or single ply structures.

The web 10 includes a first ply 12 and a second ply 14. The first ply 12 includes one or more seals 16, 18 formed or applied thereon, which may include a sealing material. The one or more seals 16, 18 include one or more longitudinal seals 16 adhered along one or more longitudinal edges 26 of the first ply 12. The one or more seals 16, 18 may additionally or alternatively include one or more transverse seals 18. The one or more transverse seals 18 extend to one or more of the longitudinal edges 26 of the first ply 12. In other embodiments, the transverse seals 18 extend across a portion of the first ply 12.

The plies 12, 14 can include paper (e.g., cardboard, kraft paper, fiberboard, pulp-based paper, recycled paper, newsprint, and coated paper such as paper coated with wax, plastic, water-resistant materials, and/or stain-resistant materials), plastic, cellulose, foil, poly or synthetic material, biodegradable materials, and/or other suitable materials of suitable thicknesses, weight, and dimensions. The plies 12, 14 can include recyclable material (e.g., recyclable paper). The plies 12, 14 can include one or more substrates. In some embodiments, the one or more substrates include a paper substrate. The paper substrate can include a material layer applied thereon. The material layer can include one or more of a waterproof layer, an airtight layer, an adhesive layer, a cohesive layer, a heat sealable layer, other suitable material layers, and/or a combination thereof.

The web 10 includes an expandable element. The expandable element includes an expansion material 20. The expansion material 20 can be positioned between the first ply 12 and the second ply 14. The expansion material 20 is applied to one of the plies 12, 14. The expansion material 20 is applied to the first ply 12. In other embodiments, the expansion material 20 is applied to the second ply 14 and/or both the first ply 12 and the second ply 14. The expansion material 20 is applied in regular shapes (for example, circles, ovals, squares, rectangles, triangles, etc.) or in irregular shapes. The expansion material can be applied to the web as a continuous layer or in a pattern. The pattern can be configured such that, when the plies are pressed together, the expansion material spreads out, forming a continuous layer. In some embodiments, the web 10 includes one or more vents or venting openings configured to enable gas (e.g., water vapor) produced by the application or expansion of the expansion material 20.

An expansion device can be provided that causes the expansion material to expand. The expansion device is activated by an expansion initiator. In some embodiments, the expansion material includes a plurality of materials, separated by a barrier, that, when mixed or in contact with each other, causes the expansion material to expand into an expanded configuration. In some embodiments, the expansion material includes a matrix which can be expanded by an expansion device. Prior to expansion of the expansion material, when the expansion material is still in an expandable condition (i.e., when the expansion material is an expandable material), the matrix can be fluid, such as a gel or liquid. This allows ready application onto the plie(s). In other embodiments, the expandable material is provided as a solid, and/or may go through a gel or fluid phase. The expansion initiator can be thermal and/or mechanical and/or chemical and/or can include other suitable initiating properties for activating the expansion device. For example, the expansion initiator can be one or more of heat, pressure, a chemical reaction and/or other suitable expansion initiators. The expansion device can include reactive components, chemical catalysts, blowing agents, heating agents (which can apply heat to the expansion material and/or cause the expansion material to increase in temperature) and/or other suitable expansion devices. In some embodiments, the expansion device is maintained separate from the matrix by a barrier, and for this purpose can be maintained within another structure such as, for example, microsphere shells. The expansion material 20, once expanded, provides a cushion configured to provide protection to one or more items/products/etc. positioned against the first ply 12 or the second ply 14.

In some embodiments, the matrix can include one or more polymers including emulsion-based polymers. The one or more polymers can include one or more of vinyl acetate ethylene, polyvinyl acetate, polyvinyl alcohol, polyvinyl acetate copolymers, polyvinyl alcohol copolymers, dextrin stabilized polyvinyl acetate, vinyl acetate copolymers, ethylene copolymers, vinylacrylic, styrene acrylic, acrylic, styrene butyl rubber, polyurethane, polyolefins, biodegradable materials (e.g., cellulose and starch), and/or other suitable expansion materials.

In some embodiments, the matrix can include a polyolefin based adhesive or a polyolefin dispersion. The polyolefin dispersion can include polyethylene and/or polypropylene, thermoplastic polymers, polymeric stabilizing agents including at least one polar polymer, water, and/or other suitable polyolefin dispersions. A suitable polyolefin dispersion can include, for example HYPOD™, from Dow Chemical, or other suitable polyolefin dispersions.

In some embodiments, the matrix is a water-based adhesive. The water-based adhesive may include a water-based polymer.

In some embodiments, the matrix is based on starch in its natural or synthetic forms. In some embodiments, the starch is in the form of a ground up micro-starch powder. The diameter of the ground up starch particles is between about 12 microns to about 20 microns. In some embodiments, the starch-based matrix comprises one or more of water or other solvent, a surfactant, polar bonding agent, or other fillers. In some embodiments, for example, the matrix comprises up to 50% water. In some embodiments, the matrix comprises 30-40% starch for example.

Some embodiments include a barrier that separates the expansion device from the matrix. A type of suitable barrier is a microsphere shell that contains a blowing agent, chemical catalyst, or chemical reactive component as the expansion device. Other types of barriers can alternatively be used.

In some embodiments, the expansion device comprises a plurality of microspheres that are expandable and/or rupturable, for example upon the application of sufficient heat. The microspheres can include an outer shell and an inner core. Suitable outer shells can include, for example, one or more of a thermoplastic polymer such as polyacrylonitrile or PVC, as well as glass, rubber, starch, cellulose, ceramic, or other suitable material. In some embodiments, the plurality of heat-expandable microspheres include a solid, liquid or gas core made from one or more of a hydrocarbon, water, or other suitable chemical that can be activated to expand or rupture the microsphere shell. In some embodiments, the microspheres can include biodegradable materials such as, for example, cellulose.

The device, such as the microspheres, can be mixed with the matrix prior to application on the web, or provided on the matrix after the matrix has been applied to the web, by mixing or forcing the microspheres into the matrix after application to the web, for example when the plies are pressed together.

In some embodiments, the microspheres have an expansion temperature (Texp), at which the microspheres begin to expand, and a maximum temperature (Tmax), whereby, if the microspheres are heated above Tmax, they will rupture. The Texp of the microspheres is not particularly limited, but is generally between about 60° C. and up to about 250° C. The Tmax of the microspheres is generally between about 80° C. and up to about 300° C. In some embodiments, the Tmax is higher than 300° C. The microspheres are selected based on their maximum expansion temperature, depending on whether the microspheres are required to rupture or not. The Tmax is dependent on several properties, including the physical properties of the microspheres, the physical properties of the matrix, as well as the physical properties of the plies on which the matrix and microspheres are deposited. The heat can be generated via suitable means such as, for example, radiofrequency radiation or other suitable means. In some embodiments, the radiofrequency radiation is applied to the expansion material 20 at frequencies of approximately 10-45 MHz or as appropriate for the microsphere composition and the material of the matrix. In other embodiments, other frequencies may be used. The heating parameters selected are dependent upon the expansion material or materials 20 used. Suitable microspheres are known in the art.

In some embodiments, the expansion device includes a blowing agent such as a gas or a mixture of gases. Examples of suitable gases include air, carbon dioxide, nitrogen, argon, helium, methane, ethane, propane, isobutane, n-butane, neopentane, and the like. In some embodiments, the gas or mixture of gases are added to the expansion material by mechanical means. Examples of mechanical means include whisking or frothing the expansion material to beat the air or other gases into the expansion material and increase its volume. In other embodiments, the gas or mixture of gases can also be encapsulated in microspheres. When the microspheres are activated, they expand and may rupture. The expansion of the microspheres causes expansion of the expansion material. The rupture of the microspheres releases their contents, resulting in foaming and expansion of the expansion material. In some embodiments, the web 10 includes one or more vents or venting openings configured to enable gas (e.g., water vapor) produced by the application or expansion of the expansion material 20.

In some embodiments, the expansion device includes one or more reactive components which cause chemical reactions to expand the matrix. Chemical reactions can include the mixing of two reactive components, that react to generate a foam. In some embodiments a catalyst is used to increase the rate of the chemical reaction. In some embodiments, the two reactive components are separated by a barrier prior to mixing and expansion. The barrier separating the reactive components can be the shell of a microsphere, wherein the core of the microspheres comprises one or more reactive components, and rupturing of the microsphere releases its contents into one or more other reactive components, causing a foam generating reaction. Other barriers may also be used such as walls, capsules, or other barrier forming containers. Examples of reactive components that cause expansion include mixing a liquid form of isocyanate with a multi-component liquid blend called polyurethane resin. When combined, these components release carbon dioxide and water vapor to generate a polyurethane foam. Other reactive components can be used that form a foam upon mixing.

In some embodiments, when the expansion material 20 is expanded solidifies, although other in embodiments, the expansion material 20 forms a gel or has another physical phase depending on the construction of the article. The expanded expansion material 20 is configured to form a region of protective padding and/or insulation. The method of solidification of the expansion material is selected based on its physical properties, and may be achieved by such methods as thermosetting, drying (such as air drying), curing, or by other suitable processes, such as know methods to transition a material from fluid to solid. For example, a thermoset plastic may be irreversibly solidified by curing, whereas solidification of a thermoplastic can be reversible.

In some embodiments the expansion material 20 is applied in a pattern. The pattern, distribution, and/or concentration of the expansion material 20 are selected to attain desired padding and/or insulative characteristics. In this embodiment, the expansion material 20 is applied in a pattern of dots. The dots can be dots, squares, circles, large and/or small shapes or polygons. Other suitable patterns can alternatively be employed, such as, for example, lines, arcs, circles, ellipses, squares, rectangles, polygons, or a combination thereof. The expansion material 20 is applied over a part of a surface of one or more of the plies 12, 14 of the web 10. Alternatively, the expansion material 20 can be applied over all of the surface of one or more of the plies 12, 14. In this embodiment, the expansion material is applied in a relatively uniform thickness. Other thicknesses, such as variable thicknesses can alternatively be employed. In some embodiments, lines of the web 10 can be left free of expansion material 20 to form natural hinge lines or regions that are more easily bent than other regions in which the expansion material 20 is expanded. In some embodiments, pressure is applied to the expansion material 20 during or subsequent to expansion, forming hinge lines or regions that are more easily bent than other regions.

The second ply 14 includes one or more seals 22, 24 including a sealing material. The one or more seals 22, 24 may be configured to compliment the seals 16, 18 of the first ply 12, and include one or more longitudinal seals 22 adhered along one or more longitudinal edges 28 of the second ply 14. The one or more seals 22, 24 of the second ply 14 include one or more transverse seals 24. The one or more transverse seals 24 extend to one or more of the longitudinal edges 28 of the second ply 14. In other embodiments, the one or more transverse seals 24 extend across a portion of the second ply 14.

According to some embodiments, the web 10 includes, in addition to or alternatively to expansion material 20, one or more inflatable chambers, such as those illustratively depicted in FIGS. 15A-16D.

Figure 2:
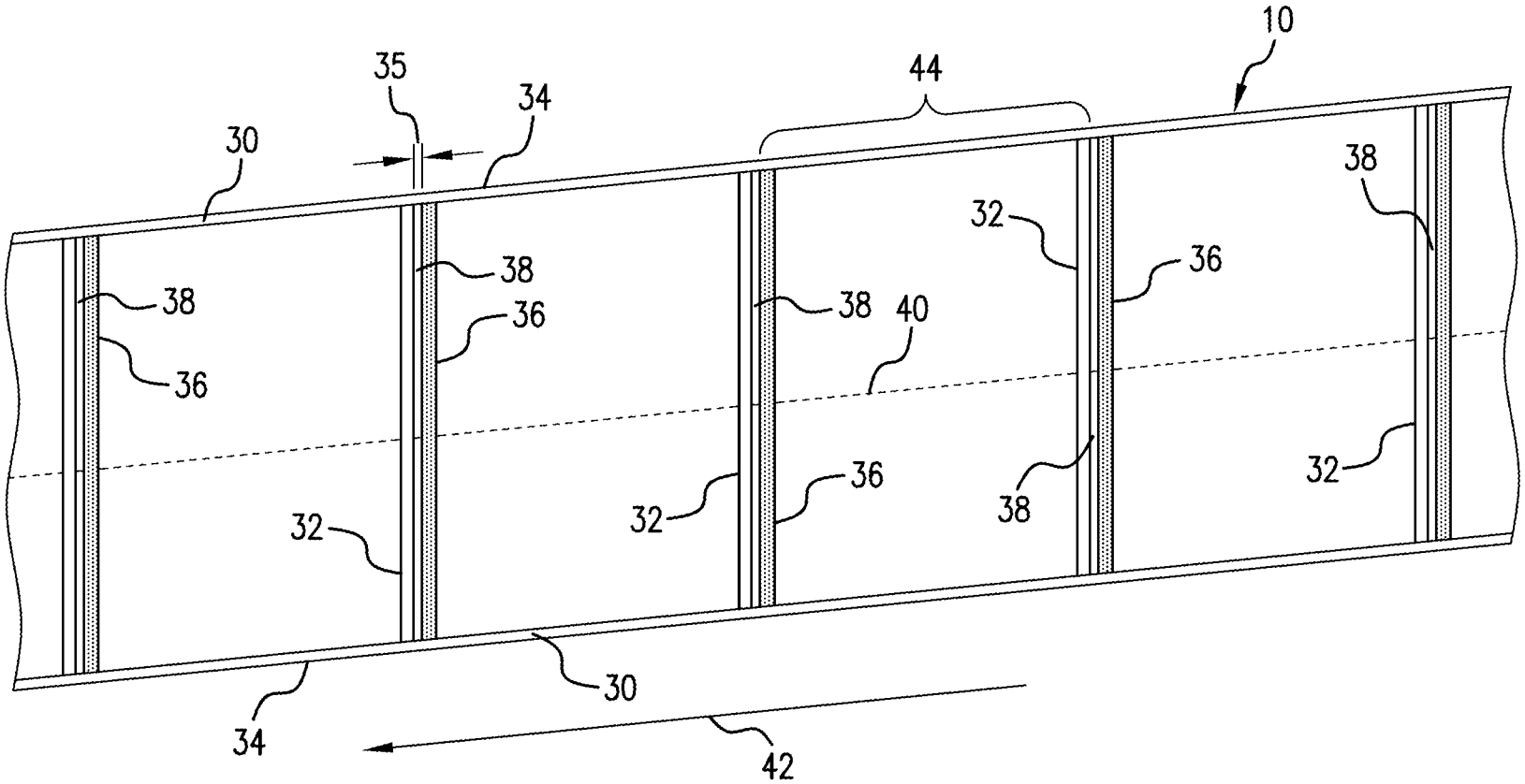
FIG. 2 is a top view of a web of the wall formed, for example with the plies of FIG. 1.

The first ply 12 is joined to the second ply 14. After the first ply 12 and the second ply 14 are joined, one or more exterior sealing materials are applied to the exterior of the web 10, forming one or more exterior seals 30, 32, 36 (as shown in FIG. 2). One or more longitudinal seals 30 are applied to the outer longitudinal edges 34 of the web 10, and one or more transverse seals 32 are applied between the one or more longitudinal seals 30. The web 10 is then fed, in direction 42, through a folding apparatus which folds the web 10. In this embodiment, the web 10 is folded along a folding edge 40. In other embodiments, the web alternatively has a plurality of folding edges 40.

The web 10 may include one or more exterior longitudinal seals 30 and one or more transverse seals 32, 36. Transverse seals 32 form the bottom seal of one or more packaging containers 44. In this embodiment, transverse seals 36 are configured to seal closed an opening in the packaging container 44 subsequent to a product being inserted into an interior cavity of the packaging container 44. According to this embodiment, transverse seals 32, 36 are of differing seal types. In this embodiment, one or more of transverse seals 32, 36 are of a different seal type as the one or more longitudinal seals 30. In other embodiments, one or more of transverse seals 32, 36 are alternatively of a similar seal type as the one or more longitudinal seals 30. According to some embodiments, The one or more longitudinal seals 30 can, in some embodiments, form a seal at a temperature different from a temperature required to form a seal using the one or more transverse seals 32, 36. This enables seals that are activated at one temperature to be activated at a time different from an activation time of one or more seals that are activated at other temperatures. In some embodiments, each of seals 30, 32, and 36 can be heat-activated seals.

The web 10 may include one or more web layers having a surface that includes first and second regions, wherein, when corresponding first regions (corresponding, e.g., in FIG. 2, to the regions upon which seals 30, 32 are positioned) are overlaid with each other and corresponding second regions (corresponding, e.g., in FIG. 2, to the regions upon which seals 36 are positioned), are overlaid with each other, the overlaid first and second regions cooperatively surrounding a cavity defined between the at least one web layer. The web 10 may include a first sealing material disposed in the first region and configured to seal together the corresponding first regions of the at least one web layer upon application of first conditions to the first sealing material. The web 10 may include a second sealing material disposed in the second region and configured to seal together the corresponding second regions of the at least one web layer upon application of second conditions to the second sealing material. The second sealing material is configured such that the first conditions applied to the second sealing material are insufficient to cause the second sealing material to seal. In some embodiments, the first and second sealing materials are different materials. The corresponding first regions are sealed to each other by the first sealing material, and the second sealing material is in an unsealed condition, forming an opening to the interior cavity 46, the opening being configured to receive the object into the interior cavity. In some embodiments, the second sealing material is configured to seal closed the opening. In some embodiments, the corresponding first regions are sealed to each other and the corresponding second regions abut each other. In some embodiments, the at least one web layer includes a longer web layer and a shorter web layer, the second region of the longer web layer is positioned on the longer web layer in a direction facing the interior cavity, and the second region of the shorter web layer is positioned on the shorter web layer in a direction facing outwardly from the interior cavity.

In some embodiments, the one or more longitudinal seals 30 and the one or more transverse seals 32, 36 include sealing material configured to establish a seal without the application of heat. For example, the one or more longitudinal seals 30 and the one or more transverse seals 32, 36 include a pressure-activated adhesive, a cold glue (e.g., a collagen-based glue, a Polyvinyl Acetate-based glue, or other suitable glues), and/or other suitable sealing materials. This prevents the expansion material 20 from activating and expanding while activating either the one or more longitudinal seals 30 and/or the one or more transverse seals 32, 36.

In this embodiment, the one or more transverse seals 32, 36 are provided at longitudinally spaced apart locations of the web 10 and extend substantially fully transversely across the web 10 between the longitudinal edges 34 of the web 10. In other embodiments, one or more of the transverse seals 32, 36 alternatively extend over a portion of the transverse length of the web 10. Transverse seals 32, 36 are separated by a gap 38 separated by distance 35. According to some embodiments, the gap 38 is configured to act as a vent in order to vent one or more gasses produced via the expansion process of the expandable element.

Figure 3:
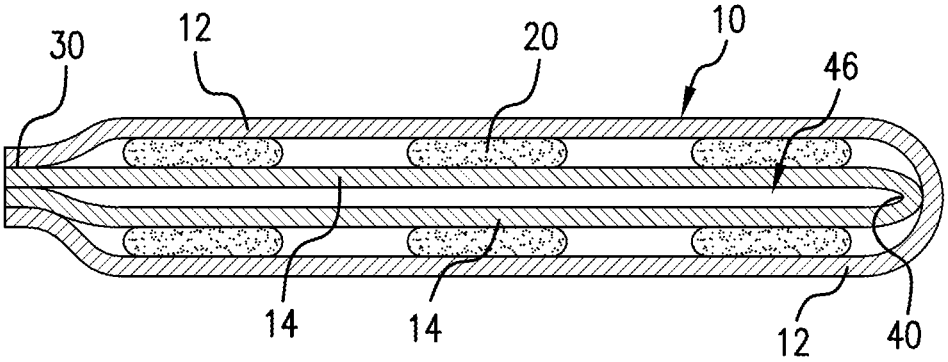
FIG. 3 is a cross-sectional longitudinal view of a web, for example the web of FIG. 2, folded over and bonded to form a web of connected packaging containers according to an embodiment.

As shown in FIG. 3, a cross section of a folded web 10 is illustratively depicted, in accordance with various embodiments of the present disclosure. The web 10 is folded over, at folding edge 40, forming a bag formation having an interior cavity 46. One side of the folded web 10 is folded over, while the other is sealed via a longitudinal seal 30, forming a seam. The longitudinal seals 30 includes heat activated seals (e.g., heat activated adhesive or other suitable heat-activated seals), one or more strip-seals, one or more pressure activated-seal such as, for example, pressure-activated adhesive or other suitable types of pressure-activated seals, or other suitable types of seal. The sealing material may be applied to a perimeter. In some embodiments, the sealing material has an approximately uniform width. In some embodiments, the sealing material is applied with varying widths. The web 10 can have one folding edge 40 or, alternatively, a plurality of folding edges 40.

Figure 4:
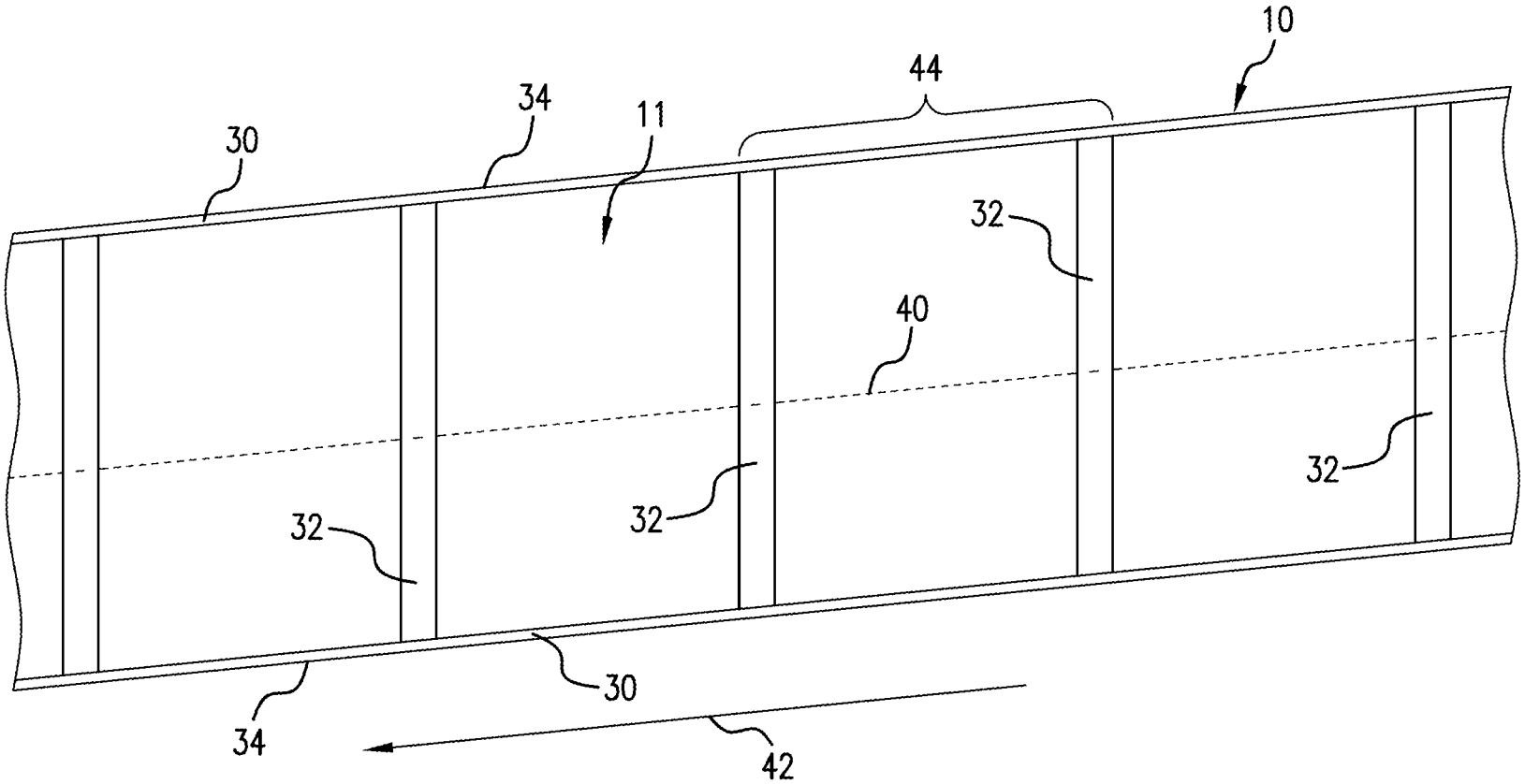
FIG. 4 is a top view of a single ply web.

As shown in FIG. 4, in some embodiments, the web 10 is a single-ply 11 structure. One or more exterior sealing materials are applied to the exterior of the web 10, forming one or more exterior seals 30, 32. One or more longitudinal seals 30 are applied to the outer longitudinal edges 34 of the web 10, and one or more transverse seals 32 are applied between the one or more longitudinal seals 30. The web 10 is then fed, in direction 42, through a folding apparatus which folds the web 10. In this embodiment, the web 10 is folded along a folding edge 40. In other embodiments, the web alternatively has a plurality of folding edges 40. The singly-ply 11 includes a suitable ply material such as, for example, plies 12, 14 of FIGS. 1-3.

Figure 5:
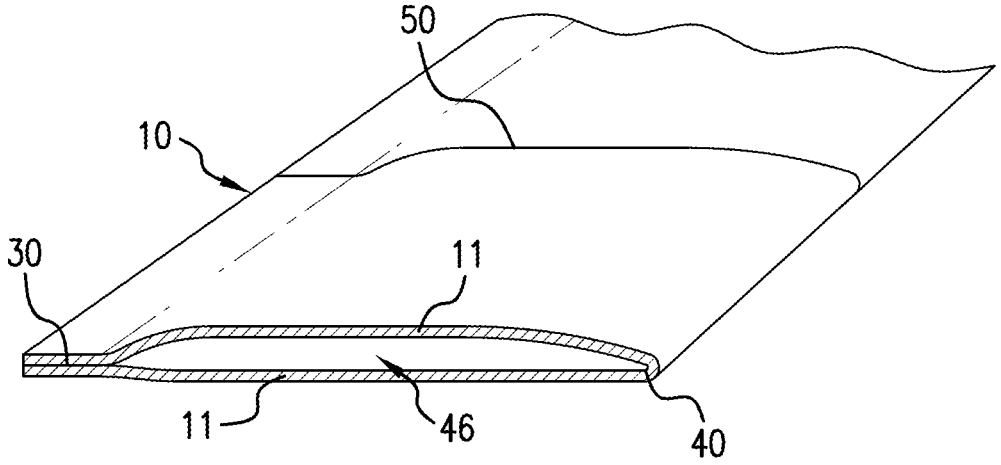
FIG. 5 is a cross-sectional perspective view of a web, for example the web of FIG. 4, folded over and bonded to form a web of connected packaging containers according to an embodiment.

As shown in FIG. 5, a cross section of a folded web 10 is illustratively depicted, in accordance with various embodiments of the present disclosure. The web 10 is folded over, at folding edge 40, forming a bag formation having an interior cavity 46. One side of the folded web 10 is folded over, while the other is sealed via a longitudinal seal 30, forming a seam. The longitudinal seals 30 includes heat activated seals (e.g., heat activated adhesive or other suitable heat-activated seals), one or more strip-seals, one or more pressure activated-seals such as, for example, pressure-activated adhesive or other suitable types of pressure-activated seals, or other suitable types of seal. The sealing material may be applied to a perimeter. In some embodiments, the sealing material has an approximately uniform width. In some embodiments, the sealing material is applied with varying widths. The web 10 can have one folding edge 40 or, alternatively, a plurality of folding edges 40.

One or more exterior sealing materials are applied to the exterior of the web 10, forming one or more exterior seals 30, 32 (as shown in FIGS. 2 and 4). One or more longitudinal seals 30 are applied to the outer longitudinal edges 34 of the web 10, and one or more transverse seals 32 are applied between the one or more longitudinal seals 30. In some embodiments, the web 10 is fed, in direction 42, through a folding apparatus which folds the web 10. The web 10 is folded along a folding edge 40. In other embodiments, the web alternatively has a plurality of folding edges 40.

The web 10 can include one or more exterior longitudinal seals 30 and one or more exterior transverse seals 32. The transverse seals 32 form the bottom seal of one or more packaging containers 44. In some embodiments, exterior longitudinal seals 30 and exterior transverse seals 32 are heat seals. In some embodiments, transverse seals 32 are of a different seal type as the one or more longitudinal seals 30. In other embodiments, one or more of transverse seals 32 are of a similar seal type as the one or more longitudinal seals 30.

In some embodiments, the one or more longitudinal seals 30 and/or the one or more transverse seals 32 include sealing material configured to establish a seal without the application of heat. For example, the one or more longitudinal seals 30 and the one or more transverse seals 32 can include a pressure-activated adhesive, a cold glue (e.g., a collagen-based glue, a Polyvinyl Acetate-based glue, or other suitable glues), and/or other suitable sealing materials.

Figure 6A:
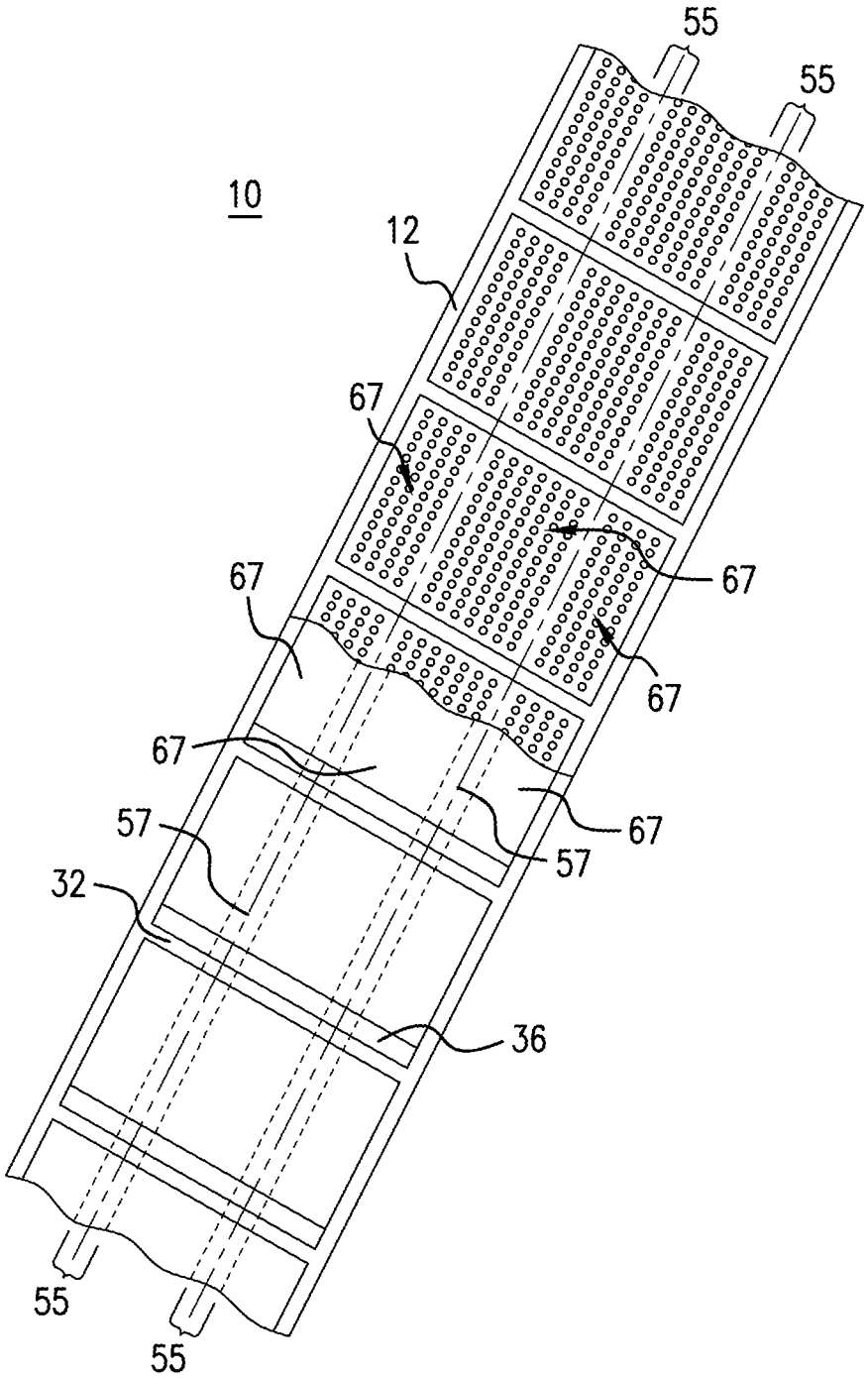
FIG. 6A is a top cutaway-view of another embodiments of a web.
Figure 6B:
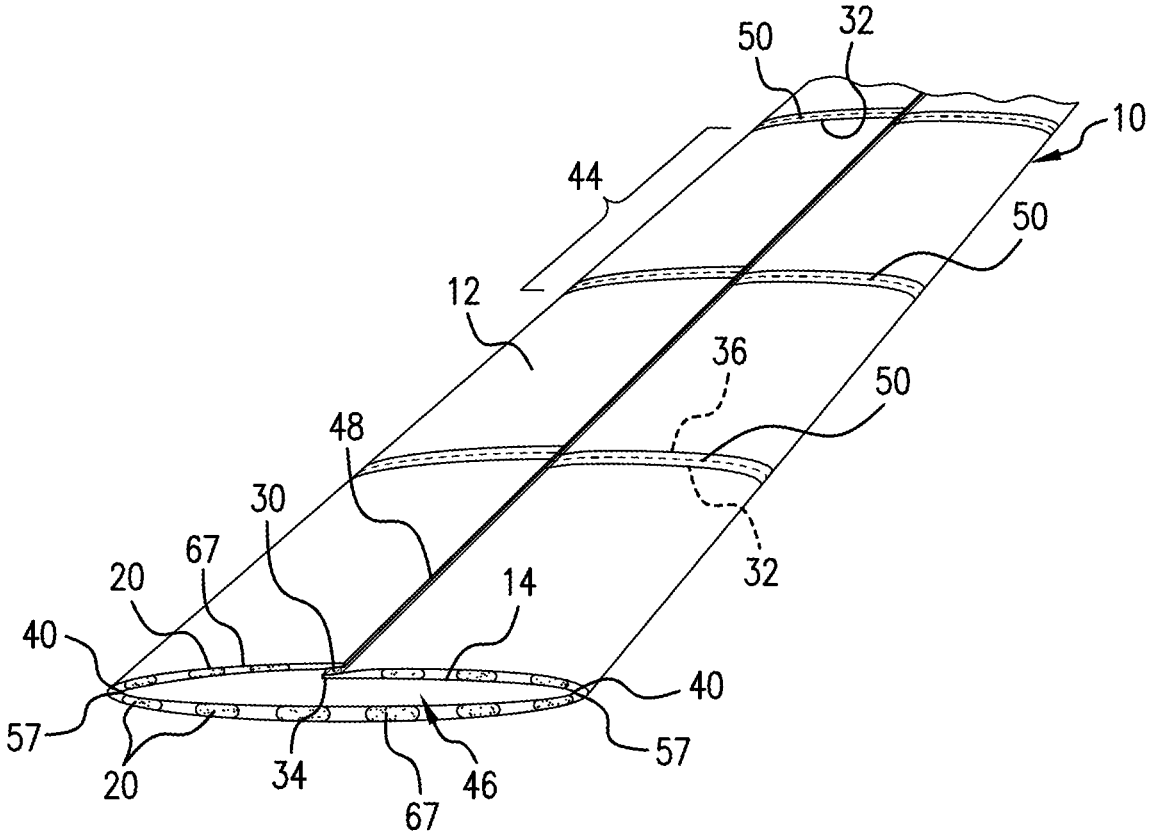
FIG. 6B is a bottom perspective view of a web of FIG. 6A, folded over and bonded to form a web of connected packaging containers.
Figure 6C:
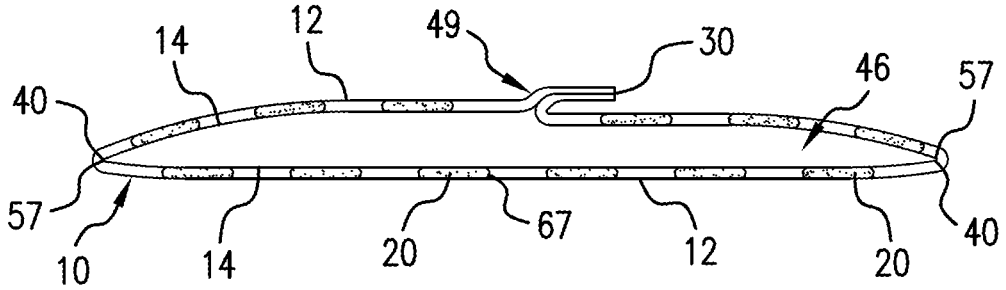
FIG. 6C is a cross-sectional longitudinal view of the web of FIG. 6B.

Once folded and flattened, the longitudinal seals 30 are aligned. In some embodiments, the seals 30 are aligned at a longitudinal edge 34 of the web 10, as shown in FIGS. 3 and 5. In other embodiments, the seals 30 are aligned at a position between a plurality of folding edges 40, forming a seam 48 at unfolded web longitudinal edge 34, as shown in FIGS. 6A-6C. The web 10 includes one or more regions of weakness 50 that extend transversely (e.g., generally perpendicularly) to the longitudinal edges 34. Seam 48 includes a longitudinal edge 34 overlapping another longitudinal edge 34, wherein sealing material is applied to an upper region of one longitudinal edge and/or a lower region of the other longitudinal edge, enabling the seal 48 to be formed. In some embodiments, seal 48 can be a fin seal 49 (e.g., as shown in FIG. 6C) or other suitable seal configuration.

In this embodiment, the one or more transverse seals 32 are provided at longitudinally spaced apart locations of the web 10 and extend substantially fully transversely across the web 10 between the longitudinal edges 34 of the web 10. In other embodiments, one or more of the transverse seals 32 extend over a portion of the transverse length of the web 10.

As shown in FIG. 6A-6C, the packaging material web includes first and second overlaid plies 12, 14 including a hinge area 55 disposed for folding the overlaid plies over each other at a hinge line 57 that extends through the hinge area 55 to divide the overlaid plies into first 61 and second 63 wall portions on opposite sides of the hinge line, such that the wall portions are folded about the hinge line 57 to a folded configuration, defining an interior cavity 46 therebetween, the interior cavity being configured to receive and house an object. In some embodiments, the packaging material web includes an expandable material configured, when in an expanded configuration, to cushion the object. The expandable material is disposed between the first and second plies in a main padding area 67, wherein the hinge area between the plies has less of the expandable material than in the main padding area 67 such that, in the folded configuration, the hinge area is thinner than the main padding area. The web further includes a sealing material disposed to affix the wall portions in the folded configuration such that the first and second walls define a packaging unit. In some embodiments, the web further includes a longitudinal seal material. In some embodiments, one or both of the longitudinal edges are sealed.

In some embodiments, the hinge area 55 is substantially free of the expandable material, providing a gap 59 between portions of the main padding area 67 on the first and second wall portions 61, 63. In some embodiments, the hinge area 55 includes less than 30% the amount of expandable material as the main padding area 67. In some embodiments, the hinge area 55 includes less than 25% the amount of expandable material as the main padding area 67. In some embodiments, the hinge area 55 includes less than 10% the amount of expandable material as the main padding area 67. In some embodiments, the hinge area 55 has no expansion material. In some embodiments, the hinge area 55 is a longitudinal strip having a width. However, the hinge area 55 may have one or more other suitable shapes.

In some embodiments, the first and second overlaid plies include a third wall portion 65, and the hinge area includes a first hinge area disposed between the first and second wall portions, and a second hinge area disposed between the second and third wall portions, such that the first and third wall portions folded respectively about hinges in the first and second hinge areas each overlays the second wall portion, such that the second wall portion forms a first wall of a packaging container, and the first and third wall portions form a second wall of the packaging container overlaid on the first wall and defining the interior cavity between the walls. The sealing material is disposed to seal the first wall to the third wall. In some embodiments, the first and third wall portions have longitudinal edges such that, in the folded configuration, the longitudinal edges are disposed above the second wall portion and are sealed together by the sealing material. In some embodiments, the second wall portion has a transverse width between the hinge lines, and the first and third wall portions cumulatively have a cumulative transverse width that is at least as wide as the transverse width of the second wall portion.

As shown in FIGS. 6A-6C, in some embodiments, the hinge areas extend longitudinally, the overlaid plies include edges extend longitudinally, and the sealing material is disposed to seal the edges together in the folded position.

In some embodiments, the first and second wall portions each form one wall. In some embodiments, the first and second wall portions each include a longitudinal edge, and the sealing material is disposed to affix the wall portions along the longitudinal edges of the first and second wall portions.

Figure 7:
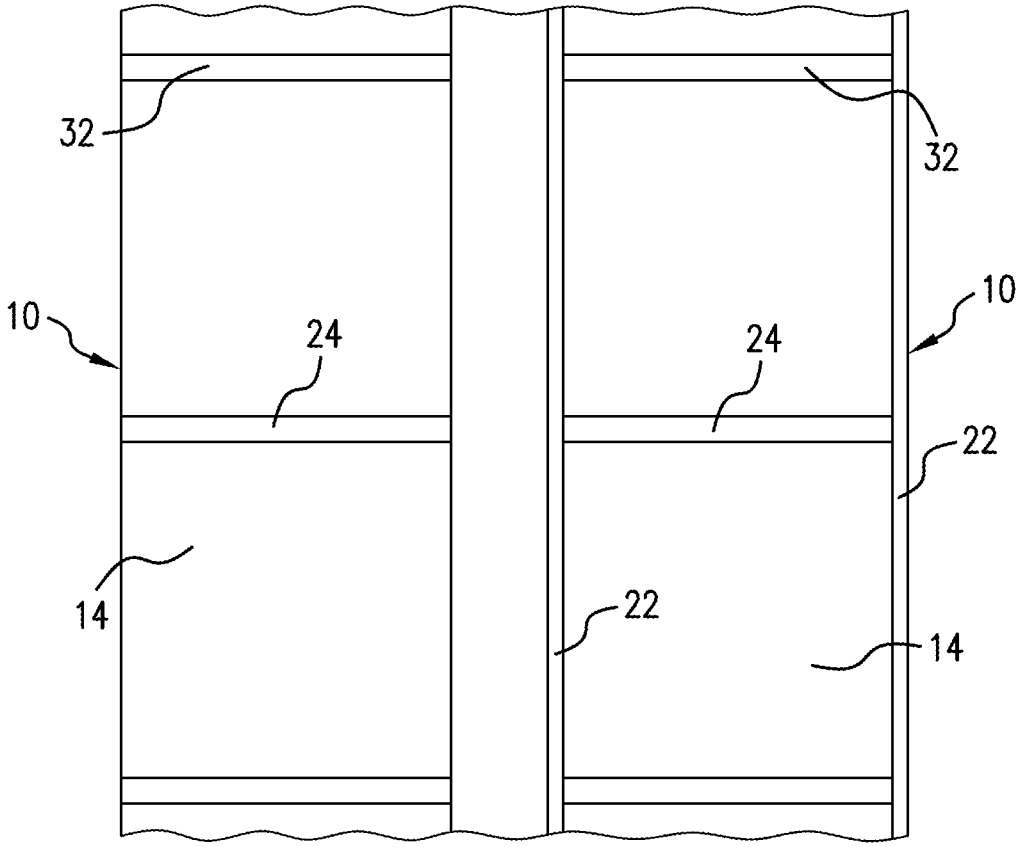
FIG. 7 top view of packaging walls, for example the walls of FIG. 1, used to form a packaging container according to an embodiment.
Figure 8:
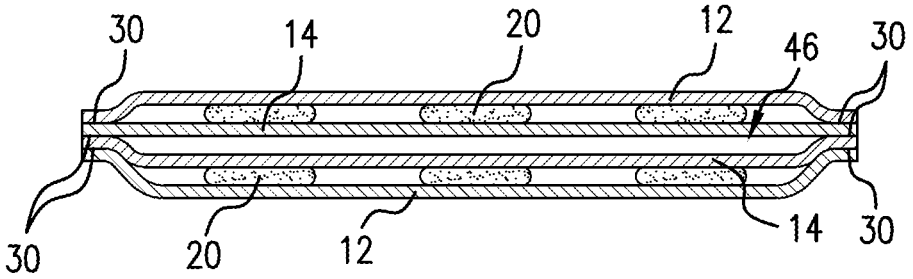
FIG. 8 is a cross-sectional longitudinal view of a packaging container formed from the walls of FIG. 8.

As shown in FIGS. 7-8, a plurality of longitudinal seals 30 are configured to seal together the plurality of webs 10. According to this embodiment, the packaging containers 44 are formed by sealing together a plurality of webs 10, rather than folding over a singular web 10.

Figure 9:
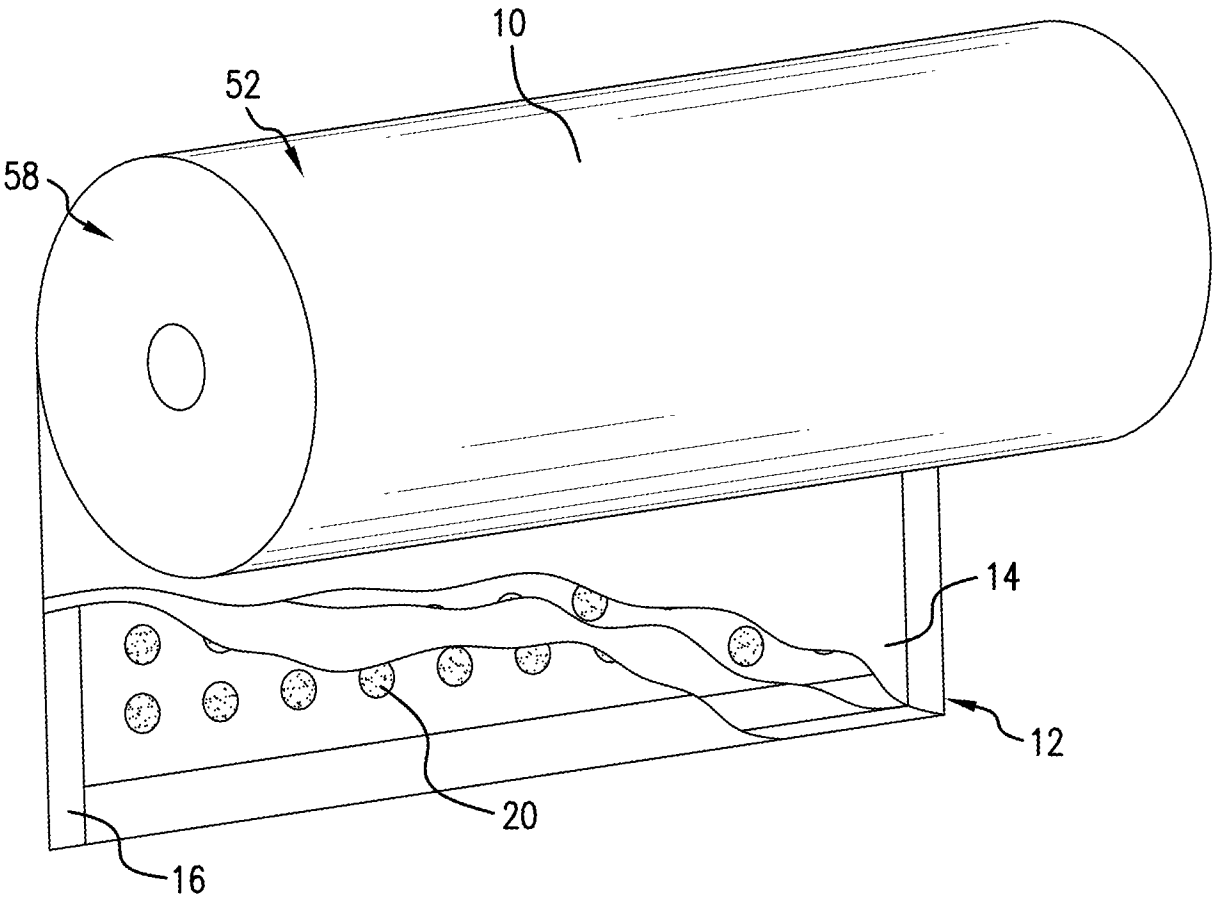
FIG. 9 is a perspective view of a completed, rolled supply web of separable packaging containers, constructed for example as shown in FIG. 8.
Figure 10:
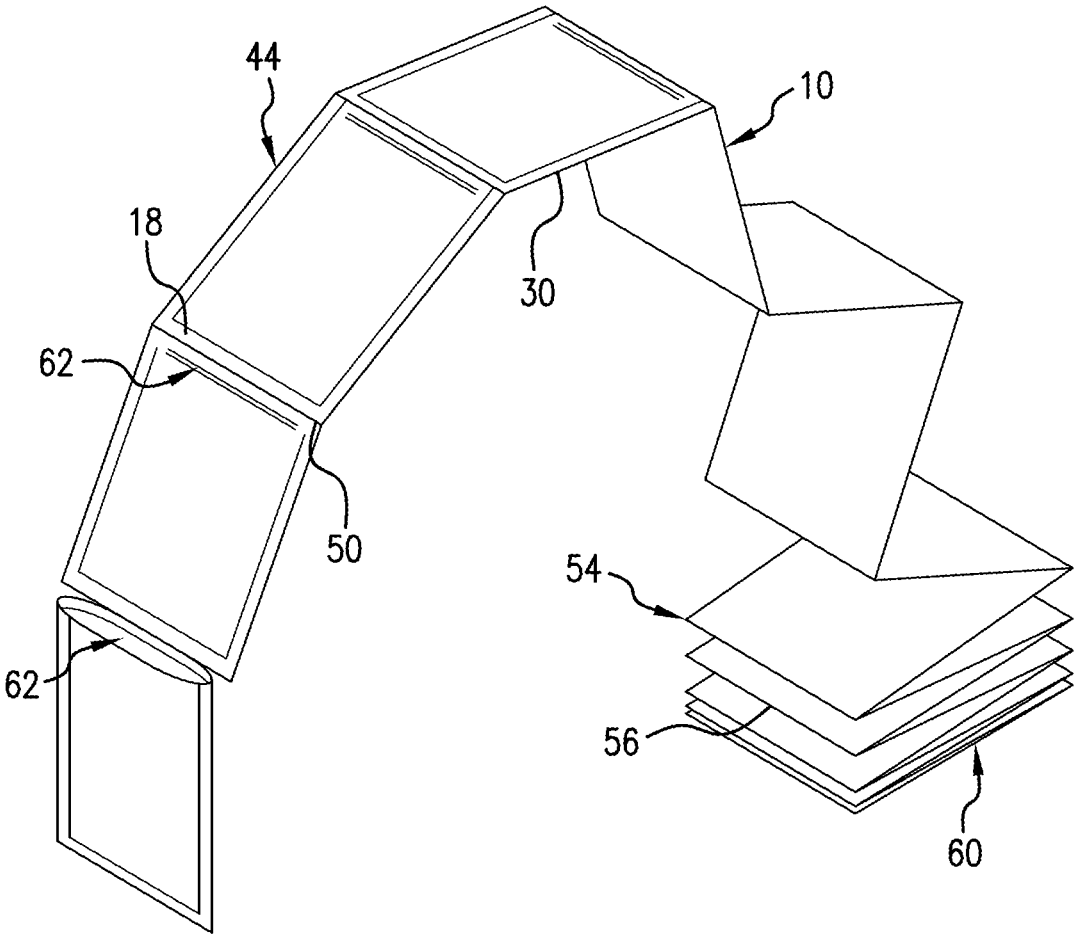
FIG. 10 is a perspective view of a completed supply web of separable packaging containers, constructed for example as shown in FIG. 8, in a fanfold configuration.

Once the web 10 of packaging material is formed, the web 10 is consolidated in an unexpanded, high-density supply configuration, forming a web stock of packaging units. According to some embodiments, the unexpanded, high-density supply configuration can be rolled into a supply roll configuration 52, such as is illustratively depicted in FIG. 9. The roll configuration 52 can be a cored roll configuration or coreless roll configuration. Another suitable high-density supply configuration is obtained by folding the web 10 into a fanfold stack configuration that has opposing folds 56, such as a fanfold (e.g., accordion) configuration 54 (such as is illustratively depicted in FIG. 10), and/or other suitable configurations. Another suitable high-density supply configuration is a series of 2 or more stacked packaging units. As shown in FIG. 10, prior to consolidation, the web 10 is folded into a series of preformed packaging containers 44. The web 100 can be in a high-density supply configuration 58 (as shown in FIG. 9), wherein an expandable wall formed by the web 100 is compacted in an unexpanded configuration. According to other embodiments, the web 10 can be in a high-density packaging container configuration 60 (as shown in FIG. 10), wherein one or more expandable walls are configured into the series of preformed packaging containers 44 and condensed into an unexpanded, high-density configuration.

Figure 11A:
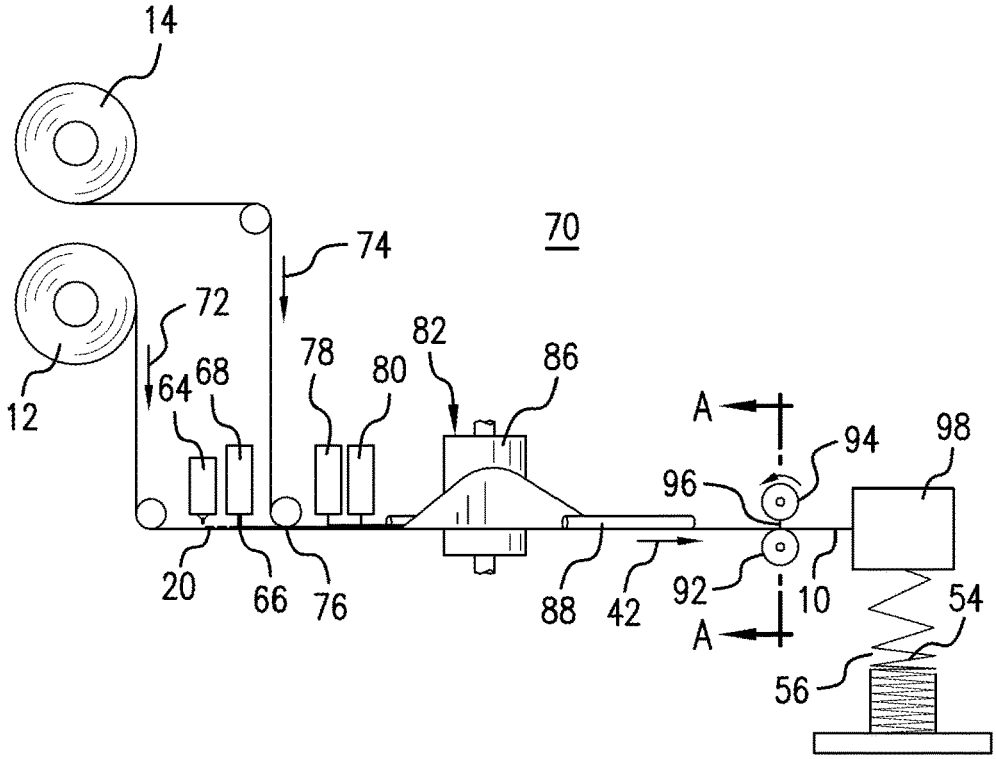
FIGS. 11A and 11B are side and top views, respectively, of a system for converting stock material into supply chain of separable packaging containers constructed, for example as shown in FIG. 3.
Figure 11B:
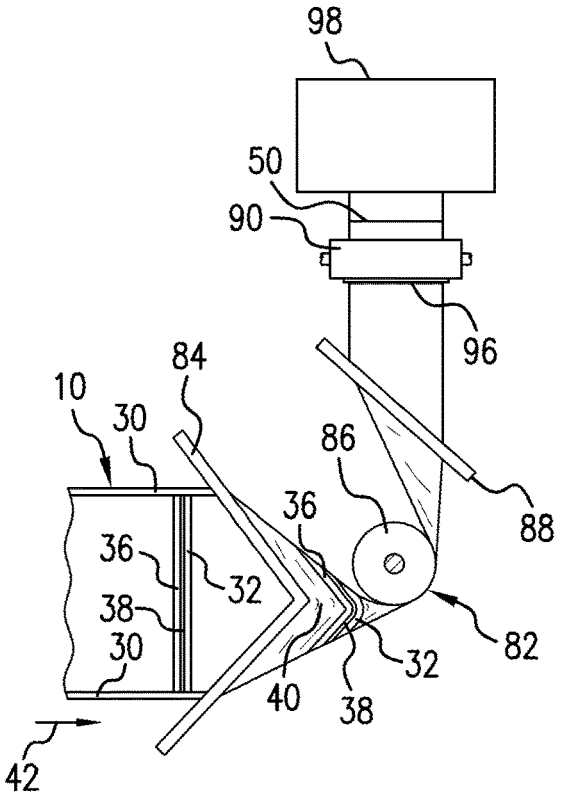

Referring to FIGS. 11A-11B, a system 70 for converting stock material into supply chain of packaging containers is shown. The web 10 includes a first ply 12 and a second ply 14. The first ply 12 is fed, in direction 72, and the second ply 14 is fed, in direction 74, and the first ply 12 is joined to the second ply 14. An expansion material 20 is applied to the first ply 12, using an expansion material applicator 64, and one or more sealing materials 66 are applied to the first ply 12, using a sealing material applicator 68. After the expansion material 20 and the sealing material 66 are applied, the first ply 12 and the second ply 14 are joined. The joining can include applying pressure using a pressure applicator 76 configured to apply pressure to the first ply 12 and the second ply 14.

After the first ply 12 and the second ply 14 are joined, one or more exterior sealing materials are applied to the exterior of the web 10, forming one or more exterior seals 30, 32 (shown in further detail in FIGS. 2 and 4), and 36 (shown in further detail in FIG. 2). One or more longitudinal seals 30 are applied to the outer longitudinal edges 34 of the web 10, using a longitudinal seal applicator 78, and one or more transverse seals 32, 36 are applied between the one or more longitudinal seals 30, using a transverse seal applicator 80. The web 10 is then fed, in direction 42, through a folding apparatus 82 which folds the web 10.

The folding apparatus 82 includes folding mechanism 84 (for example, a folding bar 84). A tension mechanism 86 (for example, a wheel 87) applies tension to the web 10, causing the folding bar 84 to fold the web 10 along the shape of the folding bar 84. The folding mechanism 84 can be a V-shaped folding bar or other suitable folding shape. For example, in some alternative embodiments, the folding mechanism 84 includes a plurality of bends.

The web 10 is folded along folding edge 40. The folding apparatus 82 includes a flattening mechanism 88 configured to flatten the web 10 once folded by the folding mechanism 84. The flattening mechanism 88 is a flattening bar configured to apply pressure to, and flatten, the web 10. The web 10 is then sealed along the one or more longitudinal seals 30, using a sealing apparatus. The flattening mechanism functions 88 can function as a sealing apparatus. In other embodiments, the system 70 can alternatively incorporate a separate sealing apparatus. The sealing apparatus is configured to apply heat, pressure, and/or other suitable means of activating the one or more longitudinal seals 30.

The system 70 includes a cutting apparatus 90. The cutting apparatus 90 is configured to form one or more regions of weakness 50 and an opening 62 in the web 10. The one or more regions of weakness 50 are configured to aid in separating the web 10 into one or more separate packaging elements (e.g., one or more packaging containers). The opening 62 is configured to enable access an interior cavity 46 of each of the one or more packaging containers 44. The opening 62 can be a slit. In other embodiments, the opening 62 is not completed cut open by the cutting apparatus 90 and is configured to be torn open. It is noted that the one or more regions of weakness 50 and/or the opening 62 can be formed prior to or subsequent to consolidation of the web 10. The cutting apparatus 90 includes an upper compression roller 92 and a lower compression roller 94. The upper compression roller 92 includes a series of teeth 96 configured to puncture the web 10, forming a region of weakness 50 transverse to the longitudinal edges of the folded web 10. The lower compression roller 94 can include a rigid surface, an elastomer, or other suitable material. In some embodiments, the cutting apparatus includes one or more blades, heat-cutters, and/or other suitable means of cutting one or more portions of the web 10.

Figure 12:
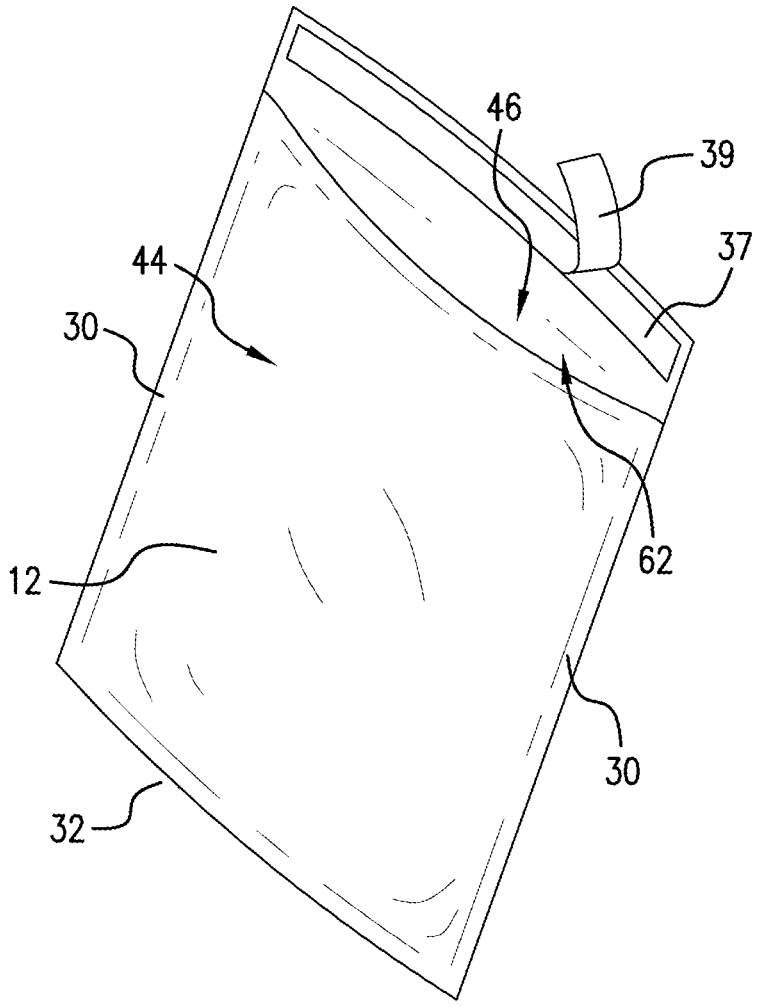
FIG. 12 is a perspective view of a packaging container, for example the packaging container formed in FIGS. 11A-11B.

According to some embodiments, such as shown in FIG. 12, transverse seal 36 is configured to seal the opening 62 closed subsequent to insertion of one or more products within the opening. In some embodiments, transverse seal 36 is a seal, having an adhesive substance 37 and a release surface 39 to which the adhesive 37 does not strongly adhere. In other embodiments, transverse seal 36 includes other types of seal as described herein.

The web 10 includes one or more regions of weakness 50 that extend transversely (e.g., generally perpendicularly) to the longitudinal direction at one or more of the longitudinal edges. In other embodiments, the regions of weakness 50 are alternatively placed elsewhere along the transverse direction of the web 10. The regions of weakness 50 can be provided by perforation, scoring, or other suitable technique for weakening the material at the desired locations such as to make separation of the individual envelope sections easier. A region of weakness 50 can be provided between each pair of adjacent packaging container formations 44, thereby allowing the individual packaging container formations 44 to be separated. The regions of weakness 50 can be provided within the perimeter of transverse seals 32, 36. The regions of weakness 50 can be through both plies 12, 14, or, alternatively, through one ply. The web 10 can include one or more slits configured to aid in the separation of adjacent packaging container formations 44.

In order to prevent the expansion material 20 from escaping from a packaging container formation 44 (particularly when chemical reactions are used to expand the expansion material), the transverse seals 18 of the first ply 12 and the transverse seals 24 of the second ply 14 can be positioned such that they encompass a region before and after the regions of weakness 50. The web 10 can include one or more slits at the longitudinal edges of the web 10 to aid in separation.

The system 70 includes a consolidating apparatus 98 configured to consolidate the web 10 into an unexpanded, high-density configuration such as, e.g., a roll configuration 52, a fanfold stack configuration 54, and/or other suitable configurations. The consolidation apparatus 98 is configured to bend, roll, and/or otherwise alter the shape of the web 10 into the consolidated, unexpanded, high-density configuration.

It is noted that the expansion material 20 and/or the sealing material 66 can be applied to the first ply 12 and/or the second ply 14. It is also noted that the web 10 can include a suitable expansion wall configuration and materials as herein described, such as the inflatable expansion materials shown and described herein in web 120.

Figure 13:
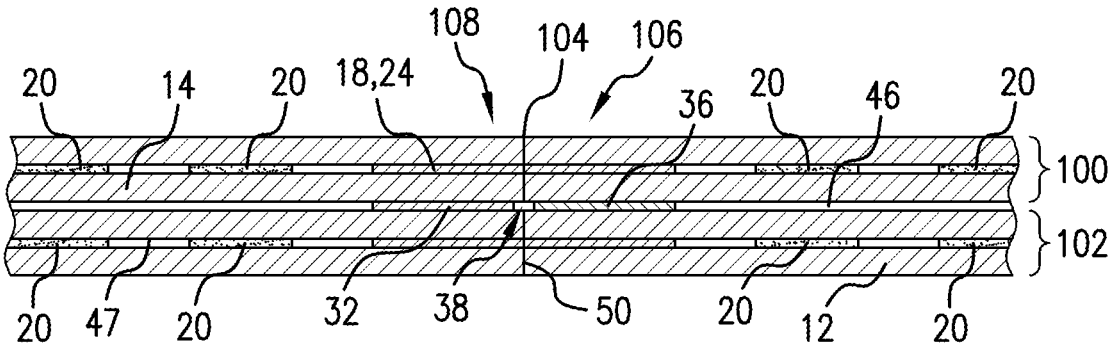
FIG. 13 is a cross-sectional side view across showing a region of weakness in a web of separable packaging containers constructed, for example, as shown in the above figures.

As shown in FIG. 13, the web 10 includes a first bag wall 100 and a second bag wall 102. The walls include wall cavities 47 into which the expansion material 20 is housed. The first bag wall 100 can include a cut 104 configured to enable access to an interior cavity 46 of the packaging container formation 44, while the second bag wall 102 includes a region of weakness 50 configured to enable separation of a top 106 of one packaging container formation 44 from a bottom 108 of a subsequent packaging container formation 44. The opening 46 is sealed along seal 36. In some embodiments, seal 36 includes a sealing material different from the sealing material of seal 32. In some embodiments, when seal 32 is formed, seal 36 remains unformed until after the object is placed within the interior cavity.

Figure 14:
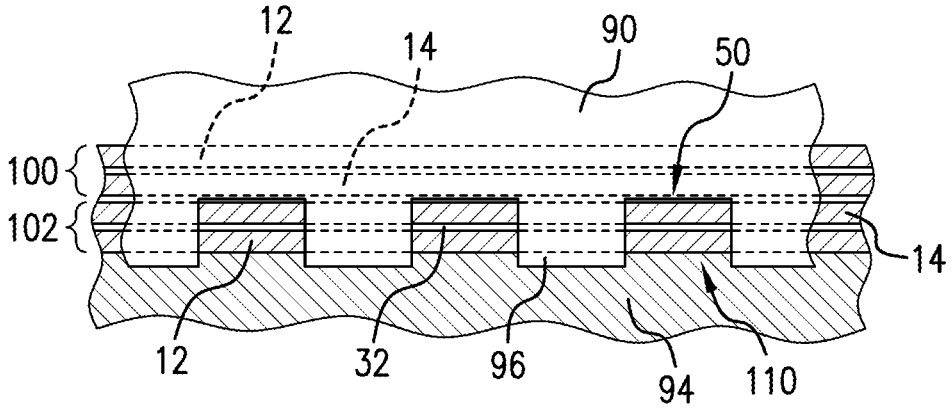
FIG. 14 is a cross-sectional longitudinal view along section plane A-A of FIG. 11A.

As shown in FIG. 14, the cutting mechanism 90 can be configured to cut through the first bag wall 100 while the teeth 96 of the cutting mechanism 90 perforate the second bag wall 102. There are recesses 110 between the teeth 96 configured to enable perforations 50 to form. The cutting mechanism 90 forms an opening 62 configured to enable access to the interior cavity 46 of the bag. In some embodiments, the cutting mechanism 90 is configured to form the opening 62 over the region of weakness 50. In some embodiments, the cutting mechanism 90 is configured to form the opening 62 adjacent to the region of weakness 50. In some embodiments, the cutting mechanism 90 is configured to form the opening 62 displaced a distance 35 from the region of weakness 50, forming a gap 38 between the opening 62 and the region of weakness 50 (as shown in FIGS. 2 and 11).

Figure 15A:
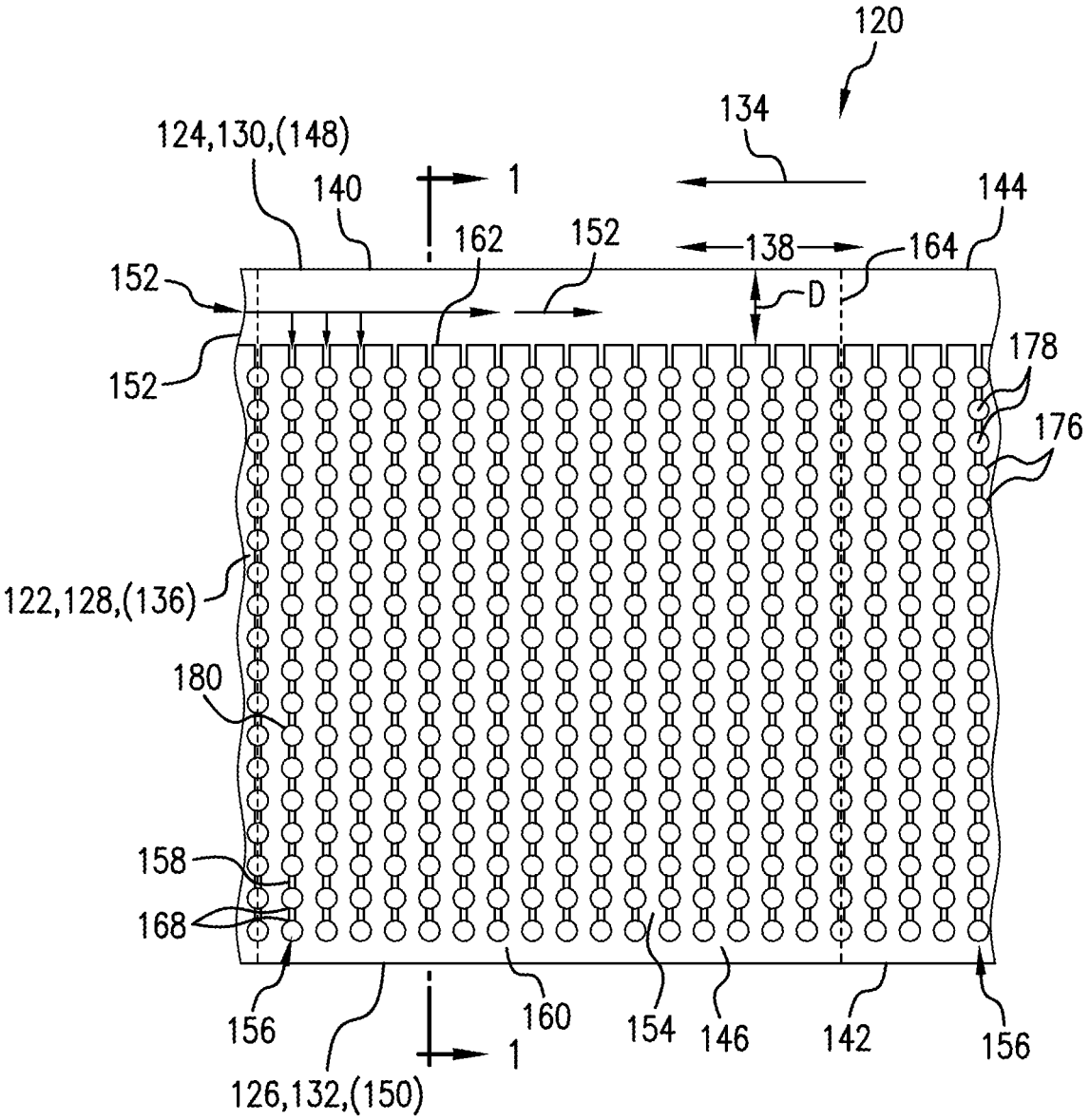
FIG. 15A is a schematic top view of an inflatable web with inflatable sub-chambers in accordance with an embodiment.

Referring to FIGS. 15A-16D, the web 10 may be a multi-ply inflatable web 120 of film for inflatable protective packaging. As shown in FIGS. 15A-16D, some embodiments of this disclosure are drawn, inter alia, to methods, systems, products, devices, and/or apparatuses generally related to flexible structures forming inflatable chambers. The flexible structure, such as the multi-ply inflatable web 120 of film for inflatable protective packaging, is provided. The inflatable web 120 includes a first web film layer, or ply, 122. The inflatable web 120 also includes a first longitudinal edge 124 and a second longitudinal edge 126. The inflatable web 120 includes a second web film layer, or ply, 128, having a first longitudinal edge 130 and a second longitudinal edge 132. The longitudinal edges 124,126,130,132 run in a longitudinal direction 134 of the web 120. The longitudinal direction of the web 120 can be the direction that the web 120 is advanced into a processing machine. The longitudinal direction 134 can also be the direction that the web 120 is fed into a processing machine, or the direction that the finished structure is rolled onto a storage roll after processing. A longitudinal direction 134 can be longitudinally upstream or longitudinally downstream. A longitudinally upstream direction 136 is a longitudinal direction opposed to a direction of movement of the web 120 through a processing machine. A longitudinally downstream direction is a direction that is substantially the same as a direction of the web 120 through a processing machine. Generally, a longitudinal direction 134 corresponds to the longest dimension of the web film layers 122,128. The second ply 128 is aligned to be overlapping and can be generally coextensive with the first ply 122 (as shown in FIG. 15A), i.e., at least respective first longitudinal edges 124, 130 are aligned with each other and/or second longitudinal edges 126, 132 are aligned with each other.

In some embodiments, the layers, or plies, 122, 128, can be partially overlapping with inflatable areas in the region of overlap. The plies 122, 128 can be joined to define a first longitudinal edge 140 and a second longitudinal edge 142 of the film 120. This can be done with separate sheets or by folding over a single sheet. A longitudinal seal 144 can be formed at the first longitudinal edge 140, and a longitudinal seal 146 can be formed at the second longitudinal edge 142. For example, the first longitudinal edges 124, 130 can be coupled together to form the first longitudinal edge 140 of the film 120, and the second longitudinal edges 126, 132 can be coupled together to form the second longitudinal edge 142 of the film 120. The coupling of the respective edges forms an airtight seal at the first and second longitudinal edges 140, 142 of the film 120.

Figure 15B:
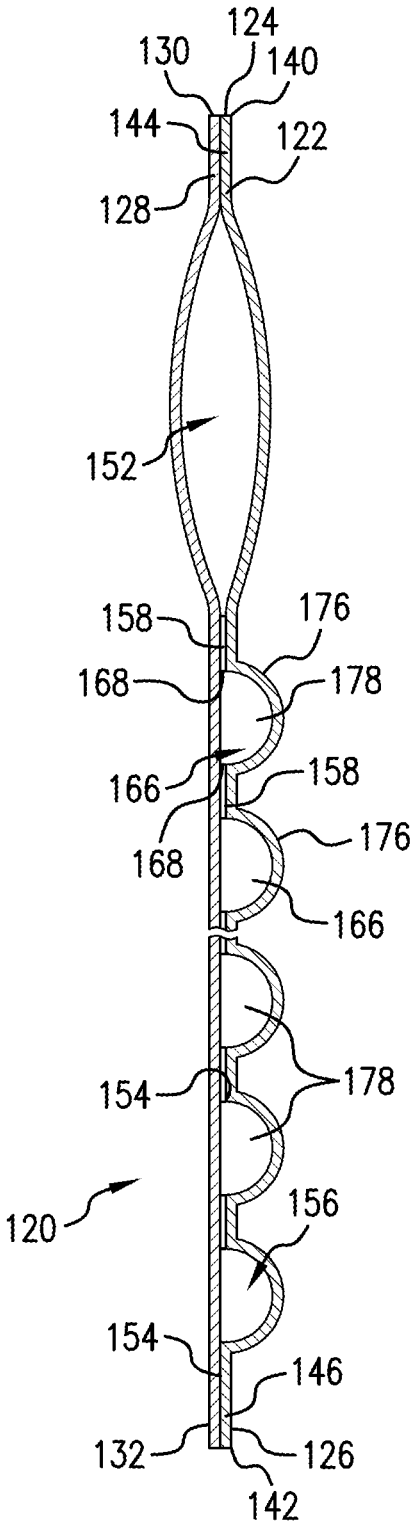
FIGS. 15B and 15C are cross-sectional views of various embodiments of inflatable webs having the arrangement of FIG. 15A.
Figure 15C:
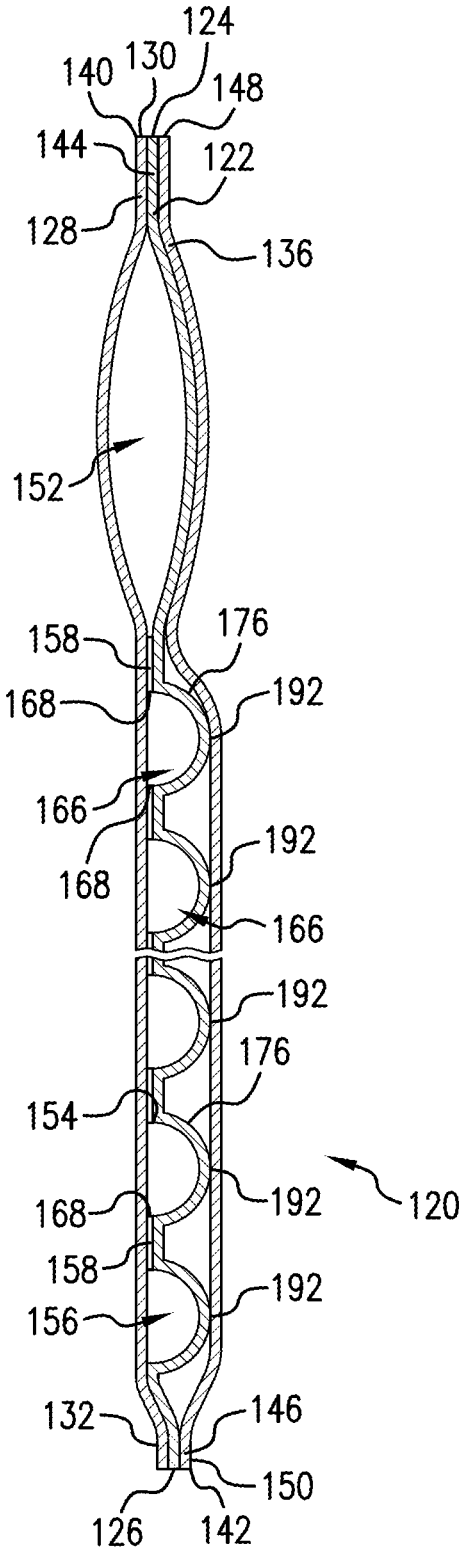

In some embodiments, a film ply 136 can be sealed to ply 122, thereby sandwiching ply 122 between ply 128 and 136, as illustrated in FIG. 15C. This provides added rigidity to the structure. The film ply 136 includes a first longitudinal edge 148 and a second longitudinal edge 150. The first longitudinal edges 124, 130, and 148 can be coupled together to form the first longitudinal edge 140 of the film 120 and the second longitudinal edges 126, 132, and 150 can be coupled together to form the second longitudinal edge 142 of the film 120. The coupling of the respective edges forms an airtight seal at the first and second longitudinal edges 140, 142 of the film 120. Although, in some embodiments, the first longitudinal edge 140 is not necessarily closed, it can remain open to form an inflation region 152, allowing fluid to be injected from the side. However, in other embodiments, the first longitudinal edge 140 is closed, forming a closed inflation region 152, such as a channel in which a nozzle is inserted.

The web 120 can be formed from any of a variety of web materials known to those of ordinary skill in the art. Such web materials may include ethylene vinyl acetates (EVAs), metallocenes, polyethylene resins such as low-density polyethylene (LDPE), linear low-density polyethylene (LLDPE), and high-density polyethylene (HDPE), paper, metal, and blends thereof. Other materials and constructions can be used. The disclosed web 120 can be rolled on a hollow tube, folded in a fanfolded box, or in another desired form for storage and shipment.

The various plies (e.g., 122, 128, and/or 136) can be connected via various seals across the expanse thereof. The seals can merely connect the film plies or the seals can further define or allow features to function. For example, plies 122, 128 can be connected together by seals 154. Additionally or alternatively, in accordance with various embodiments, one or more fluid holding cavities 156 are defined within a boundary formed by seals 154. The seals 154 can seal the plies 122, 128 together with one or more regions remaining unsealed, such as the fluid holding cavities 156. In some embodiments, the unsealed portions can include channels 158 and/or inflation regions 152 as well. The seals 154 can extend from the first longitudinal edge 140 to the second longitudinal edge 142, defining the various fluid-holding cavities 156 between the film plies. In some embodiments, such as shown in FIG. 15A, the seals 154 have a generally transverse orientation. The web 120 includes a series of transverse seals 154 disposed along the longitudinal extent of the web 120 in a transverse direction. A transverse direction is a direction extending at an angle to a longitudinal direction of the web 120. In some embodiments, the transverse direction is substantially perpendicular to the longitudinal direction. However, in other embodiments, a transverse direction can be at a non-perpendicular angle to the longitudinal direction at more than zero degrees and less than 90 degrees. In some embodiments, the seals 154 can be contiguous with the seals 160 that connect the edges 142. In some embodiments, the seals 154 can be contiguous with the seals 162 that define the inflation region 152. The second end 162 of seals 154 can be spaced a transverse dimension D from the first longitudinal edge 140. The distance between the first end 160 and second end 162 defines the transverse width of the transverse seal 154.

Each transverse seal 154 embodied in FIG. 15A is substantially straight and extends substantially perpendicular to the second longitudinal edge 142 (e.g., transversely across the film 120). It is appreciated, however, that other arrangements of the transverse seals 154 are also possible. It is contemplated that the transverse seal 154 can be sealed along the entirety of its area; however, it is also contemplated that the transverse seal can be sealed around a periphery with its middle portion unsealed, forming a pocket in its middle portion. It is also contemplated that the transverse seals 154 can be sealed with a longitudinal seal 144 proximate to the second ends 162. In other embodiments, a pair of substantially linear seals can be disposed on either side of a separation region.

The transverse seals 154 as well as the sealed longitudinal edges 140, 142 (which in some embodiments can be the same continuous seal) can be formed from any of a variety of techniques known to those of ordinary skill in the art. Such techniques include, but are not limited to, adhesion, friction, welding, fusion, heat sealing, laser sealing, and ultrasonic welding.

The inflatable web 120 can include fluid-holding cavities 156. The fluid-holding cavities 156 can be inflatable and deflatable in various embodiments, (e.g., FIGS. 15A-16D). In other embodiments, the fluid-holding cavities 156 can be filled with fluid upon inflation without a mechanism to deflate the cavity, aside from destroying the cavity. In some embodiments, the fluid-holding cavities can be inflatable/deflatable cavities 166 having an inflation port 168. In some embodiments, the fluid-holding cavities 156 can be large cavities extending across and/or around a number of features such as inflatable cavity. In some embodiments, the fluid-holding cavities can be fully isolated cavities that are filled with fluid upon formation with no deflation mechanism. These various cavities can be used separately to form inflatable webs or can be used in any suitable combination to form the webs. Some of these various embodiments are discussed in more detail below. In accordance with various embodiments, the various cavities contain a fluid, causing the respective web film layers defining the cavity to be maintained apart from one another at the locations of the cavities to provide cushioning. Suitable fluids can be gases such as air, carbon dioxide, nitrogen, or other suitable gases. Fluids can also be liquids or gels.

The web 120 can include an inflation region 152, (e.g., a closed or open passageway suitable to receive an injected fluid). In one example, the inflation region 152 is a longitudinal inflation channel as shown by way of example in FIGS. 15A-16D. The longitudinal inflation region 152 is disposed between the second end 162 of the transverse seals 154 and the first longitudinal edge 140 of the film 120. The longitudinal inflation region 152 can extend longitudinally along the longitudinal edge 140 and an inflation opening 174 can be disposed on at least one end of the longitudinal inflation region 152. The longitudinal inflation region 152 has a transverse width. In a preferred embodiment, the transverse width is substantially the same distance as the transverse dimension between the first longitudinal edge 140 and second end 162. It is appreciated, however, that in other configurations other suitable transverse width sizes can be used.

In some embodiments, the fluid-holding cavities are inflatable/deflatable cavities 166 having an inflation port 168. For example, FIG. 15B illustrates a cross-section of the inflatable web of FIG. 15A in which two plies are layered and include multiple sub-chambers. In accordance with various embodiments, the cavities 166 are formed by unsealed locations between two plies of material (e.g., 128 and 122). In accordance with various embodiments, in the formation of cavities 166, at least one film ply (e.g., 122) includes extended portions 176. In some embodiments, the inflatable cavities include individual fluid-holding cavities that are separate and apart from other cavities and configured to be sealed apart from other cavities.

In accordance with various embodiments, the extended portions 176 can define a bounded three-dimensional shape suitable for containing the fluids. The extended portions 176 can also be collapsible for packing in a denser configuration than in the inflated form. This bounded volume can be defined in part by a complex surface protruding from at least one of the plies (e.g., 122). For example, when laid flat the ply generally defines a planar form. While it is understood that the plies 122, 128 are flexible and therefore can define complex surfaces across their expanse as they are bent, folded, or otherwise deformed, when laid flat they can also generally conform to the flat surface across their expanse, thereby generally defining a planar surface. Even when defining a planar surface, the extended portions 176 protrude away from the generally planar surface as separate complex surfaces, forming a plurality of individual distinct cushioning structures in the ply. The complex surfaces forming the individual distinct cushioning structures are present even without internal air pressure. For example, as shown in FIGS. 15B and 15C, extended portions 176 protrude from ply 122 away from ply 128. In embodiments, in which ply 122 includes one or more extended portions 176, the ply defines a formed ply 122. In embodiments in which ply 128 includes one or more extended portions, then ply 128 would additionally or alternatively define a formed ply. In embodiments in which ply 128 does not include one or more extended portions, then ply 128 defines a base ply 128. As discussed below, ply 128 may be a base ply in various embodiments, but in other embodiments, ply 128 may be a formed ply. For clarity with respect to the examples shown in the various figures, ply 128 can be provided and referred to as a base ply, and ply 122 as a formed ply. But, these are merely presented as examples and a person of ordinary skill in the art would understand that both plies could be formed plies or alternatively one ply is a formed ply.

In accordance with various embodiments, the structure of the extended portions 176 can be defined by a three-dimensional plastic deformation in the surface of the material ply (e.g., 122), forming the complex surface. As used herein, a plastic deformation refers to permanent distortion that occurs when a material is subjected to tensile, compressive, bending, or torsion stresses that exceed its yield strength and cause it to elongate, compress, buckle, bend, or twist thereby leaving a permanent structural deformation in the material. When the ply is originally manufactured, it can have a generally uniform cross-section. The extended portions 176 are separate plastic deformations of the material forming the separate complex surfaces. In various examples, the plastic deformation is not uniform across an extended portion 176, thus forming the complex curve. In a particular example, some portions of the formed ply (e.g., 122) are plastically stretched away from the generally expansive surface of the film and discrete locations defining the complex surfaces. In such embodiments, on a structural level the material of the ply would show the polymer plastically deformed, plastically stretched, thinned, and/or permanently physically altered (meaning the structure will not naturally return to its previous shape or size) at the locations of each of the extended portions 176. The base ply (e.g., 128) closes the generally open side on the concave side of the extended portions 176 forming the cavity or sub-chamber 178. Multiple connected sub-chambers 178 can define a chamber 156 as shown in FIGS. 15B, and 15C.

In an alternative embodiment, a plurality of plastic plies are positioned to lay flat against each other. A seal pattern may be applied to an unstretched portion of the plies, defining the fluid-chambers. In some embodiments, the plastic plies are unstretched plastic plies. A plurality of unstretched flat plastic film plies are laid on each other and the seal pattern is applied to define the inflation chambers. In this embodiment, the portion of the plies that enclose the fluid chambers are unstretched. In some embodiments, the entirety of the film plies are unstretched. Suitable configurations of inflatable web material known in the art can be used. For example, the material shown in U.S. Patent Publication No. 2019/0291907.

In various embodiments, the extended portions 176 has a perimeter 180 that defines an opening to be closed by the base ply (e.g., 128). The opening has an area that is less than the surface area of the surface forming the extended portion 176 that protrudes away from the base ply (e.g., 128). In embodiments in which the extended portion 176 is formed by plastically stretching, it is the material that previously covered the opening area that is plastically stretched out to form the extended portion 176.

In accordance with various other embodiments, the structure of the extended portion 176 can be formed from other suitable structures defining the protrusion of complex surfaces from the ply. For example, the extended portions 176 can be molded in place, avoiding the plastic deformation in the material of the ply. In another example, the extended portions 176 can include a second capped structure, heat-sealed or otherwise adhered to the surface of the ply. While not necessarily enumerated herein, other suitable structures defining complex surfaces protruding from the ply, as would be understood by a person of ordinary skill in the art, are also contemplated herein.

In accordance with various embodiments, the extended portions 176 can protrude from one ply, defining a single direction of chamber protrusion, or from both plies, defining protrusions from both surfaces of the web 120. In one example, the extended portions 176 protrude from one formed ply (e.g., 122) but not the base ply (e.g., 128). In such examples, the base ply (e.g., 128) forms a portion of the bounded cavity but is defined by its natural shape in response to the fluid pressures, whereas the extended portion of the formed ply (e.g., 122) takes on the applied shape of the extended portions 176. Thus, the base ply (e.g., 128) would not necessarily protrude at the location of the cavities in the absence of internal fluid pressure. Even in the presence of internal fluid pressure, the base ply (e.g., 128) protrudes minimally or significantly less than the protrusion of the chamber 156 in the same region of the web 120. In another example, the extended portions are defined in both plies but at non-opposing locations. Stated another way, in a location where an extended portion is located in one ply, an extended portion is not located in the immediately opposing location of the other ply. In another example, various extended portions 176 are independently defined with both plies at the same or similar locations such that the chambers protrude in both directions at overlapping locations of the plies. While shown as circular as an example, it should be appreciated that the extended portions 176 can include a variety of suitable shapes and dimensions. For example, the extended portions 176 can be rectangular, triangular oval, oblong, etc.

In some embodiments, the protective packaging includes preformed inflated enclosures (see, e.g., bubble wrap). In some embodiments, the extended portions 176 are closed in a way that allows the cavities 166 to be inflatable and/or deflatable after the manufacturing of the web 120. For example, each of the cavities 166 can include an inflation port 168. A channel 158 can connect with the inflation port 168 or similar suitable structure for adding or removing fluid to or from the cavities 166 after formation of the cavities 166. In some embodiments, the various cavities 166 are also deflatable and inflatable after the manufacturing of the web 120. This is in contrast to traditional protective packaging such as bubble wrap in which the fluid is captured in the bubbles at the time of manufacturing and there is no way to deflate the bubbles after manufacturing of the material without destroying the bubbles, in which case the bubbles are not refillable. In accordance with various aspects of the present disclosure, the cavities 166 can be inflated after manufacture of the web and after the cavities 166 of the web have been deflated. This can be done by injecting air into an inflation port 168 of the cavities 166. In some embodiments, the various cavities are sealable once finally inflated, maintaining an inflated configuration.

In accordance with various embodiments, multiple cavities 166 are inflatable and deflatable, together forming a chamber 156. For example, a sub-chamber 178 can have inflation ports 168 that are interconnected with another sub-chamber 178 via channel 158. Together the group of interconnected sub-chambers 178 forms a chamber 156 with a common inflation channel 158 that is suitable to distribute the fluid to each of the sub-chambers 178 through their respective ports 168. As shown by way of example in FIG. 15A, the common inflation channel 158 can be a channel that extends between a row of chambers 156 serially (i.e. daisy-chained). In another embodiment, the common inflation channel can be a manifold that extends to each of the chambers 156 in parallel (e.g., in some embodiments, an orphan chamber is fed from the adjacent chamber in parallel). In accordance with various embodiments, the channel 158 may extend from the inflation region 152. In some embodiments, the web 120 includes multiple chamber channels 158 with each chamber channel 158 directed to separate chambers 156. For example, as shown in FIG. 15A a plurality of channels 158 extends from the inflation region 152. In this example, each channel extends transversely across the material from a longitudinal inflation region 152. Additionally, different groups of chambers are provided along the longitudinal length of the web 120.

The chamber 156 is sufficiently bounded to retain a fluid after being sealed. In some embodiments, the chamber 156 can be inflatable after being formed. In some embodiments, the chamber 156 can be deflatable after being formed. In some embodiments, the chambers can pass fluid back and forth between sub-chambers even after a final seal is applied to the chamber, preventing additional fluid from being added to the chamber. In some embodiments, the chamber 156 is also deflatable after being formed and prior to being sealed.

As shown by way of example in FIG. 15B, web 120 can include transverse rows of chambers 156 formed from multiple sub-chambers 178, each of the chambers being connected to inflation region 152. In this way, fluid injected into the inflation region 152 can pass though the channels 158 and into the inflation port 168 of each of the sub-chambers 178 filling the sub-chambers 178 and the chamber 156.

In accordance with various embodiments, web 120 can have a relative few large chambers per section (i.e. between regions of weakness discussed herein). For example, each section may have one large chamber. In another example, each section may have 2-5 chambers. In another example, each section may have 5-20 chambers. In other embodiments, the web 120 can have a relative large number of extended portions that may or may not form chambers. A large number of extended portions are referred to as caps. The caps can be the plastically deformed extended portions discussed above. For example, more than 20 plastically deformed extended portions per section may be referred to caps.

In some embodiments, the cavities 166 can be individually inflatable. For example, each cavity 166 can include an individual inflation port to the exterior of the web 120. Such an inflation port can include a one-way valve, a sealable port, a mechanically closing port, or the like.

In accordance with various embodiments, when the web 120 is inflated and being prepared to be used as protective packaging, one or more of the inflation port 168, the channel 158, or the inflation region 152 can be sealed causing at least a partial isolation in the chambers 156 and/or sub-chambers 166. Once the final seal is applied, embodiments lacking a valve are no longer sealable or deflatable. Up to this point, fluid forced into one or more of the inflation region 152, inflation port 168, the channel 158, sub-chamber 166, or chamber 156 can be forced back out and forced back in again. This allows for the material to be inflated and then deflated to a more condensed state for easier handling and shipping. After being handled and when being prepared as protective packaging, the web 120 can be inflated and have the final seal applied.

In accordance with various embodiments, the inflation channel 158 can be an extended protrusion in the formed ply 122. These extended formed channels can be made similar to the extended portions 176 discussed above. For example, these channels can have a structure that includes a plastic deformation in the formed ply 122. In other embodiments, the channels 158 may be formed by an unsealed region between formed film 122 and base ply 128. Fluid can then pass between the unsealed plies 122 and 128. Seals can then bound the sides of the channels to direct fluid from one cavity to the next. In various embodiments, the channels are significantly smaller than the chambers 156 and/or the extended portions 176.

In some embodiments, the fluid-holding cavities can be isolated cavities filled with fluid upon formation. The isolated cavities have no inflation port and thus can only release the fluid upon destruction. Similar to the inflatable cavities 166 discussed above, the isolated cavities are formed from an extended portion 176 similar to those discussed above. As a distinction, however, the isolated cavities are filled when they are formed as they do not have an inflation port or connected channel and are thus not inflatable or deflatable unless destroyed. In this embodiment, plies 122 and 128 are sealed to one another the full circumference around the cavities without the presence of the inflation port or channels.

In some embodiments, the isolated cavities can include intra chamber channels. Such cavities are filled at formation. They do not have an inflation port on the exterior but can include channels that extend between the sub-chambers allowing the fluid contained therein to be pushed back and forth within the connected sub-chambers.

These isolated cavities, however, can be surrounded by an inflatable cavity. The isolated cavities can be defined by seal 154, forming a perimeter around them with the isolated cavities being unsealed. For example, as discussed above, plies 122 and 128 can be sealed together to define the isolated cavities or the inflatable cavities 178. A tertiary ply 136 can also be provided. The tertiary ply 136 is tertiary because it can be attached to base ply 128 and formed ply 122. In various examples, the tertiary ply 136 and base ply 128 sandwiches formed ply 122 there-between. In such an embodiment, tertiary ply 136 is sealed to formed ply 122. In one example, the seals are on the exterior surface of the expanded portion 176. In a more particular example, the seals are located on the farthest protruding portion of the exterior surface of the expanded portion 176. The tertiary ply 136 is also sealed to formed ply 122 transversely across the ply at periodic locations along the length via transverse seals. Similar seals can be applied in the other examples of webs shown herein (e.g., FIG. 15A). The transverse seal can be located where transverse regions of weakness are. Also as discussed above, tertiary ply 136 can have longitudinal seals along the edges 144 and 146 along with a final seal along the inflation region. Each of these outer seals (e.g., 144 and 146) enclose the region around the expanded portions 176. The seals 192 hold the tertiary ply 136 to the outer surface of the expanded portions 176. In embodiments, discussed below, the volume between ply 122 and 136 and within the seals is the secondary cavity. Here, cavity is shown containing fluid. In some examples, the fluid may be open to atmospheric air (see e.g., FIG. 15D) or the fluid may be sealed. For example, the fluid here may have been trapped at the time of sealing the ply 136 to ply 122. In some embodiments, this volume is passively inflatable (e.g., FIG. 15D). In some embodiments, this volume is actively inflatable. Thus, the secondary cavity can form a chamber that is separately inflatable and/or separately sealable from the cavities defined by the expanded portions 176.

In various embodiments, the web 120 includes one or more separation regions or regions of weakness 164. The separation region 164 facilitates separation of two adjacent web portions such as separate groups of chambers 156. The regions can be separated such as by tearing the web 120 by hand or with the assistance of a tool or machine. A separation region 164 can facilitate either or both partial or total separation of adjacent inflatable chambers 156. As illustrated in the schematic of FIG. 15A, the separation region 164 is positioned between chambers 156. In this way, chambers 156 can be easily separated from one another. In the embodiment of FIG. 15A, thin transverse seals 154 are arranged adjacent to the separation regions 164, on either side. While illustrated adjacent to the seal 154, it is appreciated that the separation region 164 can also extend through the seal 154, or through unattached plies 122, 128, 136 (as included in the particular embodiment) such as through the various inflatable cavities and the plies defining them. In various embodiments, lines of weakness can be used to separate the regions.

By way of example, FIG. 15A illustrates a schematic of an inflatable web 120 with inflatable sub-chambers 178 forming multiple transverse chambers 156 that reoccur longitudinally of the length of the inflatable web 120. Each of the sub-chambers 178 in each chamber 156 is connected by channel 158. The channel 158 also connects to inflation region 152 for inflation or deflation of the chamber 156. FIG. 15B is a schematic of a cross-section of the inflatable web 120 based on one particular embodiment of FIG. 15A. In some examples, the web shown in FIG. 15A can be made with just plies 122 and 128 as shown in FIG. 15B or the web shown in FIG. 15A can be made with more plies such as plies 122, 128, and 136. As these are merely examples it is appreciated that any suitable number of plies can be used in the formation of web 120. As shown in the cross section of FIG. 15B, which is taken along the cross section line 1-1 shown in FIG. 15A, the expanded portions 176 are formed in ply 122 and sealed to base ply 128 forming the sub-chambers 178. The connected sub-chambers form chamber 156. FIG. 15C is a schematic of a cross-section of the inflatable web 120 based on another particular embodiment of FIG. 15A. Here web 120 includes plies 122, 128, and 136. Again, these are merely examples and it is appreciated that any suitable number of plies can be used in the formation of web 120. As shown in the cross section of FIG. 15C, which is taken along the cross section line 1-1 shown in FIG. 15A, the expanded portions 176 are formed in ply 122 and sealed to base ply 128 forming the sub-chambers 178. The connected sub-chambers form chamber 156. The tertiary ply 136 can be sealed to formed ply 122 at the peaks of the expanded regions 176. The cavity defined there-between is an inflatable secondary cavity. One inflation region 152 is formed between plies 122 and 128. Fluid is injectable into chamber 156 via inflation region 152.

By way of example, in another embodiment, the tertiary ply 136 includes openings near the edges 148, 144 thereof. The openings allow air to pass through the ply 136 to the volume between ply 136 and formed ply 122. Thus, when the chambers 156 are inflated, volume can fill with fluid (e.g., atmospheric air). This limits ply 136 from adhering to ply 122 via a vacuum therebetween.

Figure 15D:
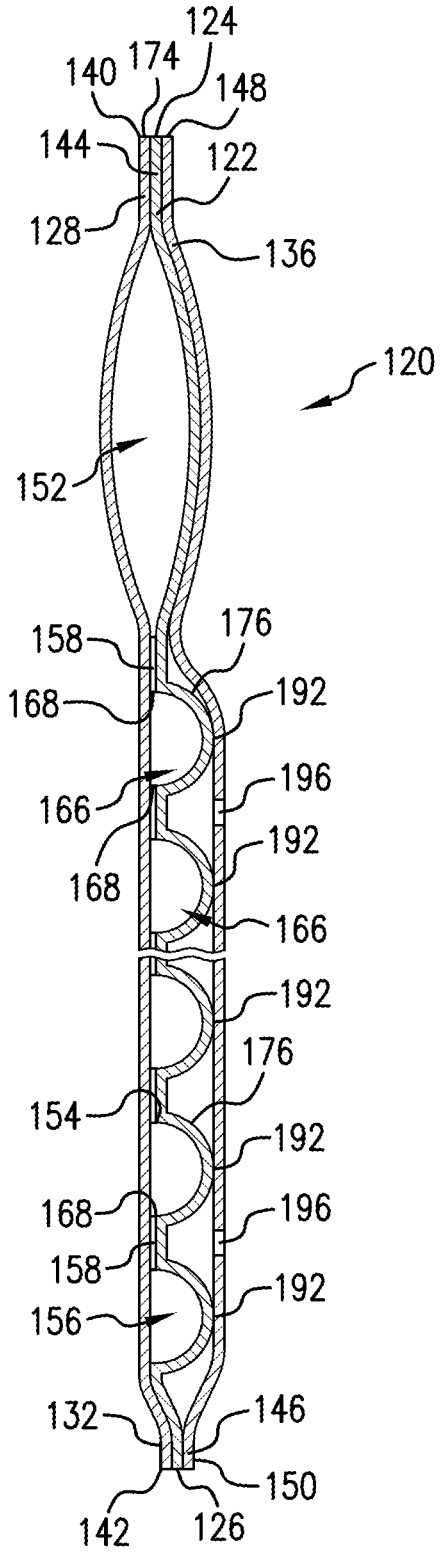
FIG. 15D is a cross-sectional view of an embodiment of the inflatable web of FIG. 15C.

FIG. 15D illustrates another example of a passively inflated cavity. In this embodiment, the inflatable web 120 includes inflatable sub-chambers and a perforated tertiary ply 136. The perforations 196 pass through the tertiary ply 136 but not the other plies. The perforations 196 allow air to pass through the ply 136 to the volume between ply 136 and formed ply 122. Thus, when the chambers 156 are inflated, volume can fill with fluid (e.g., atmospheric air). This limits ply 136 from adhering to ply 122 via a vacuum there between.

By way of example, the web 120 can, alternatively, include chambers 156 that are positioned diagonally with respect to the inflation region 152. This diagonal orientation can improve the deflation of the chambers after they are originally formed. In some embodiments, chamber 156 terminates before traversing across the web 120. In having a chamber with an early termination, a gap is formed allowing for the application of a region of weakness to form the separation region 164. In some embodiments, the inflatable web 120 can alternatively have a staggered orientation of inflatable sub-chambers 178. Here, each of the sub-chambers 178 are connected to the next adjacent sub-chamber 178 via a channel 158. Each of the different channels leaves the sub-chamber 178 at opposite angles. This leaves a staggered pattern of sub-chambers 178 forming a zigzag chamber design. Doing this allows of more sub-chambers 178 to be packaged in a single web. In some embodiments, chambers 156 have a linearly transverse orientation with channels 158 connected to a central inflation region. One set of channels exit the inflation region in one direction and another set of channels exit the inflation region in the opposite direction. This allows for chambers 156 to extend from the inflation region in both directions.

In some alternative embodiments, the inflatable web 120 includes isolated cavities. The cavities are surrounded by the secondary cavity. An inflation region directs fluid into the secondary cavity. A final seal along the inflation region seals the fluid into the secondary cavity. In some embodiments, the web 120 includes one or more segment seals, which seal the secondary cavity from the lines of weakness 164. Thus, the segments of the web 120 can be torn at the lines of weakness 164 without rupturing the secondary cavity.

It should be appreciated that while the tertiary ply 136 can be used to form the secondary cavity, it can additionally or alternatively be used to reinforce the web 120 making it stiffer. The additional layer adds stiffness by forming a structure similar to an I-beam. Meaning, that while the volume of the web 120 may be the inflated sub-chambers or similar cavities, their dispersion across the surface does not necessarily add stiffness. However, having a film ply on both the top and bottom of these cavity structures forms a type of I-beam increasing rigidity. This may be accomplished by increasing the bending moment of inertia. As indicated variously herein, the cavity between the tertiary ply 136 and the formed ply 122 can be inflated after the formation of the formed layer is formed. The cavity may be inflated before, after, or at the same time as the chambers defined by the formed ply 122 are inflated.

Once the web 10 is consolidated, it is fed through a protective packaging machine, such as those shown in FIGS. 17-18 and 20-21.

Figure 17:
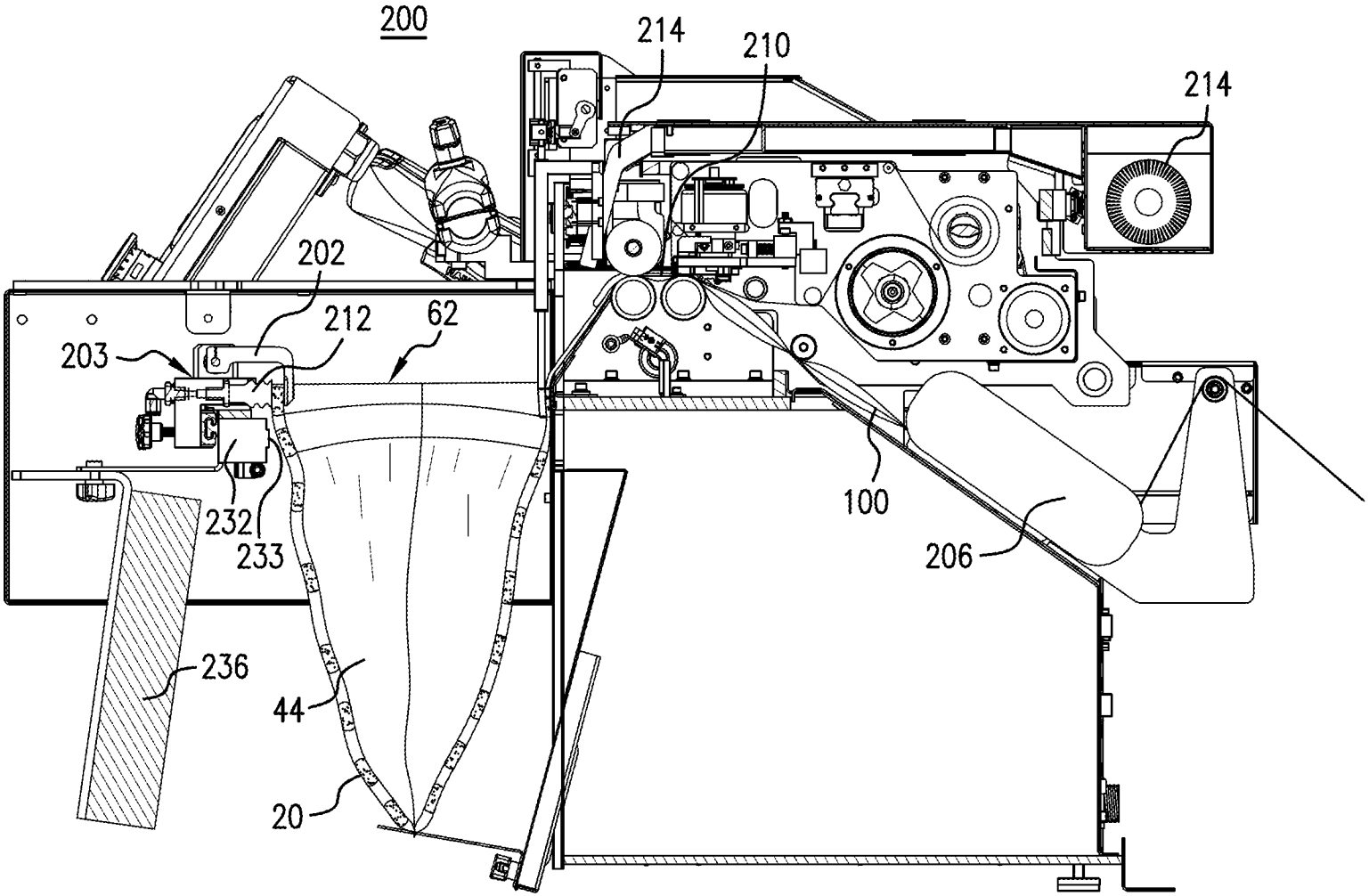
Figure 18:
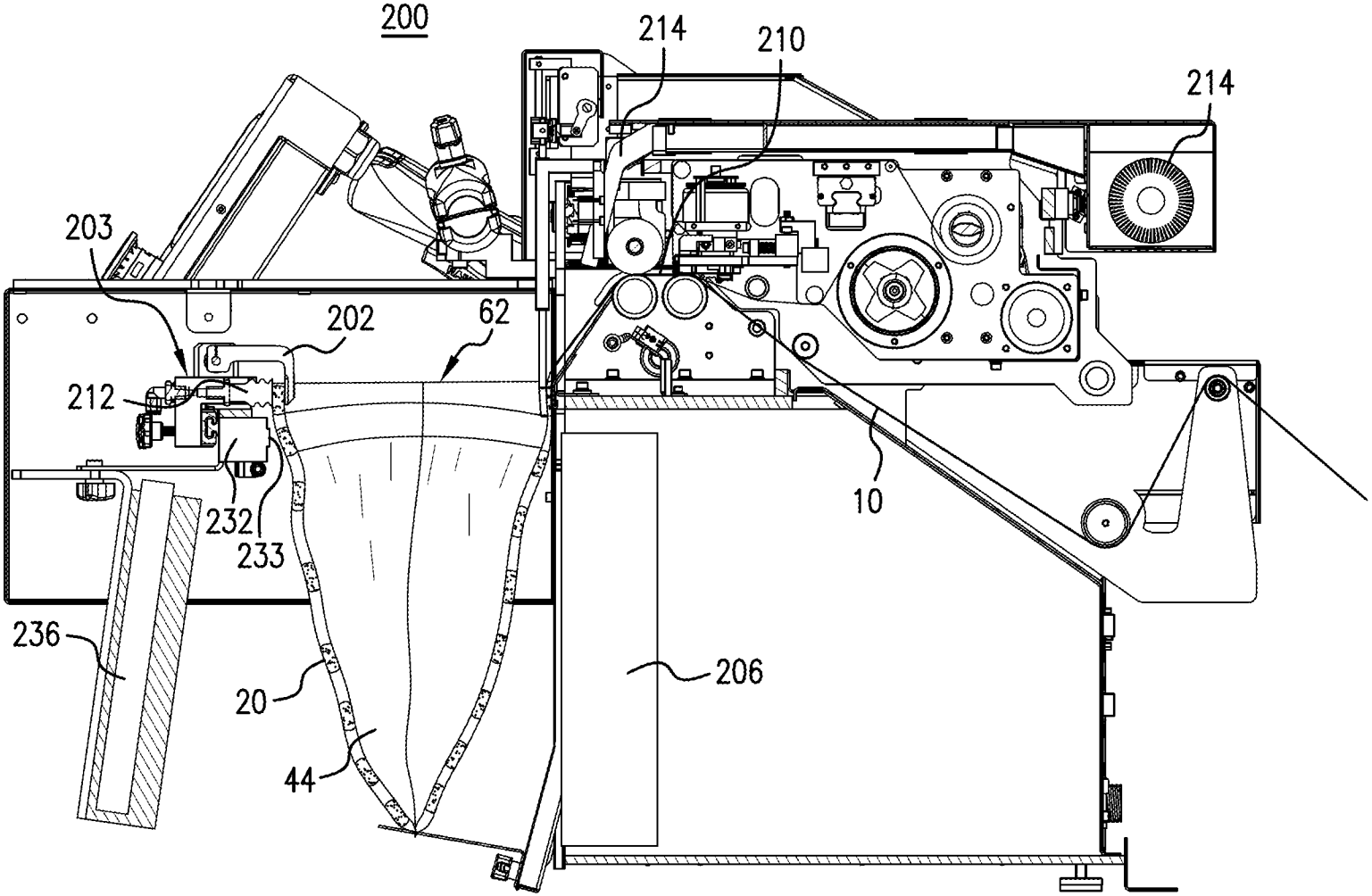
FIG. 18 is a cross-sectional side view of an expansion and bagging device according to an embodiment.

One or more steps in forming the series of bags are performed using protective packaging machines, such as the bagging machines 200 shown in FIGS. 17-18 and the bagging machines 300 shown in FIGS. 21-22.

As those shown in FIGS. 17-18, the bagging machine 200 is fed a web 10 that has been pre-folded and/or sealed in order to include a web 10 of preformed bag formations. In other embodiments, such as in FIGS. 21-22, the bagging machine 300 is configured to receive an unfolded or unsealed web 10 and form the web 10 into one or more packaging container formations 44.

If the web 10 includes inflatable material, the bagging machine may inflate the inflatable material prior to setting the seals. If the web 10 includes expansion material 20, the bagging machine may, through application of heat or other suitable means, expand the expansion material prior to, during, or subsequent to setting the seals.

Figure 16:
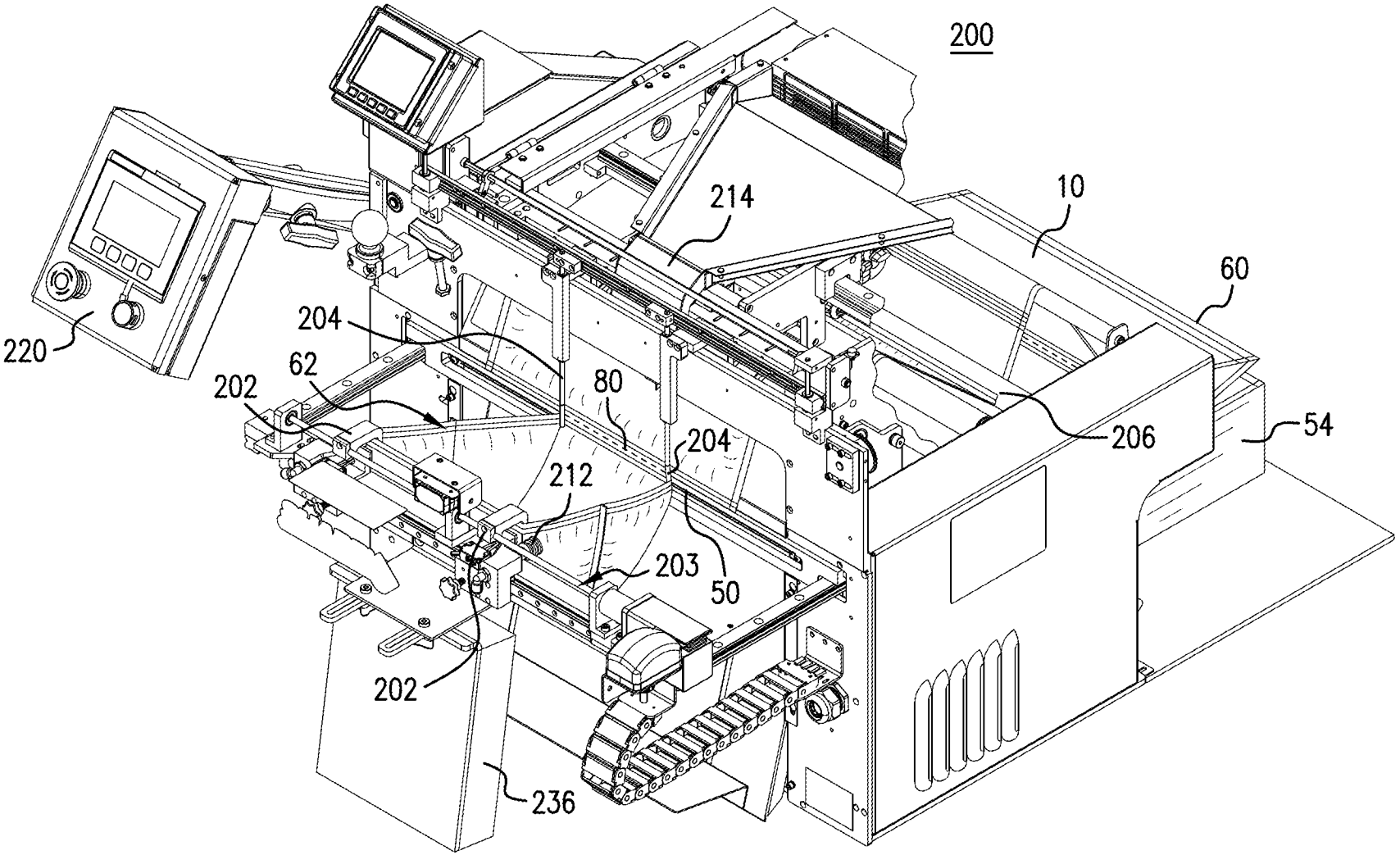
FIGS. 16 and 17 are a perspective (FIG. 16) and cross-sectional side (FIG. 17) view of an expansion and bagging device in accordance with an embodiment.

According to the embodiments shown in FIGS. 16-17, the bagging machine 200 may be configured to receive a web 10 of preformed packaging container formations 44 and be configured to open the opening 62 in each bag formation in order to access the interior cavity 46 of each bag formation 44.

In the embodiment of FIG. 16, the bagging machine 200 includes a plurality of fingers 202 and/or telescopic projections 204 configured to pull open the bag opening 62, enabling one or more products/objects/etc. to be inserted into the interior cavity 46.

The web 10 is fed into the bagging machine 200 in an unexpanded, high-density configuration. The web 10, at the supply side of the bagging machine 200, may be in a fanfold supply configuration 54 and/or other suitable configuration such as, for example a roll configuration 52.

The bagging machine 200 includes an expansion device 206. If the web 10 includes an expansion material 20, the expansion device 206 can include a heating element, heating coil, hot air applicator, radiofrequency radiation generator, UV light applicator, chemical reaction applicator, pressure mechanism, or other suitable device for expanding the expansion material. Alternatively or additionally, if the web 10 includes one or more inflatable chambers, the expansion device 206 can include an inflation device configured to inject fluid to expand and fill the fluid-chambers (as shown, for example, in FIG. 19). The fluid may be air or other suitable fluids. In some embodiments, the expandable element of the web 10 includes one-way valves to retain the fluid in the chamber. In some embodiments, the inflatable chambers require a longitudinal seal to be applied (see, e.g., FIG. 19). In some embodiments, such as that shown in FIGS. 16-17, the expansion mechanism 206 is positioned and configured to expand the expandable element prior to inserting a product into the interior cavity 46. In other embodiments, the expansion mechanism 206 is positioned and configured to expand the expandable element subsequent to inserting a product into the interior cavity 1105. In yet other embodiments, such as that shown in FIG. 18, the expansion mechanism 206 is positioned and configured to expand the expandable element during the inserting of a product into the interior cavity 46.

As shown in FIG. 16, the expansion device 206 is positioned upstream from a bagging mechanism 208 to deliver the web 10 to the bagging mechanism 208. The bagging mechanism 208 is configured to seal and separate bag formations from subsequent bag formations, forming individual bags.

In other embodiments, the expansion device 206 is positioned at or downstream from the bagging mechanism 208 in order to cause the walls of the web 10 to expand at other points during the bag-making process. In some embodiments, such as that shown in FIGS. 17 and 18, a printing assembly 210 may be used to print one or more images and/or one or more pieces of data/information onto the web 10.

As shown in FIG. 17, the expansion mechanism 206 is configured to expand the expansion element prior to opening the bag opening 62 for insertion of one or more products. In other embodiments, such as shown in FIG. 18, the expansion mechanism 206 is configured to expand the expansion element at the same time as or after opening the bag opening 62 for insertion of one or more products.

The web 10 includes one or more regions of weakness 50 and one or more openings 62, applied prior to the sealing process. In other embodiments, the one or more regions of weakness 50 and/or one or more openings 62 are applied during or after the sealing process. The regions of weakness 50 are configured to be broken in order to separate one packaging container from a subsequent packaging container. The openings 62 are configured and positioned to enable access to the interior cavity 46 of a packaging container formation 44 and may be opened by the mechanical fingers 202 and/or suction cups 212. Pressurized air can be used to aid in opening the opening 62 in the packaging container formations 44.

The fingers 202 are configured to pinch a portion of the packaging container opening 62, providing further securing means of opening up the packaging container at the opening 62 and holding the packaging container in place. The bagging machine 200 can include an air blower 214 configured to apply air pressure to the opening 62 to aid in opening the packaging container. The opening 62 can include a pouch seal. The pouch seal can include an adhesive for sealing closed the opening 62 once product is inserted. Other forms of sealing the opening 62, such as heat sealing, can, additionally or alternatively, be implemented. Once the opening 62 is closed and sealed, the regions of weakness 50 can be broken by suitable means such as, for example, reversing the next packaging container, cutting, melting, or other suitable means.

Each packaging container 44 in the web 10 can be separated using a pulling force applied to each packaging container 44, tearing the region of weakness 50 located between each bag in the series of bags, or using one or more cutting edges configured to form a laceration along the seam connecting two packaging containers 44 in the series of packaging containers 44. In some embodiments, each bag in the series of bags is separated using focused heat configured to melt a portion of the seam connecting two packaging containers 44 in the series of packaging containers 44.

Figure 20A:
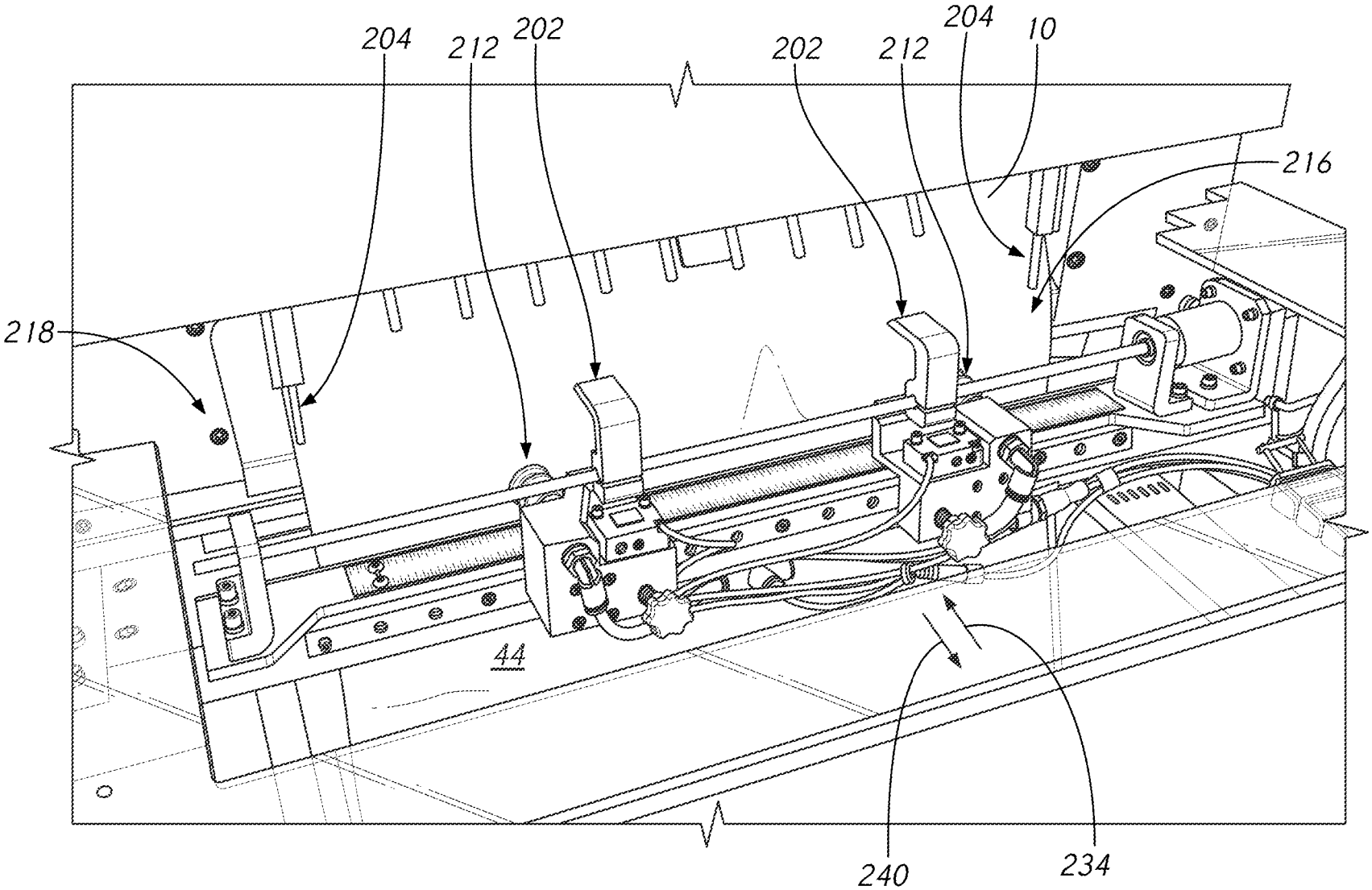
FIGS. 20A, 20B, 20C, 20D, 20E, 20F, 20G, 20H, and 20I are perspective views of a bag opening and sealing assembly of an expansion and bagging device in accordance with various examples of the present disclosure.
Figure 20B:
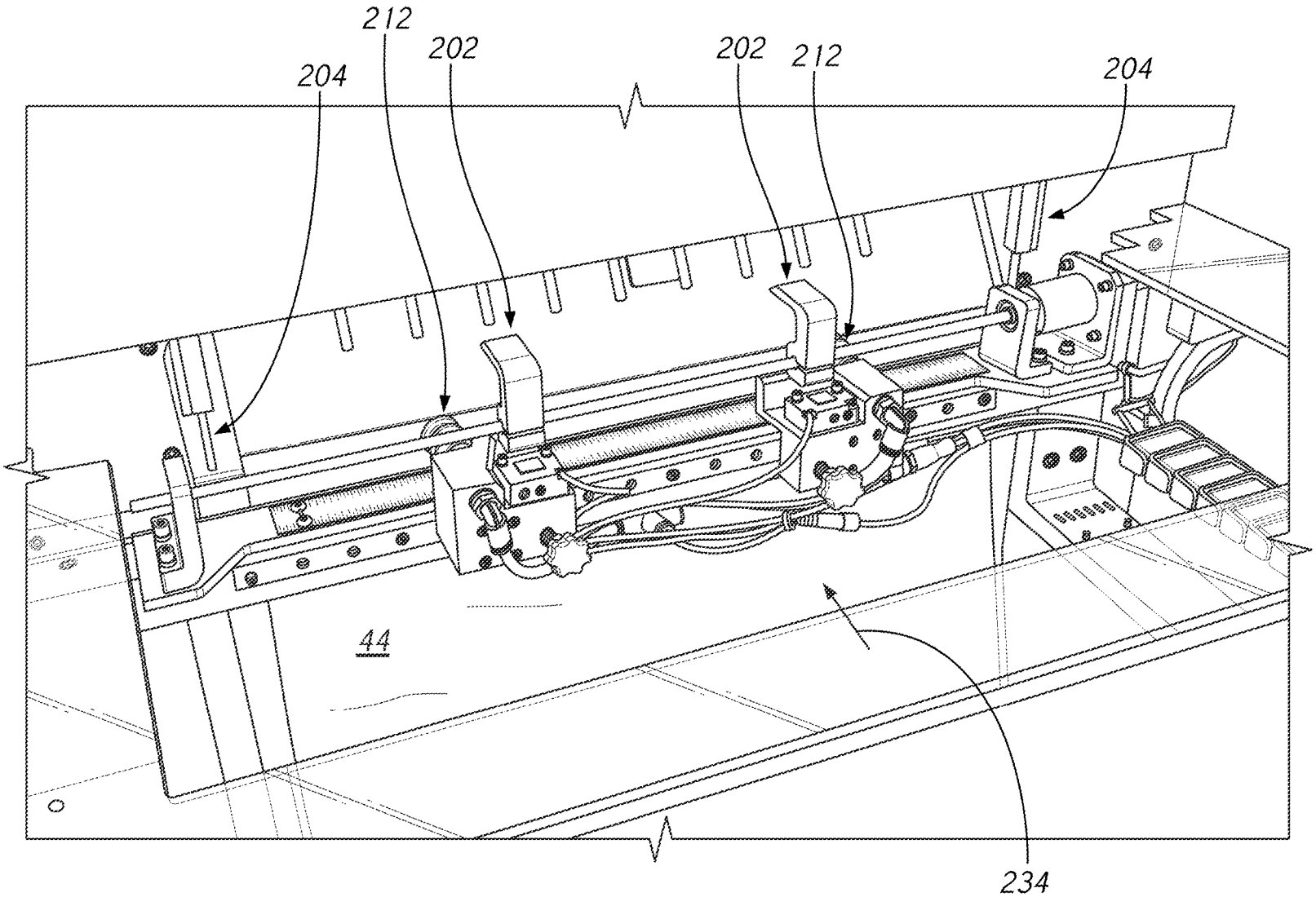
Figure 20C:
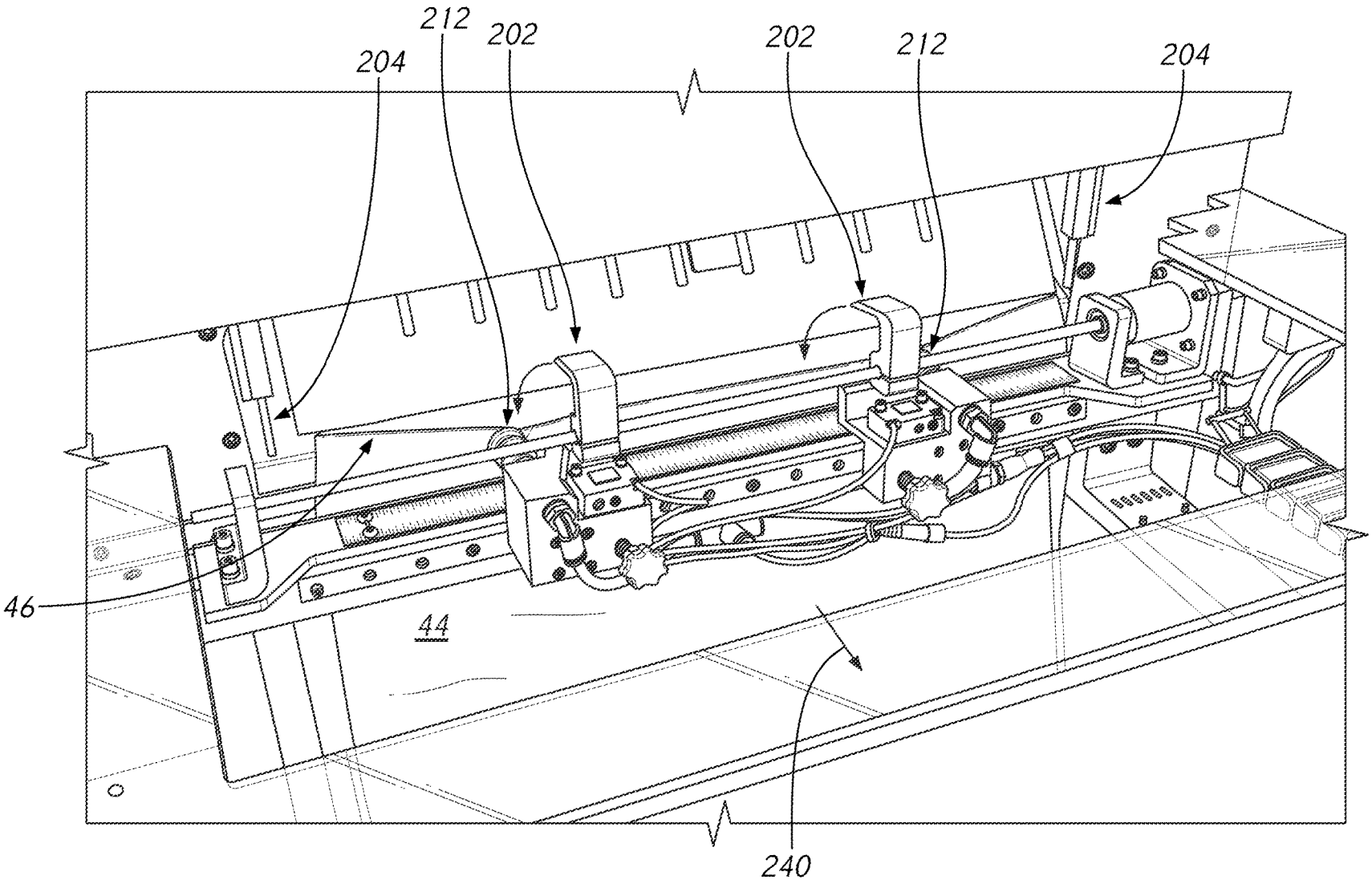
Figure 20D:
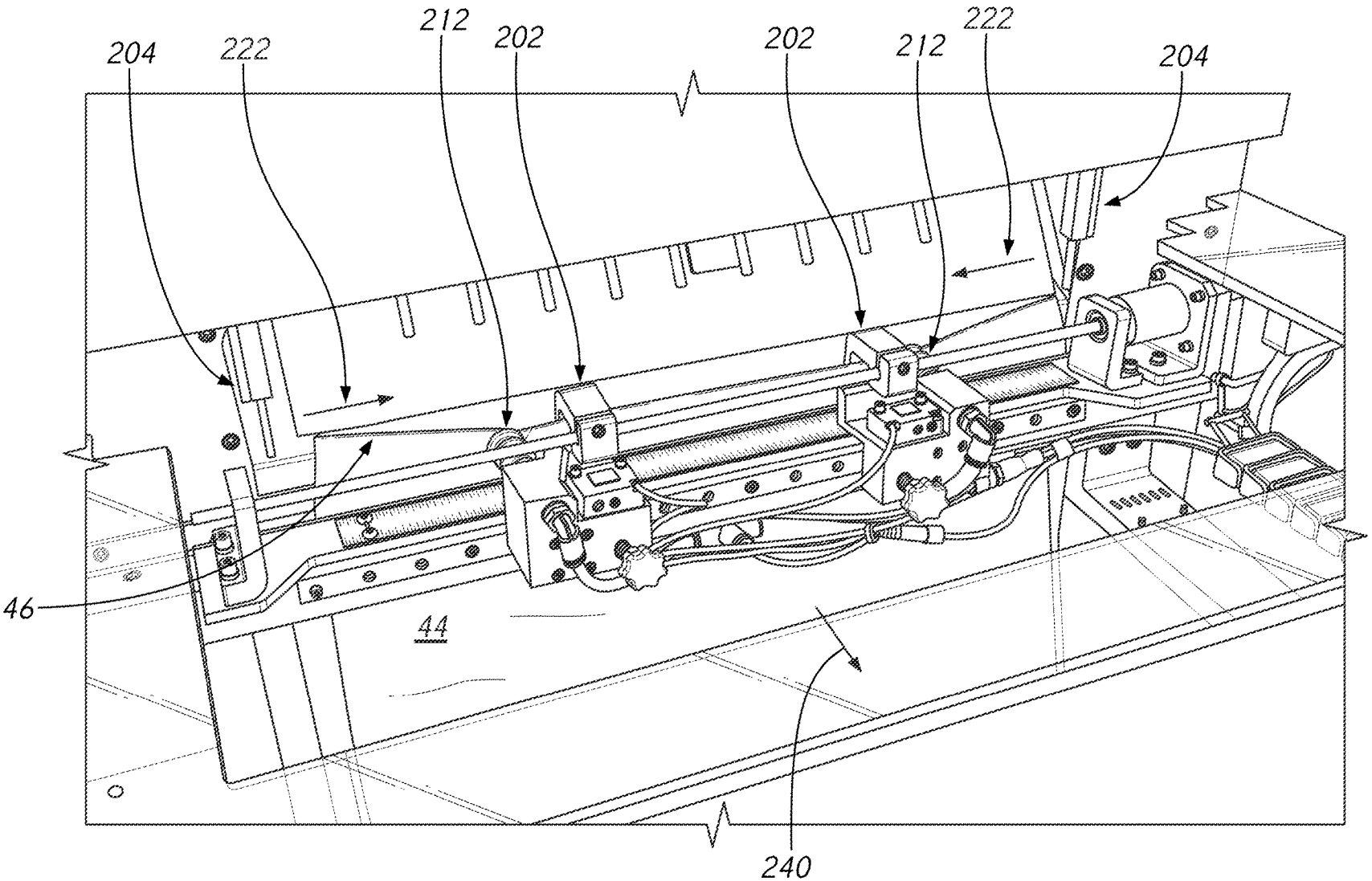

An operational sequence can begin with the web 10 advancing until the opening 62 is positioned above the sealing area 216, as shown in FIG. 20A, with the opening facing vertically and longitudinally along a length of the packaging unit. The amount of web 10 advancement to properly position the opening 62 may be programmed into the controller sequence based on the bag length (that is, the system may, each time, advance the same amount of web 10) or alternatively computer vision (e.g., an optical sensor) may be used at the inlet 218 to pause the advancement of the web 10 when the presence of the region of weakness 50 is at an appropriate location of the bag inlet 218. The bagging machine 200 can include a control panel 220 (as shown in FIG. 16) configured to control one or more of the functions of the bagging machine 200. As shown in FIG. 20B, the sequence continues with the initial opening of the packaging container 44. The bagging machine 200 may utilize a vacuum assist device (e.g., suction cups 212) (and/or an air knife or other suitable device) to slightly enlarge the opening 62 to allow for the insertion of the fingers (e.g., rear fingers 204 and front moveable fingers 202) into the opening 62. In this and previous stages, the rear film-control elements (e.g., fingers 204) may be in a disengaged position relative to the web 10 (e.g., in this example, positioned outward of a perimeter of the web 10). As shown in FIG. 20C, after the initial opening 62 is provided, the front film-control elements are deployed (e.g., fingers 202 are rotated down into the opening 62 to grip the front side of the packaging container 44). At this time, the rear film-control elements (fingers 204) are also deployed and, as shown in FIG. 20D, the rear fingers 204 are moved towards the centerline of the inlet 218, as shown by arrows 222. In some embodiments, the rear fingers 204 are translated inward to positions in which the rear fingers 204 substantially align with the front fingers (or telescopic projections) 202, at which point they may be transversely extended into the opening 62. In other embodiments, the fingers 204 can be advanced to different transverse positions (e.g., to a position in which they are closer together than the front fingers 202) before they are extended into the packaging container 44. In the case of telescoping fingers 204, for example, air pressure may be used to deploy the telescoping portion into the packaging container 44 (e.g., via a release of pressurized air against the telescoping portions 224 of the fingers 204).

Figure 19:
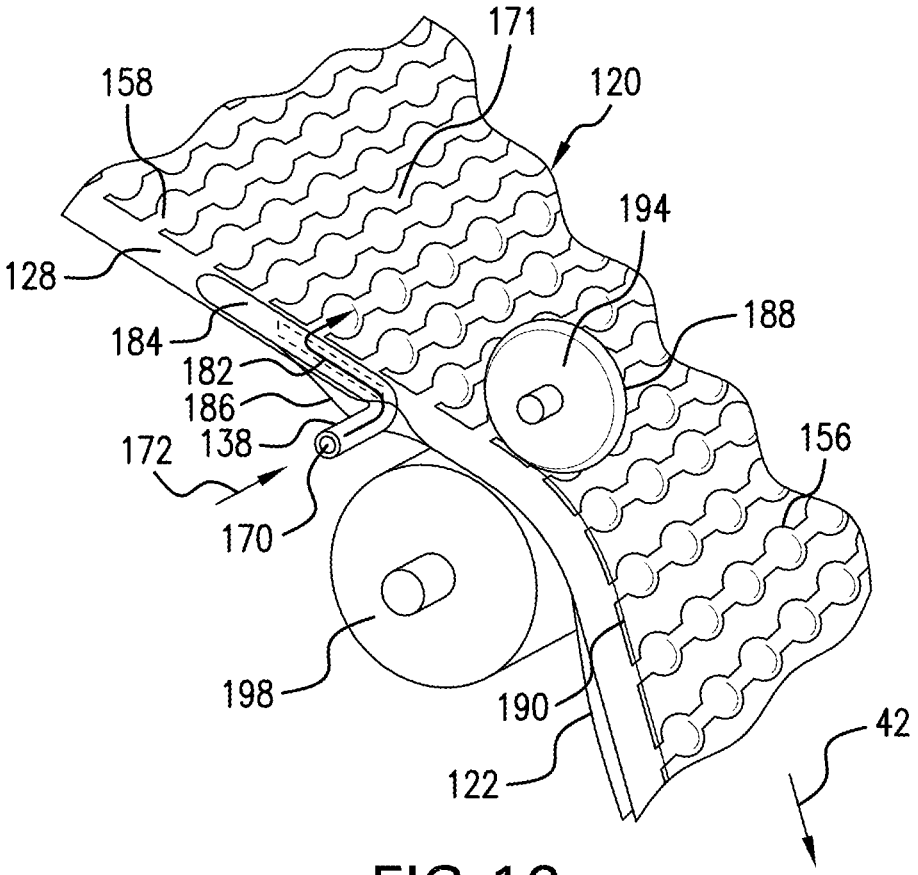
FIG. 19 is a perspective view of an expansion and bagging device according to an embodiment.
Figure 20E:
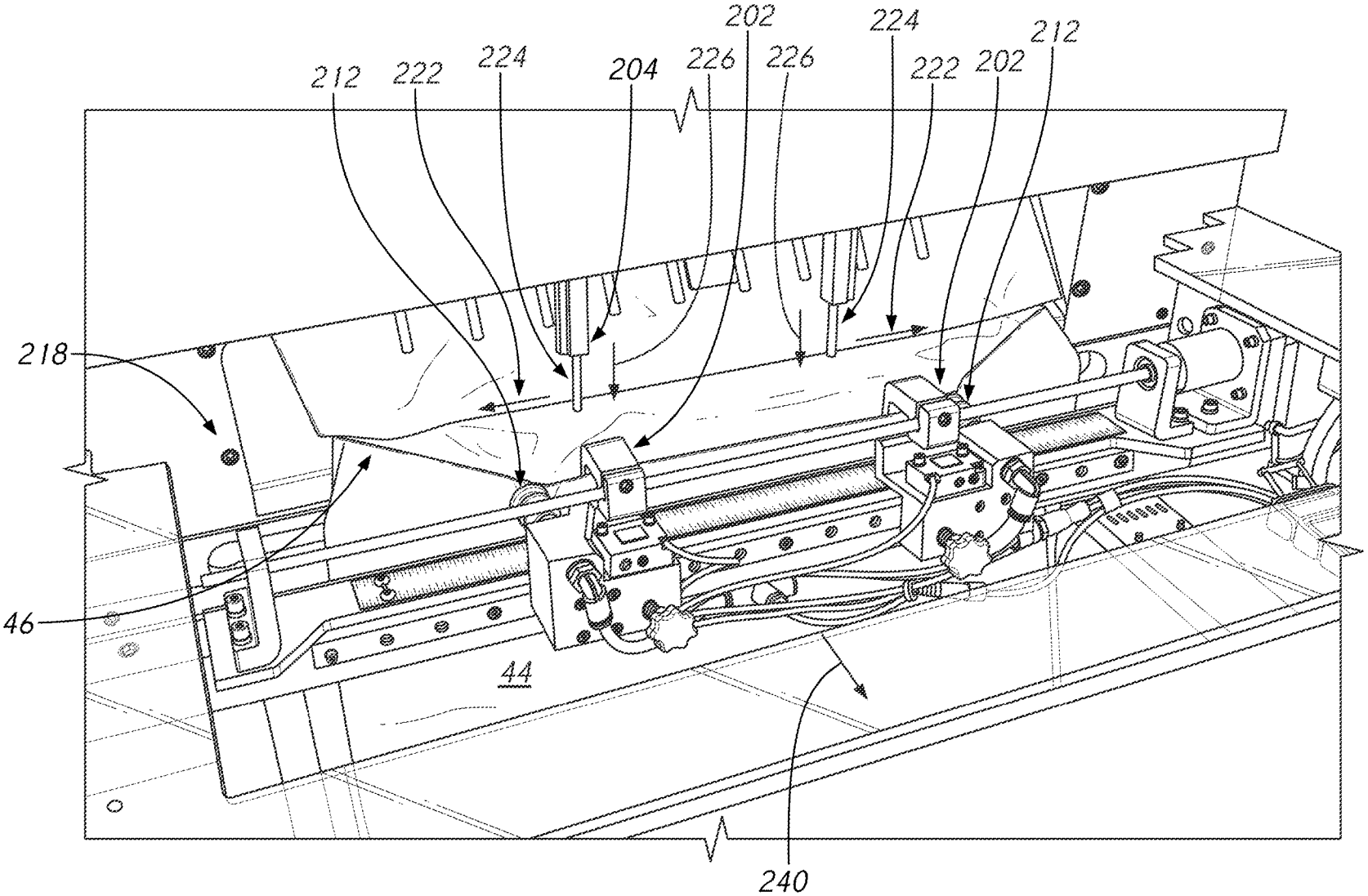
Figure 20F:
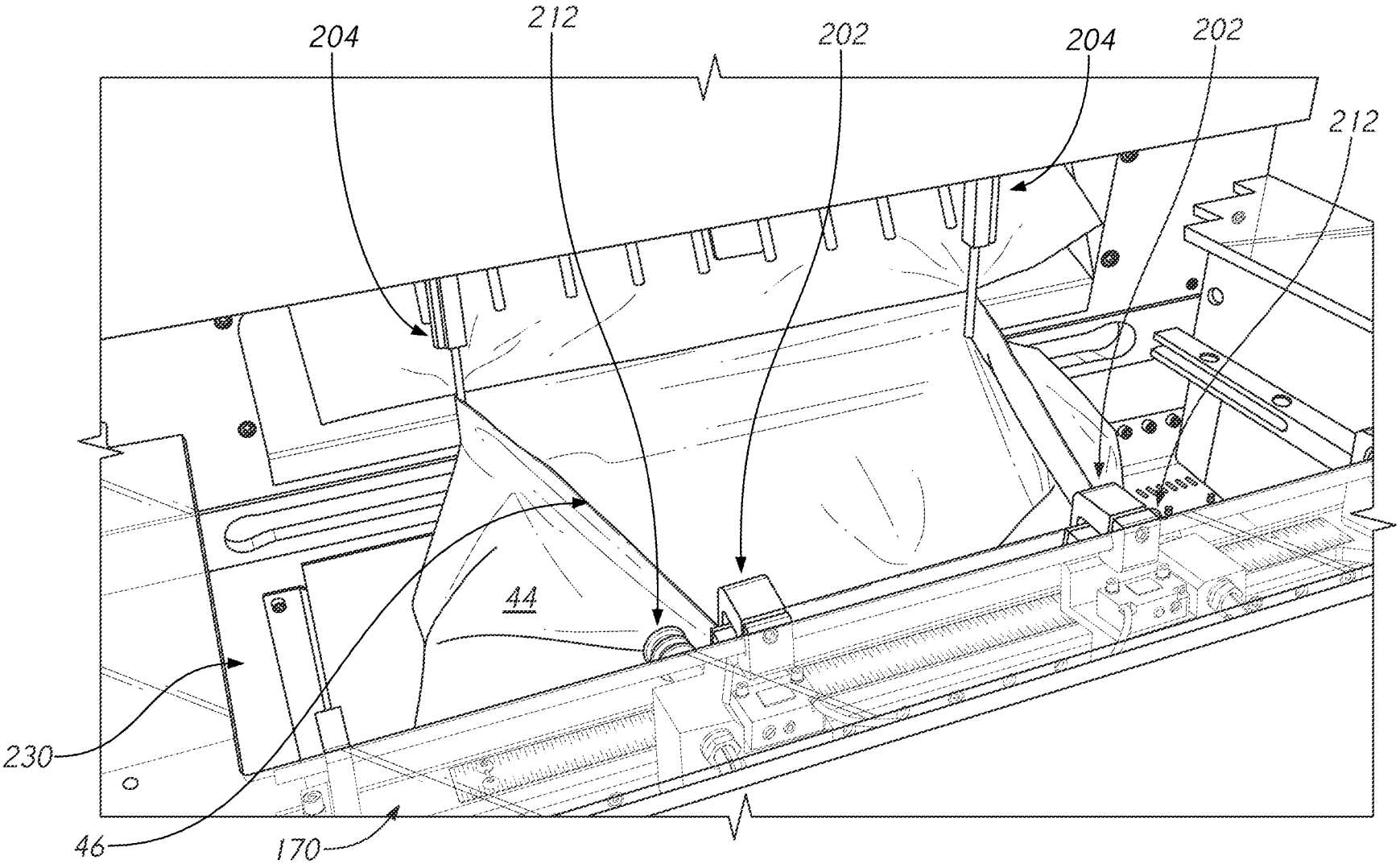

As shown in FIG. 20E, the extension of the fingers 204 into the opening 62 (along direction 226) may be performed concurrently with (or shortly before) the spreading outward of the fingers 204 (along direction 226) and also while the front fingers 202 are advanced away from the bag inlet 218 (along the opening direction 240), which causes the opening 62 to become tautly engaged between the rear and front fingers 204, 202, as shown in FIG. 20F. The front fingers 202 may be mounted on a moveable structure 203 (as shown in FIGS. 18A-18B and 19) configured to enable movement of the front fingers 202. In some embodiments, the suction cups 212 are mounted to the moveable structure 203.

As shown in FIG. 20F, leading up to this point, a portion of the rear perforation, near the longitudinal edges of the web 10 may tear or have torn. However, a least a portion (e.g., up to 50% and typically more than 50%) of the rear perforations remain intact to keep the packaging container 44 attached to the web 10 until product loading is complete. At this point, the packaging container 44 is ready for product to be loaded into it the interior cavity 46, which may be performed by a human operator or a robot operator controlled by the bagging machine 200. In the case of a human operator, the control system 220 may display instructions to the user (e.g., for loading the packaging container 44) and/or may await operator input, which may be provided by the user placing his or her hands on the hand stations or contacts associated with a safety shroud 228 to indicate that the product has been provided in the packaging container 44 and that the operator's hands are free from the bagging area 230. In the case of a robot operator, a signal indicated the completion of the product loading sequence may be generated in the background and transmitted to the controller to automatically initiate the bag closing and sealing stages of the process.

Figure 20G:
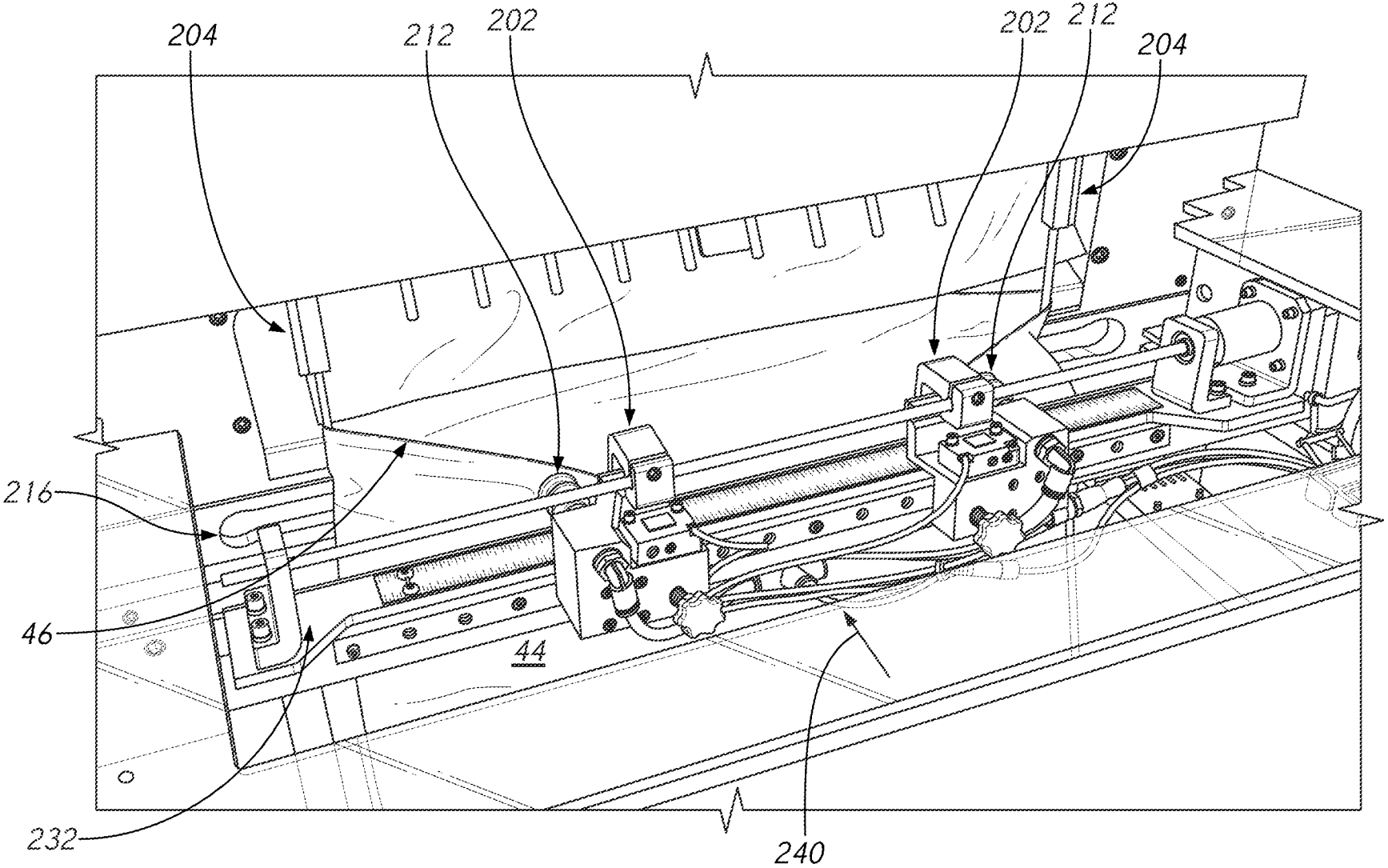

As shown in FIG. 20G, during bag closing, a pressure plate 232 is advanced in the bag closing direction 234 while the front fingers 202 remain in the closed position gripping the front side of the opening 62. The bagging machine 200 can further include a pad 236 (as shown in FIG. 20A) (e.g., a foam pad) configured to apply pressure to the bag to remove air from the packaging container 44. Concurrently, the rear fingers 204 are translated outward (in the direction 222) to widen the bag opening 62 and thus flatten out the top portion of the packaging container 44, preparing it for the sealing operation. During the sealing operation, the pressure plate 232 is pressed against the sealing area 216 allowing the bumper on the pressure plate 232 to resiliently deform thereby applying a suitable amount of pressure against the front and rear sides of the bag to effect the sealing operation.

Figure 20H:
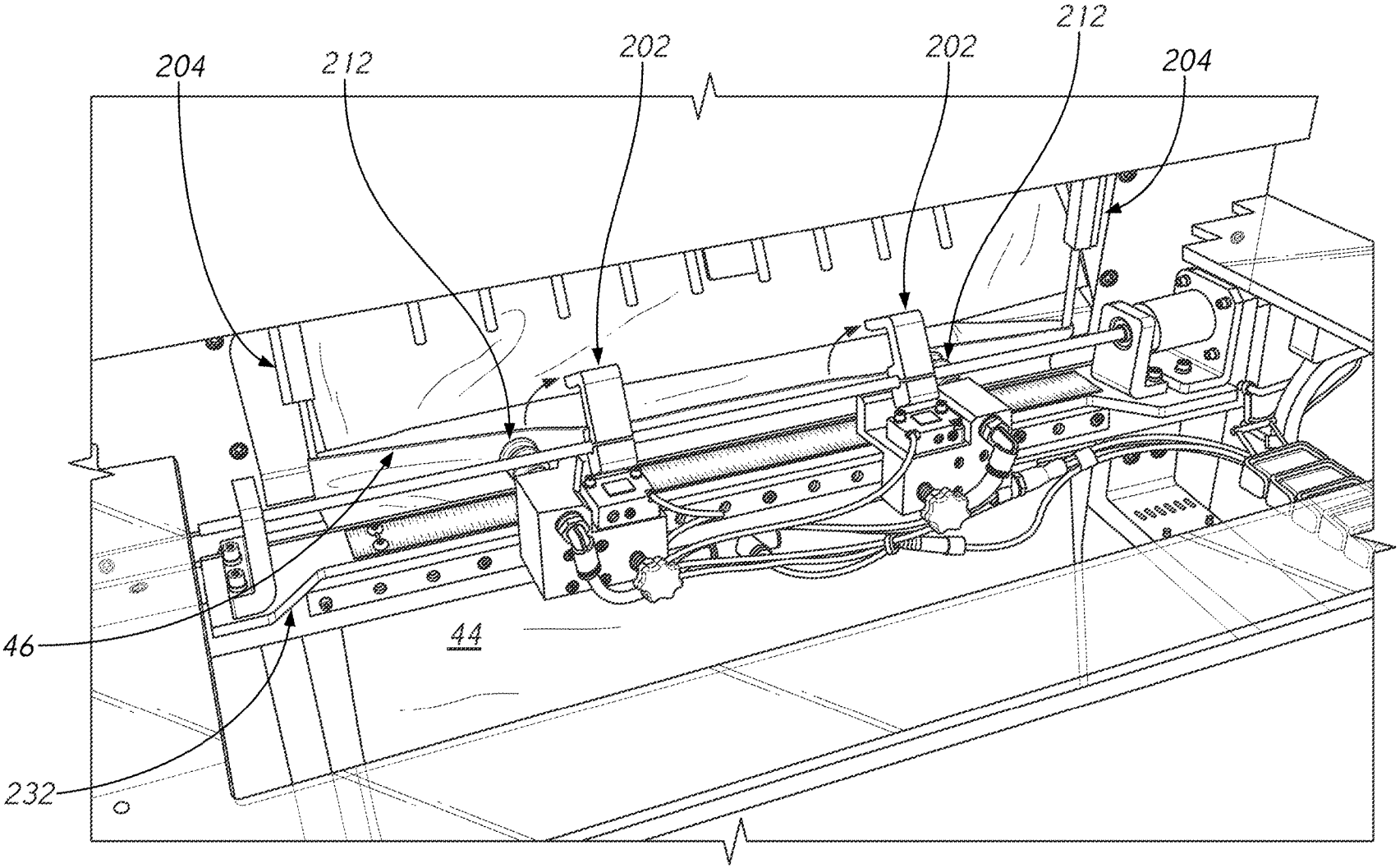
Figure 20I:
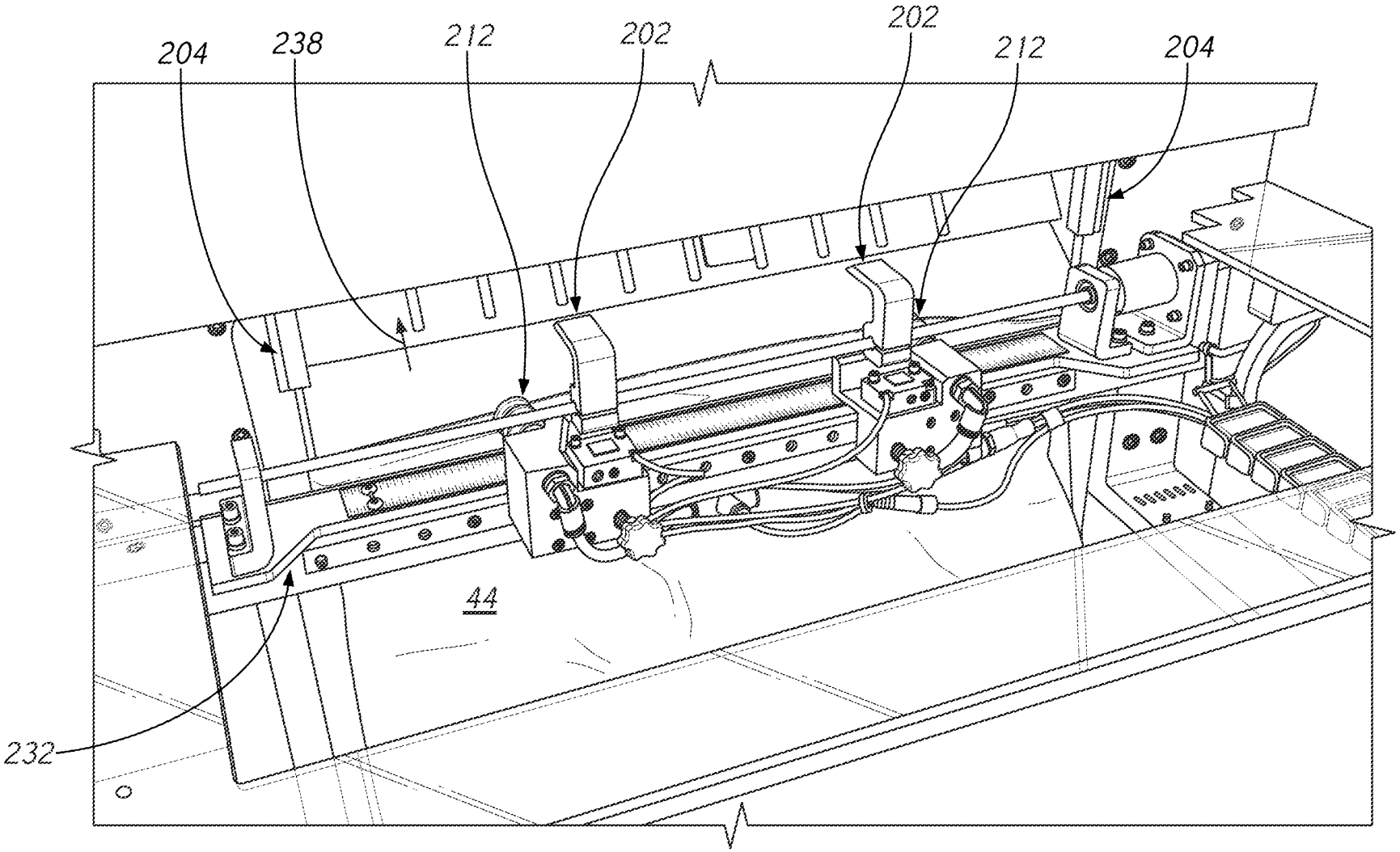

As shown in FIG. 20H, as the pressure plate 232 engages the sealing area 216 and/or the sealing operation is complete, the front fingers 202 are disengaged from the opening 62 (e.g., pivoted to the open position), while the rear fingers 204 remain in engagement with the outer edges of the opening 62. This maintains the opening 62 flat during the completion of the sealing operation. In some embodiments, the pressure plate 232 includes a sealing mechanism 233 such as, for example, a heating element (such as shown in FIGS. 18B and 19). Upon completion of the sealing operation, the rear region of weakness 50 is torn, for example by reversing the web 10 (along direction 238) as shown in FIG. 20I, thereby separating the filled and sealed packaging container 44 and releasing the sealed packaging container 44 towards the bag outlet.

Figure 21A:
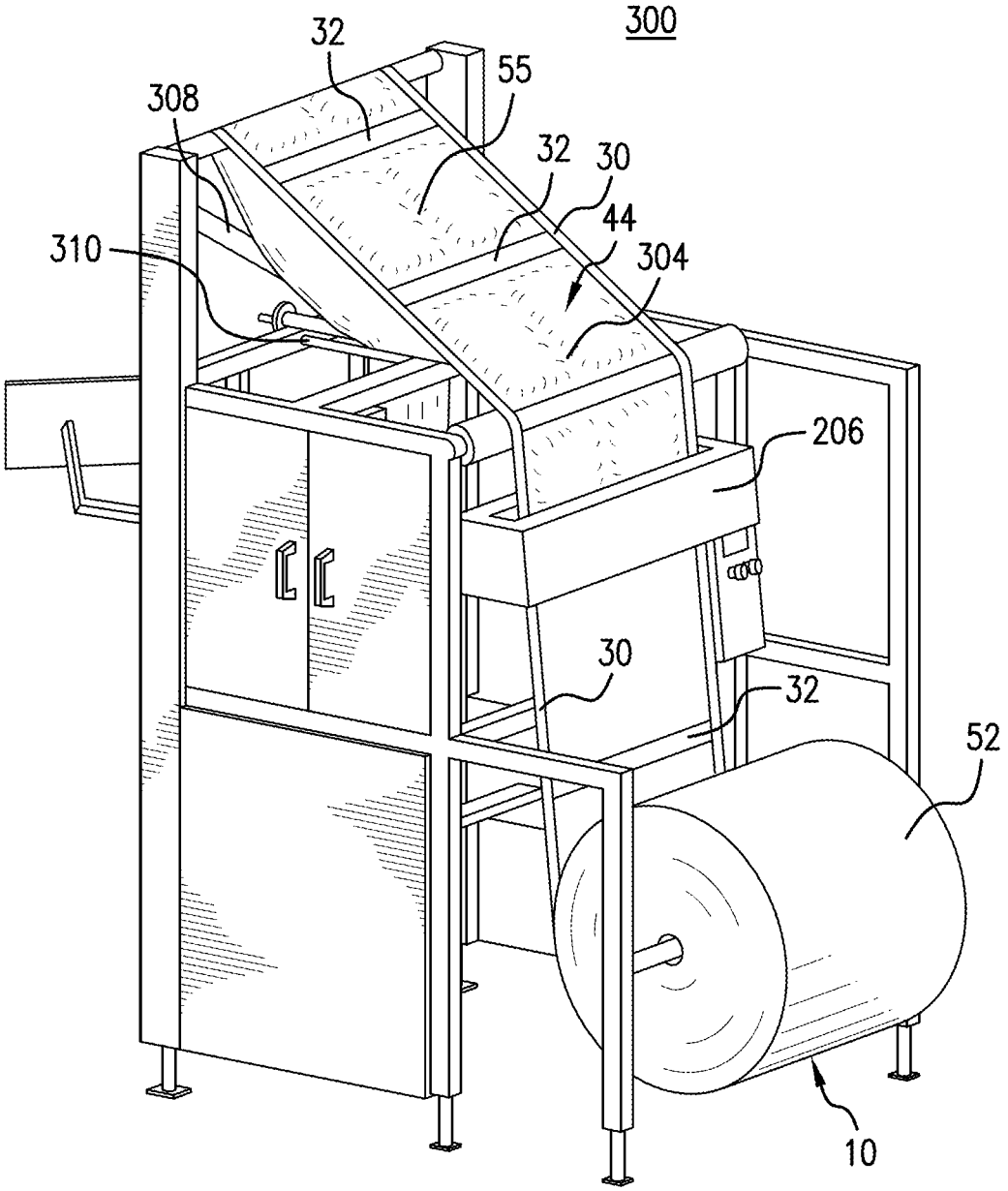
FIGS. 21A and 21B are rear and front perspective views of a bagging device according to an embodiment.
Figure 21B:
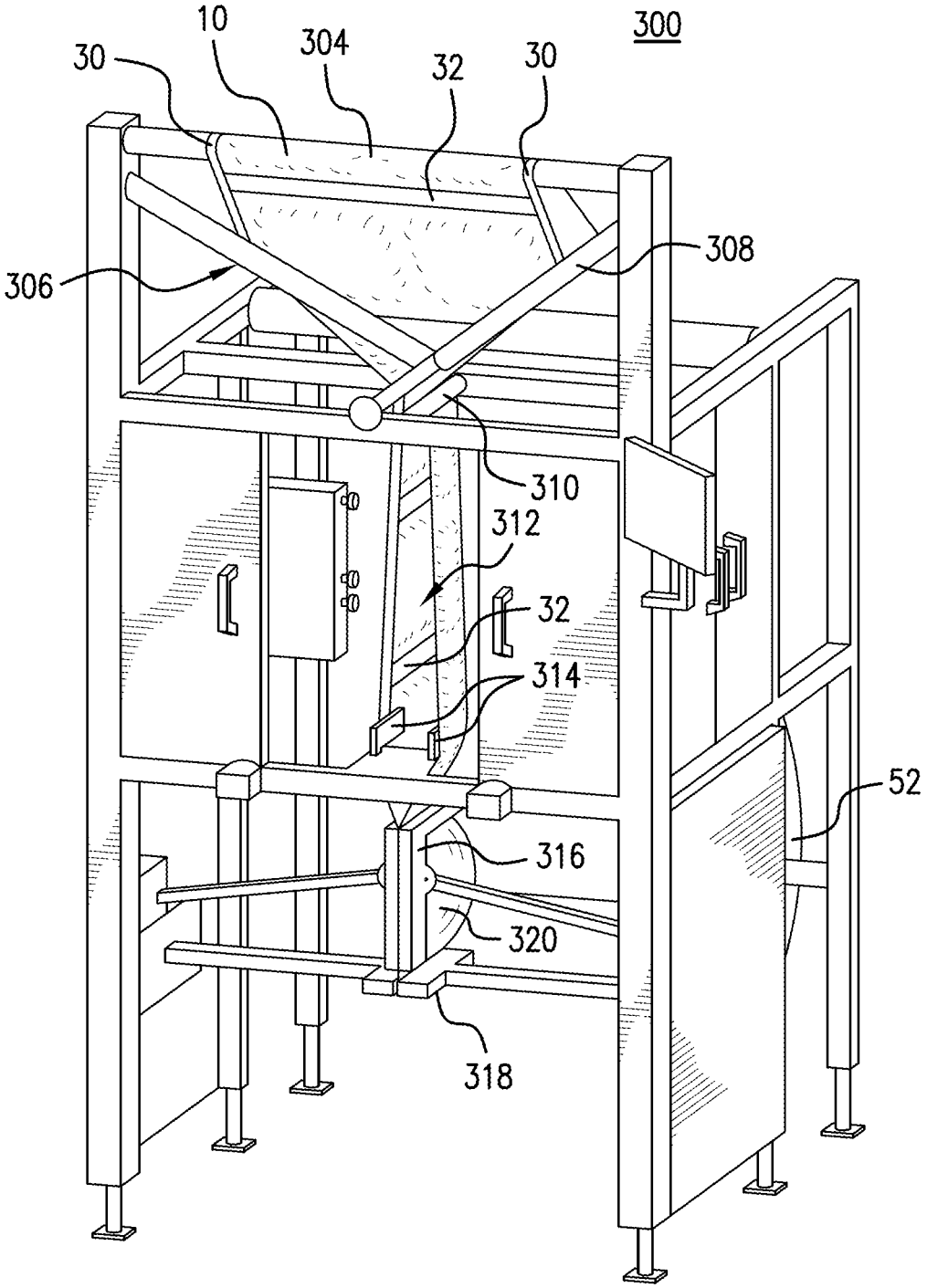

As shown in FIGS. 21A-21B, a bagging machine 300 is configured to both convert and seal the web 10 into one or more completed packaging containers 302. The web 10 is fed into the bagging machine 300 in an unexpanded, high-density configuration. The web 10 can be in a roll configuration 52. In other embodiments, the web 10 may be in one or more other unexpanded, high-density configurations such as, for example, a fanfold configuration.

Once fed into the bagging machine 300, the web 10 passes through an expansion device 206 configured to expand the expandable element of the web 10. According to some embodiments, a section 304 of the web 10 is left unexpanded to facilitate folding of the web 10. In some embodiments, lines of the web 10 can be left free of expansion material 20 to form natural hinge lines or regions that are more easily bent than other regions in which the expansion material 20 is expanded. In some embodiments, pressure is applied to the expansion material 20 during or subsequent to expansion, forming hinge lines or regions at section 304 that are more easily bent than other regions.

The expanded web 10 proceeds to be fed through a folding apparatus 306 configured to fold the web 10 such that the longitudinal edges of the web 10 come into contact with each other. The folding apparatus 306 may include one or more folding bars 308 configured to fold the web 10 into a C-fold formation. The folding apparatus 306 can fold the web 10 at section 304 or at one or more other sections. The folding apparatus 306 may further include a cross-bar 310 configured to align the web 10 such that the folded web 10 forms an interior cavity 312. Once folded, a series of retaining mechanisms (e.g., fingers 314) hold open the web 10, enabling one or more products to be placed into the interior cavity 312. In FIG. 21B, the web is positioned vertically while the product is placed into the interior cavity 312 horizontally, while the opening is transverse to a longitudinal direction of the web. In other embodiments, the web can be positioned horizontally or at another suitable angle (e.g., with the opening to the interior cavity 312 facing upwards).

Once the product is placed into the interior cavity 312, the web 10 is fed to a sealing mechanism 316 configured to seal the longitudinal seal and transverse seals of the web 10. The sealing mechanism 316 can be configured to apply heat, pressure, and/or other suitable means of setting the seals. In some embodiments, the sealing mechanism 316 is configured to pull the web through the bagging machine 300 for sealing. Once sealed, the web 10 is converted into a formed and sealed bag 302. According to some embodiments, the bagging machine 300 includes a separating mechanism 318 configured to separate a bag 44 from the web 10. In some embodiments, the separating mechanism 318 is configured to pull on the completed bag 320, tearing the completed bag 320 from a subsequent bag along a region of weakness 50. In some embodiments, the separating mechanism 318 is configured to separate the bag 320 via cutting via a blade or heat. In some embodiments, the separating mechanism 318 may incorporate other suitable means of separation. According to some embodiments, the separating mechanism 318 is configured to hold the bag 302 in place to enable the sealing mechanism 316 to seal a subsequent bag.

Figure 22A:
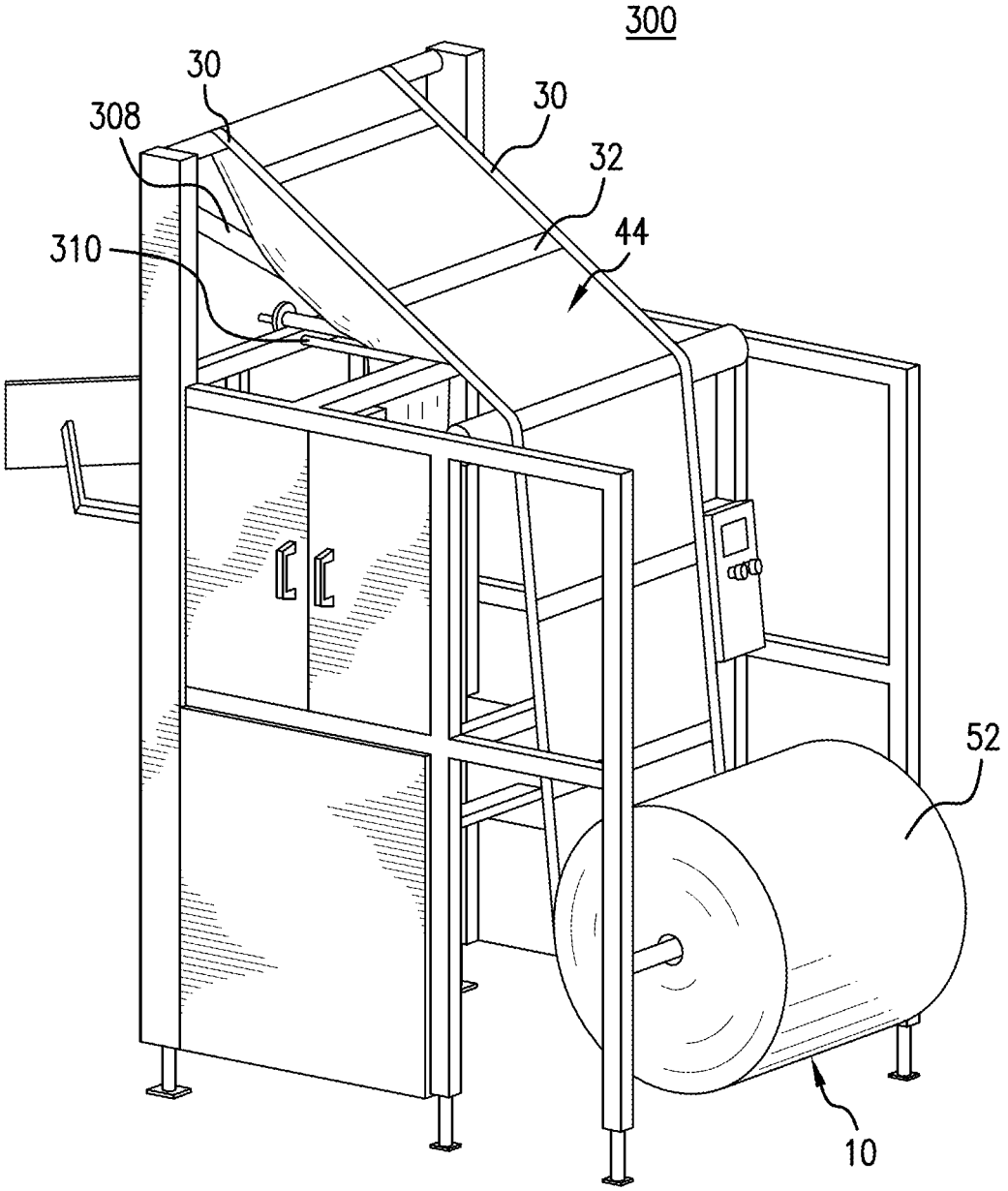
FIGS. 22A and 22B are rear and front perspective views of a bagging device according to an embodiment.
Figure 22B:
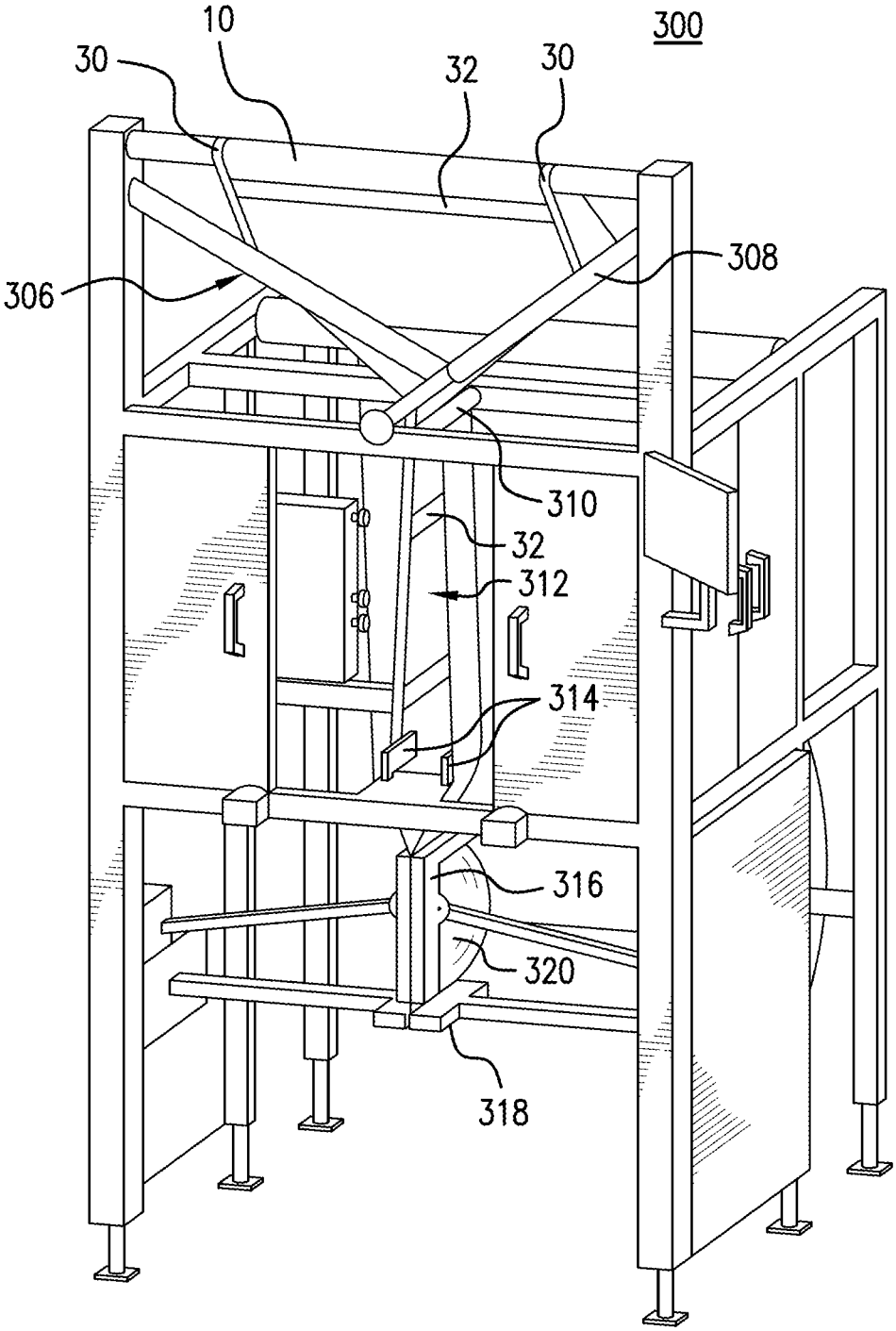

In some embodiments, such as shown in FIGS. 22A-22B, bagging machine 300 does not include an expansion mechanism 206 and the web 10 is not expanded.

As shown in FIG. 19, some embodiments of a packaging material expansion device 206, such as the expansion and bagging devices described above, that is used with an inflatable web that includes one or more inflatable chambers/cavities 156 which, after inflation, must be sealed, such as web 120 shown in FIG. 15A or another suitable inflatable web. The expansion device 206 includes an inflation nozzle 170 that delivers fluid to inflation chambers 156 of the web 120, such as via inflation channel 152. In this embodiment, the nozzle 170 has a longitudinally elongated portion 138 that is configured to be received in a circumferentially closed inflation channel 152 to guide the inflation channel 152 thereover and into the sealing mechanism 188.

The fluid may be provided in path 172, from a suitable source such as, for example, an air compressor, fan, or compressed air supply. In other embodiments, other suitable fluids can be used. In this embodiment, the fluid exits the nozzle 170 via a radial opening 184, which in this embodiment is aimed generally transversely, into the inflation channel 152 and inflation chambers 156. For embodiment that use a circumferentially closed inflation channel, a slitting device, such as blade 186, is provided adjacent the nozzle 170 to cut open the inflation channel 152 to allow the web 120 to come off of the nozzle 170 as it moves downstream therefrom. In embodiments that use an inflation region that is open circumferentially, a slitting device is typically not required.

Once filled, a sealing mechanism 188 is configured to seal the fluid chambers/cavities 156 closed, forming a longitudinal seal 190 that seals off the fluid connection channel 158 between the inflation channel 152 and inflatable chambers 156, typically crossing longitudinally over the transverse seals 171 that define the inflation chambers 156. The sealing mechanism 188 of this embodiment includes an upper roller 194 and a lower roller 198 configured to apply pressure and heat to the web as the web passes in direction 42 sufficient to longitudinally heat seal the webs 10 together. In embodiments in which a different type of sealing is used, a suitable alternative sealing mechanism is selected. Other known inflation and sealing devices can be used in an expansion and bagging device, for example such as the mechanisms disclosed in U.S. Patent Publication No. 2019/0291907.

Figure 23:
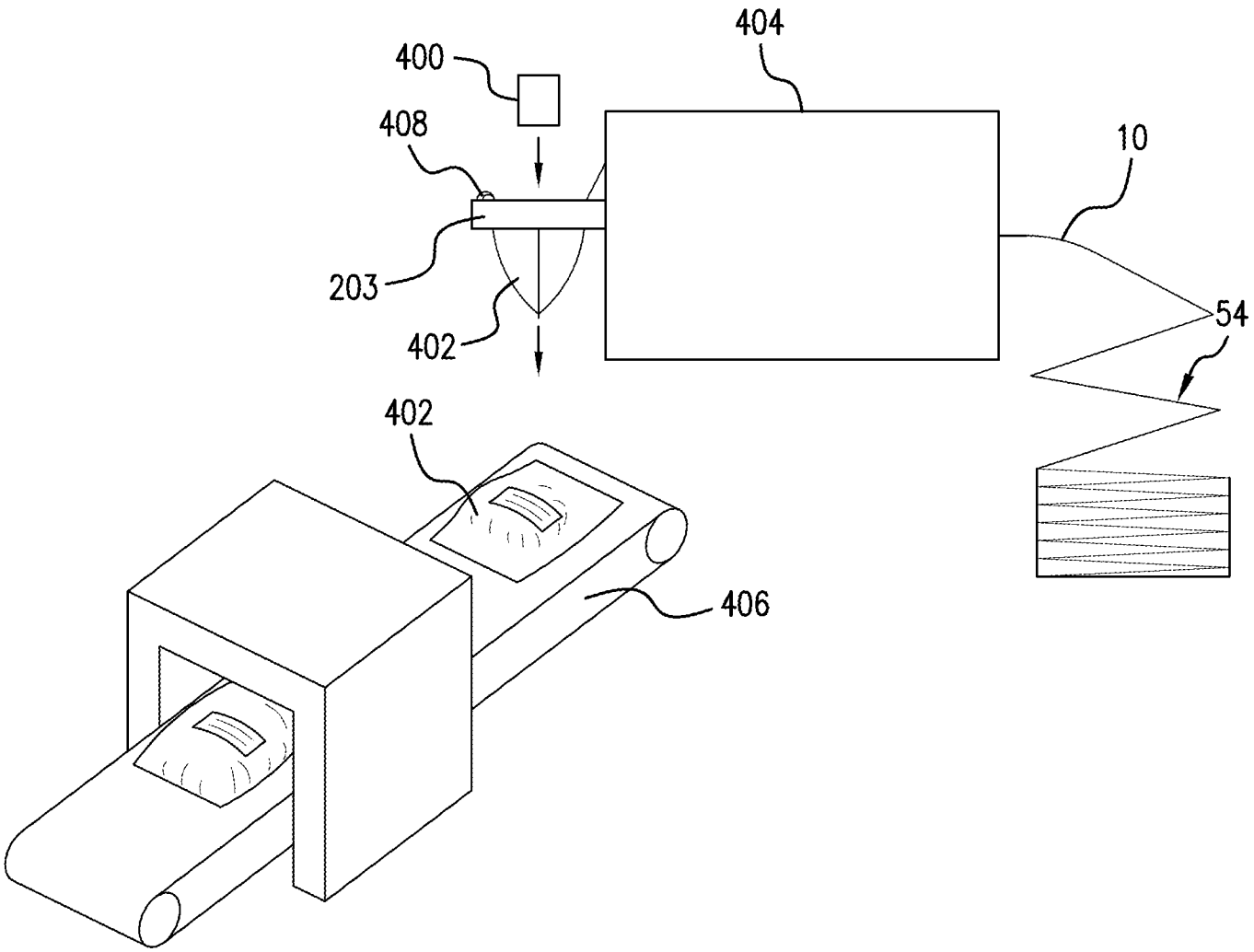
FIG. 23 is a perspective cutaway view of an expansion device of an expansion and bagging device for use with an inflatable web of packaging material in accordance with an embodiment.

As shown in FIG. 23, an opening to a packaging container 402 is expanded using an expander 408, enabling a product 400 to be inserted into the packaging container 402. Once the product 400 is inserted into the packaging container 402, the packaging container 402 is sealed and leaves the bagging mechanism 404 and is transported, via a transport mechanism 406, for shipment. The bagging mechanism 404 can be a bagging mechanism as described herein such as, for example, bagging mechanism 200.

Figure 24:
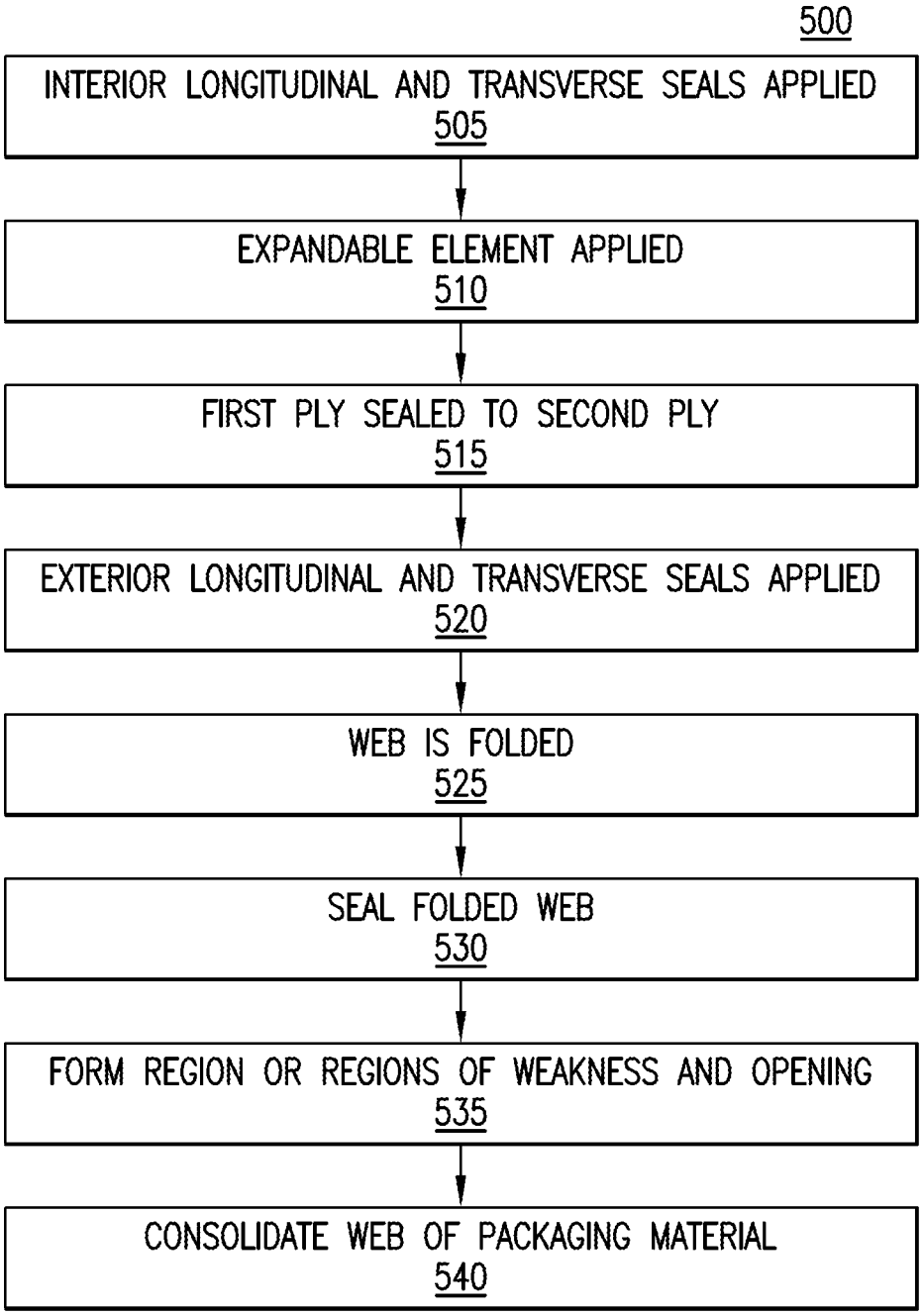
FIG. 24 is a flowchart of a method for generating one or more packaging elements, in accordance with various embodiments.

According to the method 500 of FIG. 24, a web of packaging material is generated. The web can include one or more plies. The web can include one or more of a first ply, a second ply, and an expandable element coupled to the first ply and/or the second ply. One or more of the plies can include paper (e.g., cardboard, kraft paper, fiberboard, pulp-based paper, recycled paper, newsprint, and coated paper such as paper coated with wax, plastic, water-resistant materials, and/or stain-resistant materials), plastic, cellulose, foil, poly or synthetic material, biodegradable materials, and/or other suitable materials of suitable thicknesses, weight, and dimensions. The plies can include recyclable material (e.g., recyclable paper). The expandable element can be positioned between the first ply and the second ply. When applied, the expandable element is in an unexpanded configuration. Referring to the flow chart, the method 500 is described using suitable devices and systems described herein. Suitable devices and systems include, for example, but not limited to, system 70 of FIGS. 11A-11B, bagging machine 200 of FIGS. 16-17 and 19, bagging machine 300 of FIGS. 21A-21B and 22A-22B.

Generating the web can include forming one or more regions of weakness along the web. The one or more regions of weakness can be positioned along the first ply and/or the second ply and configured to enable separation of one packaging element from another packaging element. The one or more regions of weakness can include one or more scores, slits, perforations, ticks on one or more longitudinal edges of the web, one or more combination of the aforementioned, and/or other suitable forms to regions of weakness.

At 505, one or more interior longitudinal layers of sealing material and one or more interior layers of sealing material are applied, using a sealing applicator, to a first ply, a second ply, and/or both the first ply and the second ply. Each of the interior longitudinal layers of sealing material is positioned along one or more longitudinal edges of an interior surface of the first ply and/or the second ply. The one or more interior transverse layers of sealing material applied to an interior surface of the first ply or the second ply and are transverse to the one or more longitudinal layers of sealing material. In some embodiments, one or more of the layers of sealing material are strip seals or other configurations and/or types of sealing material as described herein.

At 510, an expandable element is applied between the first ply and the second ply, using an expansion material applicator. In other embodiments, no expandable material is applied.

The expandable element can include one or more inflatable chambers. The one or more inflatable chambers can include one or more cavities configured to be filled with a fluid, such as air or other suitable fluid.

The expandable element can include one or more expansion materials in an unexpanded configuration. The one or more expansion materials can include an emulsion-based polymer that includes starch, vinyl acetate ethylene, polyvinyl acetate, polyvinyl alcohol, one or more polyvinyl acetate copolymers, one or more polyvinyl alcohol copolymers, dextrin stabilized polyvinyl acetate, one or more polyvinyl acetate copolymers, one or more vinyl acetate copolymers, one or more ethylene copolymers, vinylacrylic, styrene acrylic, acrylic, styrene butyl rubber, polyurethane, biodegradable materials (e.g., cellulose), and/or other suitable expansion materials. In some embodiments, the expansion material includes a gas or a mixture of gases. Examples of suitable gases include air, carbon dioxide, nitrogen, argon, helium, methane, ethane, propane, isobutane, n-butane, neopentane, and the like. In some embodiments, the gas or mixture of gases are added to the expansion material by mechanical means. Examples of mechanical means include whisking or frothing the expansion material to beat the air or other gases into the expansion material and increase its volume. The gas or mixture of gases can also be encapsulated in microspheres and released when the microspheres are activated to expand the expansion material.

In some embodiments, the expansion material can include a polyolefin based adhesive or a polyolefin dispersion. The polyolefin dispersion can include polyethylene and/or polypropylene, and/or other suitable polyolefin dispersions. A suitable polyolefin dispersion can include, for example HYPOD™, from Dow Chemical, or other suitable polyolefin dispersions. The expansion material can be applied to the web as a continuous layer or in a pattern. The pattern can be configured such that, when the plies are pressed together, the expansion material spreads out, forming a continuous layer.

In some embodiments, the expansion material can include an adhesive and thermally expandable microspheres combined with the adhesive to generate a thermally expandable adhesive. The microspheres can be mixed with the adhesive prior to application on the web, or layered on top of the adhesive after it has been applied to the web enabling the microspheres to be forced into the adhesive when the plies are pressed together. For example, the expansion material can include an adhesive applied to a first ply with microspheres applied loosely to a surface of the adhesive. Microspheres that do not stick to the adhesive can then be collected and discarded or reused, and the microspheres that stick to the adhesive are pressed into the adhesive when a second ply is applied over the first ply, sandwiching the adhesive and the microspheres between the first ply and the second ply.

At 515, using a pressure applicator, the first ply is sealed to the second ply by applying pressure to the first ply and the second ply, causing the first ply and the second ply to join at the one or more interior longitudinal layers of sealing material and the one or more interior transverse layers of sealing material.

After the first ply is sealed to the second ply, at 520, one or more exterior longitudinal layers of sealing material are applied to an outer surface of the second ply, using a longitudinal seal applicator, and one or more exterior transverse layers of sealing material are applied to the outer surface of the second ply, using a transverse seal applicator. The one or more exterior transverse layers of sealing material are transverse to the one or more exterior longitudinal layers of sealing material. The one or more exterior longitudinal layers of sealing material and the one or more exterior transverse layers of sealing material include a heat sealing material. In some embodiments, the one or more exterior longitudinal layers of sealing material each form a seal at a temperature different from a temperature required to form a seal using at least one of the one or more exterior transverse layers of sealing material. In some embodiments, the one or more exterior longitudinal layers of sealing material include different sealing properties from sealing properties of the one or more exterior transverse layers of sealing material. In some embodiments, the one or more exterior transverse layers of sealing material include exterior transverse layers of sealing material of a first seal-type and exterior layers of sealing material of a second seal-type.

The web, at 525, is then folded, using a folding apparatus, along a folding edge. Once folded, the web, at 530, is sealed, using a sealing apparatus, along the one or more exterior longitudinal layers of sealing material and along the one or more exterior transverse layers of sealing material, forming a series of bag formations, each bag formation including an interior cavity configured to receive one or more products.

At 535, one or more regions of weakness in the web are formed using a cutting apparatus. The region of weakness includes one or more of the following: scores; slits; perforations; or ticks on the one or more longitudinal edges of the web. Forming the region of weakness can include forming an opening to enable access to the interior cavity. In some embodiments, the one or more exterior transverse layers of sealing material can include a sealing material positioned along the opening, configured to form a seal that seals off the opening. In some embodiments, the sealing material positioned along the opening and one or more other exterior transverse layers of sealing material are of differing seal types. In some embodiments, the sealing material positioned along the opening and one or more other exterior transverse layers of sealing material are of differing seal types.

In some embodiments, the cutting apparatus includes a series of teeth. In some embodiments, the one or more exterior transverse layers of sealing material are positioned along or adjacent to the region of weakness.

At 540, the web of packaging material is consolidated, using a consolidating apparatus, into an unexpanded, high-density configuration. The unexpanded, high-density configuration may be a rolled configuration, a fanfold configuration, and/or other suitable high-density configurations.

Examples of components that may be utilized within an inflation and sealing device, including without limitation, the nozzle, blower, sealing assembly, and drive mechanisms, and their various components or related systems may be structured, positioned, and operated as disclosed in any of the various embodiments described in the incorporated references such as, for example, U.S. Pat. Nos. 8,061,110 and 8,128,770; U.S. Patent Publication No. 2014/0261752; and U.S. Patent Publication No. 2011/0172072 each of which is herein incorporated by reference. Each of the embodiments discussed herein may be incorporated and used with the various sealing devices of the incorporated references and/or other inflation and sealing devices. For example, suitable mechanisms discussed herein and/or in the incorporated references may be used in the inflation and sealing of webs 10 and 120. Examples of one or more of the inflation openings or ports can include a one-way valve such as those disclosed in U.S. Pat. No. 7,926,507, herein incorporated by reference in its entirety. Examples of bagging machines such as bagging maching 200 of FIGS. 16-17 and 18, can further function in accordance with U.S. Patent Publication No. 2020/0115082, filed Oct. 11, 2019 and incorporated herein by reference. Examples of suitable systems and methods for providing expandable material such as, for example, that shown in FIGS. 1, 3, 5-6, 9-10, 11A-11B, and 14, are disclosed in U.S. Provisional Patent Application No. 62/706,111, filed Jul. 31, 2020, titled "METHOD OF MAKING AN EXPANDABLE WEB", the content of which is herein incorporated by reference in its entirety. Examples of expandable materials and compositions of expansion materials can be found in U.S. Patent Publication No. 2019/0062028, filed Sep. 11, 2018.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is also to be understood that the terminology used herein is for describing particular examples only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. Packaging material, comprising:

at least one web layer having a surface that includes first and second regions, wherein, when corresponding first regions are overlaid with each other and corresponding second regions are overlaid with each other, the overlaid first and second regions cooperatively surrounding a cavity defined between the at least one web layer;

a first sealing material disposed in the first region and configured to seal together the corresponding first regions of the at least one web layer upon application of first conditions to the first sealing material; and a second sealing material disposed in the second region and configured to seal together the corresponding second regions of the at least one web layer upon application of second conditions to the second sealing material;

wherein the first or second conditions include a required temperature or pressure; where the second sealing material is configured such that the first conditions applied to the second sealing material do not cause the second sealing material to seal; and wherein the first conditions include a required first maximum temperature for the first sealing material; wherein the second conditions include a required second minimum temperature for the second sealing material; wherein the second minimum temperature is higher than the first maximum temperature, where the second sealing material; and wherein the at least one web layer forms a plurality of walls of a packaging unit configured to cushion an object to be shipped; and wherein at least one of the walls includes padding configured to provide cushioning to the object.

2. The packaging material of claim 1, wherein the first and second sealing materials are different materials.

3. The packaging material of claim 1, wherein:

at least one of the walls includes a wall cavity positioned therebetween; and the padding is disposed in the wall cavity.

4. The packaging material of claim 1, wherein the padding is positioned along the at least one web layer in sections in order to facilitate folding of the at least one web layer between adjacent sections.

5. The packaging material of claim 1, wherein the padding includes an expansion material.

6. The packaging material of claim 1, wherein the at least one web layer includes a substrate made of paper.

7. The packaging material of claim 1, wherein the first sealing material is disposed over a majority of a surface of the at least one web layer.

8. Packaging material web, comprising:

first and second overlaid plies including a hinge area disposed for folding the overlaid plies over each other at a hinge line that extends through the hinge area to divide the overlaid plies into first and second wall portions on opposite sides of the hinge line, such that the wall portions are folded about the hinge line to a folded configuration, defining an interior cavity therebetween, the interior cavity being configured to receive and house an object;

an expandable material configured, when in an expanded configuration, to cushion the object, the expandable material being disposed between the first and second plies in a main padding area, wherein the hinge area between the plies has less of the expandable material than in the main padding area such that, in the folded configuration, the hinge area is thinner than the main padding area; and a sealing material disposed to affix the wall portions in the folded configuration such that the first and second walls define a packaging unit.

9. Packaging material, comprising:

at least one web layer having a surface that includes first and second regions, wherein, when corresponding first regions are overlaid with each other and corresponding second regions are overlaid with each other, the overlaid first and second regions cooperatively surrounding a cavity defined between the at least one web layer;

a first sealing material disposed in the first region and configured to seal together the corresponding first regions of the at least one web layer upon application of first conditions to the first sealing material; and a second sealing material disposed in the second region and configured to seal together the corresponding second regions of the at least one web layer upon application of second conditions to the second sealing material;

wherein the first or second conditions include a required temperature or pressure; where the second sealing material is configured such that the first conditions applied to the second sealing material do not cause the second sealing material to seal; and wherein the first conditions include a required first maximum temperature for the first sealing material; wherein the second conditions include a required second minimum temperature for the second sealing material; wherein the second minimum temperature is higher than the first maximum temperature, where the second sealing material; and wherein the at least one web layer forms walls of a packaging container when the first regions are sealed to each other, which walls cooperatively bound at least a portion of the cavity, the cavity being a packaging interior cavity that is configured to house an object to be shipped.

10. The packaging material of claim 9, wherein:

the corresponding first regions are sealed to each other by the first sealing material; and the second sealing material is in an unsealed condition, forming an opening to the interior cavity, the opening being configured to receive the object into the interior cavity.

11. The packaging material of claim 10, wherein the second sealing material is configured to seal closed the opening.

12. The packaging material of claim 10, wherein, when the corresponding first regions are sealed to each other and the corresponding second regions abut each other.

13. The packaging material of claim 10, wherein:

the at least one web layer includes a longer web layer and a shorter web layer;

the second region of the longer web layer is positioned on the longer web layer in a direction facing the interior cavity; and the second region of the shorter web layer is positioned on the shorter web layer in a direction facing outwardly from the interior cavity.

14. The packaging material of claim 10, further comprising an assembled web that includes the at least one web layer, which at least one web layer includes a plurality of said walls defining a plurality of said interior cavities, such that the assembled web includes a series of the packaging containers.

15. The packaging material of claim 14, further comprising a region of weakness positioned between adjacent packaging containers in the series of packaging containers, wherein the region of weakness is configured to facilitate separation of the adjacent packaging containers.

16. The packaging material of claim 15, wherein:

one of the walls is interrupted, forming the opening;

the region of weakness is positioned along the other remaining wall; and the opening is overlaid over the region of weakness.

17. The packaging material of claim 14, wherein the at least one web layer is part of a single web that is folded over itself to provide the at least one web layer on each side of the fold.

18. The packaging material of claim 14, wherein the at least one web layer includes a plurality of webs that are overlaid.

19. Packaging material, comprising:

at least one web layer having a surface that includes first and second regions, wherein, when corresponding first regions are overlaid with each other and corresponding second regions are overlaid with each other, the overlaid first and second regions cooperatively surrounding a cavity defined between the at least one web layer;

a first sealing material disposed in the first region and configured to seal together the corresponding first regions of the at least one web layer upon application of first conditions to the first sealing material; and a second sealing material disposed in the second region and configured to seal together the corresponding second regions of the at least one web layer upon application of second conditions to the second sealing material;

wherein the first or second conditions include a required temperature or pressure;

wherein the second sealing material is configured such that the first conditions applied to the second sealing material do not cause the second sealing material to seal;

wherein the at least one web layer includes first and second overlaid plies including a hinge area disposed for folding the overlaid plies over each other at a hinge line that extends through the hinge area to divide the overlaid plies into first and second wall portions on opposite sides of the hinge line, such that the wall portions are folded about the hinge line to a folded configuration, defining the cavity therebetween, the cavity being an interior cavity configured to receive and house an object;

wherein the at least one web layer includes further includes an expandable material configured, when in an expanded configuration, to cushion the object, the expandable material being disposed between the first and second plies in a main padding area, wherein the hinge area between the plies has less of the expandable material than in the main padding area such that, in the folded configuration, the hinge area is thinner than the main padding area; and wherein the first sealing material is disposed to affix the wall portions in the folded configuration such that the first and second walls define a packaging unit.

20. The packaging web material of claim 19, wherein the hinge area is substantially free of the expandable material, providing a gap between portions of the main padding area on the first and second wall portions.

21. The packaging web material of claim 19, wherein:

the first and second overlaid plies include a third wall portion; and the hinge area comprises:

a first hinge area disposed between the first and second wall portions; and a second hinge area disposed between the second and third wall portions; such that the first and third wall portions folded respectively about hinges in the first and second hinge areas each overlays the second wall portion, such that the second wall portion forms a first wall of a packaging container, and the first and third wall portions form a second wall of the packaging container overlaid on the first wall and defining the interior cavity between the walls;

wherein the first sealing material is disposed to seal the first wall to the third wall.

22. The packaging web material web of claim 21, wherein first and third wall portions have longitudinal edges such that, in the folded configuration, the longitudinal edges are disposed above the second wall portion and are sealed together by the first sealing material.

23. Packaging material, comprising:

at least one web layer having a surface that includes first and second regions, wherein, when corresponding first regions are overlaid with each other and corresponding second regions are overlaid with each other, the overlaid first and second regions cooperatively surrounding a cavity defined between the at least one web layer;

a first sealing material disposed in the first region and configured to seal together the corresponding first regions of the at least one web layer upon application of first conditions to the first sealing material; and a second sealing material disposed in the second region and configured to seal together the corresponding second regions of the at least one web layer upon application of second conditions to the second sealing material;

wherein the first or second conditions include a required temperature or pressure;

wherein the second sealing material is configured such that the first conditions applied to the second sealing material do not cause the second sealing material to seal;

wherein the first conditions include a required first maximum temperature for the first sealing material;

wherein the second conditions include a required second minimum temperature for the second sealing material;

wherein the second minimum temperature is higher than the first maximum temperature; and wherein the second sealing material is configured to remain unsealed at the first maximum temperature.

24. Packaging material, comprising:

at least one web layer having a surface that includes first and second regions, wherein, when corresponding first regions are overlaid with each other and corresponding second regions are overlaid with each other, the overlaid first and second regions cooperatively surrounding a cavity defined between the at least one web layer;

a first sealing material disposed in the first region and configured to seal together the corresponding first regions of the at least one web layer upon application of first conditions to the first sealing material; and a second sealing material disposed in the second region and configured to seal together the corresponding second regions of the at least one web layer upon application of second conditions to the second sealing material;

wherein the first or second conditions include a required temperature or pressure; where the second sealing material is configured such that the first conditions applied to the second sealing material do not cause the second sealing material to seal; and wherein the first conditions include a required first maximum temperature for the first sealing material; wherein the second conditions include a required second minimum temperature for the second sealing material; wherein the second minimum temperature is higher than the first maximum temperature, where the second sealing material; and wherein the second sealing material is heat sealable, and application of the second conditions forms a heat seal between the corresponding second regions.

* * * * *